US011573523B2

(12) United States Patent
Wan et al.

(10) Patent No.: US 11,573,523 B2
(45) Date of Patent: Feb. 7, 2023

(54) PROCESSING CARTRIDGE

(71) Applicant: TOPJET TECHNOLOGY CO., LTD, Guangdong (CN)

(72) Inventors: Chengchang Wan, Guangdong (CN); Lujun Liu, Guangdong (CN); Huolin Tian, Guangdong (CN); Yijun Wen, Guangdong (CN)

(73) Assignee: TOPJET TECHNOLOGY CO., LTD, Zhuhai (CN)

( * ) Notice: Subject to any disclaimer, the term of this patent is extended or adjusted under 35 U.S.C. 154(b) by 0 days.

(21) Appl. No.: 17/489,618

(22) Filed: Sep. 29, 2021

(65) Prior Publication Data

US 2022/0100146 A1 Mar. 31, 2022

Related U.S. Application Data

(63) Continuation-in-part of application No. PCT/CN2018/083114, filed on Mar. 26, 2021, and a (Continued)

(30) Foreign Application Priority Data

Mar. 31, 2019 (CN) ..... 201910254373.4
Mar. 27, 2020 (CN) ..... 202020426614.7

(Continued)

(51) Int. Cl.
*G03G 21/16* (2006.01)
*G03G 21/18* (2006.01)

(52) U.S. Cl.
CPC ..... *G03G 21/1842* (2013.01); *G03G 21/1814* (2013.01)

(58) Field of Classification Search
CPC ..... G03G 21/1814; G03G 21/1839; G03G 21/1842; G03G 21/1864; G03G 21/1871
See application file for complete search history.

(56) References Cited

U.S. PATENT DOCUMENTS 5,442,421 A 8/1995 Kojima
2004/0184834 A1* 9/2004 Blaine ..... G03G 21/1821 399/113

(Continued)

FOREIGN PATENT DOCUMENTS

CN 104614968 A 5/2015
CN 107402510 A 11/2017

(Continued)

OTHER PUBLICATIONS

PCT/CN2020/081555 filed Mar. 27, 2020 International Search Report dated Jun. 15, 2020.

(Continued)

*Primary Examiner* — Hoang X Ngo
(74) *Attorney, Agent, or Firm* — Rutan & Tucker, LLP

(57) ABSTRACT

Provided is a processing cartridge detachably installed in an imaging device. The processing cartridge includes a first unit and a second unit, and a movable assembly coupled to and receive force from the force applying portion. When the processing cartridge is assembled to the imaging device, the first t and second units can be switched between states of approaching and separating. The movable assembly comprises an installing part and an acting part movable relative to and connectable with each other. The movable assembly is installed in the processing cartridge by the installing part, the acting part is coupled to the force applying portion and receives force from the force applying portion, to force the first and second units to switch between the two states. The acting part is retractable relative to the installing part and comprises an acting block and a guide block guided by the installing part.

17 Claims, 34 Drawing Sheets

Related U.S. Application Data continuation-in-part of application No. PCT/CN2020/081555, filed on Mar. 27, 2020.

(30) Foreign Application Priority Data

Apr. 16, 2020 (CN) ..... 202020571540.6
May 21, 2020 (CN) ..... 202020884450.2

(56) References Cited

U.S. PATENT DOCUMENTS

| | | | | |
|---|---|---|---|---|
| 2010/0247140 | A1* | 9/2010 | Kikuchi | G03G 21/1853 399/111 |
| 2012/0020699 | A1* | 1/2012 | Kamimura | G03G 21/1642 399/119 |
| 2013/0051846 | A1* | 2/2013 | Kamimura | G03G 15/751 399/117 |
| 2013/0051849 | A1* | 2/2013 | Itabashi | G03G 21/1647 399/119 |
| 2019/0278220 | A1 | 9/2019 | Sakurai | |

FOREIGN PATENT DOCUMENTS

| | | | |
|---|---|---|---|
| CN | 108021011 | A | 5/2018 |
| CN | 109884867 | A | 6/2019 |
| CN | 110133980 | A | 8/2019 |
| CN | 110161825 | A | 8/2019 |
| CN | 209446978 | U | 9/2019 |
| CN | 209707915 | U | 11/2019 |
| CN | 111190333 | A | 5/2020 |
| CN | 111413857 | A | 7/2020 |
| CN | 212181259 | U | 12/2020 |
| CN | 212675366 | U | 3/2021 |
| EP | 2863271 | A1 | 4/2015 |
| JP | 2015084013 | A | 4/2015 |
| WO | 2020/200065 | A1 | 10/2020 |
| WO | 2021190614 | A1 | 9/2021 |

OTHER PUBLICATIONS

PCT/CN2021/083114 filed Mar. 26, 2021 International Search Report dated Jun. 29, 2021.
CN 202020884450.2, First Office Action dated Oct. 16, 2020.
EP 20784970.4 filed Feb. 9, 2022 Extended European Search Report dated Dec. 21, 2022.

* cited by examiner

PROCESSING CARTRIDGE

CROSS-REFERENCE TO RELATED APPLICATIONS

The present application is a continuation of International Application No. PCT/CN2020/081555, filed on Mar. 27, 2020, which claims priority to Chinese Patent Application No. 201910254373.4, filed on Mar. 31, 2019, and a continuation of International Application No. PCT/CN2020/083114, filed on Mar. 26, 2021, which claims priority to Chinese Patent Application No. 202020426614.7, filed on Mar. 27, 2020, to Chinese Patent Application No. 202020571540.6, filed on Apr. 16, 2020, and to Chinese Patent Application No. 202020884450.2, filed on May 22, 2020, the contents of all of which are incorporated herein by reference in their entireties.

TECHNICAL FIELD

The present disclosure relates to the technical field of electronic photo imaging and, in particular, to a processing cartridge detachably installed to an electronic photo imaging device.

BACKGROUND

Current processing cartridges include a toner bin and a waste toner bin which are coupled to each other. The toner bin is configured to contain toner required for development, and to developing member for carrying the toner is rotatably installed in the toner bin. The waste toner bin is configured to contain the waste toner generated by development, and a photosensitive member configured to form an electrostatic latent image is rotatably installed in the waste toner bin. When the processing cartridge is in operation, the developing member contacts the photosensitive member, and the toner carried by the developing member will develop electrostatic latent image formed on a surface of the photosensitive member.

When the processing cartridge is not in operation, in order to prevent deformation of a surface of the developing member or contamination of the surface of the photosensitive member caused by the long-term contact between the developing member and the photosensitive member. The processing cartridge further includes a force bearing portion fixed in the toner bin. Correspondingly, an electronic photo imaging device such as a printer is provided with a force applying portion for applying force to the force bearing portion. When the force applying portion contacts and applies force to the force bearing portion, the toner bin rotates relative to the waste toner bin to move far away from each other. At the same time, the developing member and the photosensitive member are also separated from each other. When the processing cartridge needs to operate, the force applying portion no longer applies force to the force bearing portion, and the toner bin and the waste toner bin approach to each other. At this moment, the developing member and the photosensitive member contact each other again.

The aforementioned method that the force applying portion applies force to the force bearing portion to force the toner bin and the waste toner bin to be away from each other can achieve the purpose of preventing the photosensitive member from being contaminated. However, since the force bearing portion is fixedly installed in the toner bin, in order to ensure the force bearing portion to be coupled to the force applying portion, the force bearing portion being more prominent, when the processing cartridge is dropped off, or once collided during transportation, the force bearing portion may be broken, so that the developing member and the photosensitive member cannot be separate from each other and thereby causing contamination of the photosensitive member.

SUMMARY

The present disclosure provides a processing cartridge movably provided with a movable assembly coupled with coupled to the force applying part applying portion, and the movable assembly is assembled installed in a movable manner. Even if the processing cartridge falls or collides, due to the fact that the movable assembly has a certain amount of space to move, the risk that the movable assembly is broken can be greatly reduced.

In order to achieve the above purpose, the invention adopts the following technical solution.

A processing cartridge detachably installed in an imaging device having a force applying portion, including a first unit and a second unit coupled to each other, and a movable assembly capable of being coupled to the force applying portion and receiving a force applied by the force applying portion. When the processing cartridge is being assembled to the imaging device, the first unit and the second unit are capable of being switched between a state of approaching each other and a state of separating from each other. The movable assembly comprises an installing part and an acting part that are capable of moving relative to each other and connectable with each other. The movable assembly is installed in the processing cartridge by the installing part. The acting part is coupled to the force applying portion and configured to receive a force applied by the force applying portion, to force the first unit and the second unit to switch from the state of approaching each other to the state of separating from each other. The acting part is retractable relative to the installing part. The acting part comprises an acting block, and a guide block guided by the installing part.

The movable assembly is installed in a movable manner in a movable manner that is capable of rotating or moving in a straight line. Even if the processing cartridge falls or collides, due to the fact that the movable assembly has a certain amount of space to move, the risk that the movable assembly is broken can be greatly reduced.

DESCRIPTION OF EMBODIMENTS

Embodiments of the present disclosure are described in detail with reference to the accompanying drawings as follows. A length direction of the processing cartridge 1 is defined as a longitudinal direction X, a width direction is defined as a transverse direction Y, and an installing direction is defined as a vertical direction Z. The entire structure of the processing cartridge 1 is described as follows.

Figure 1:
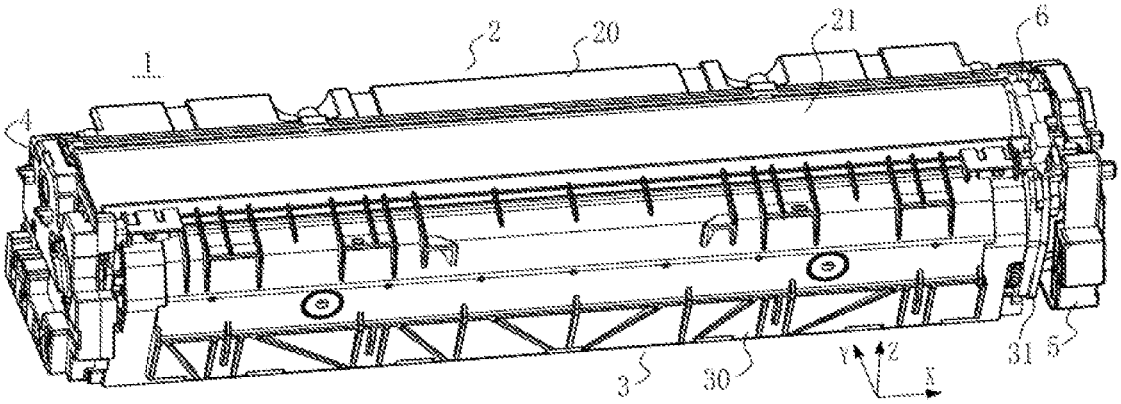
FIG. 1 is a perspective view of a processing cartridge according to the present disclosure.
Figure 2:
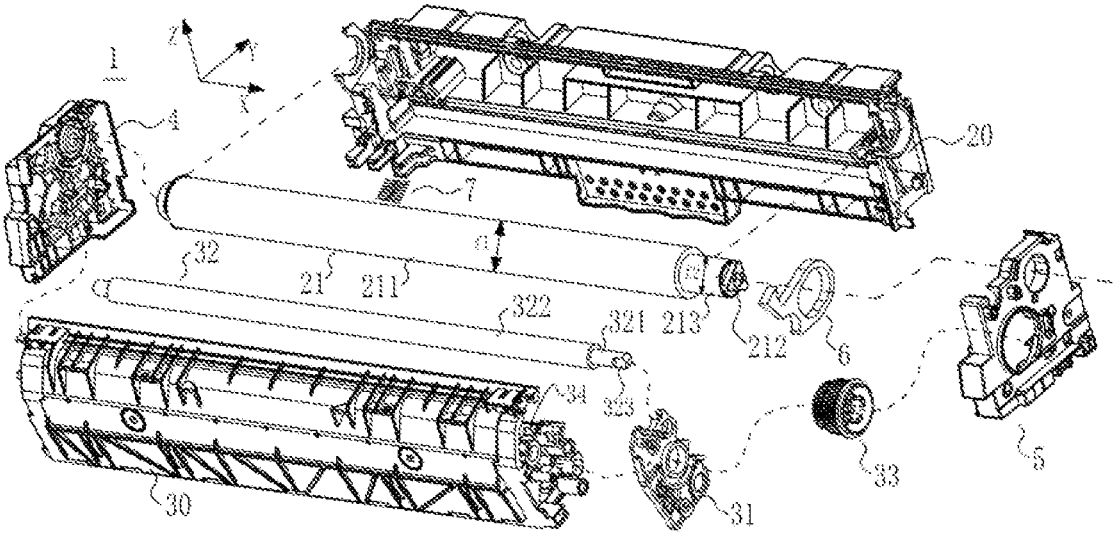
FIG. 2 is an exploded view of the components of a processing cartridge according to the present disclosure.

FIG. 1 is a perspective view of the processing cartridge according to the present disclosure. FIG. 2 is an exploded view of components of the processing cartridge according to the present disclosure.

The processing cartridge 1 is detachably installed to the electronic photo imaging device. The processing cartridge 1 includes a first unit 2 and a second unit 3 which are coupled to each other, and a first end cover 4 and a second cover 5 which are positioned at two longitudinal ends, respectively. The first unit 2 and the second unit 3 coupled to each other via the first end cover 4 and the second end cover 5 can move relative to each other. For example, the first unit 2 and the second unit 3 can rotate relative to each other, or the first unit 2 and the second unit 3 can slide relative to each other, etc. The first end cover 4 and the second end cover 5 can be either separate parts, respectively, or parts of the toner bin 3 or the waste toner bin 2. Furthermore, the direction from the first end cover 4 to the second end cover 5 is the +X direction, and the direction from the toner bin 3 to the waste toner bin 2 is the +Y direction.

In conjunction with FIGS. 1 and 2, the second unit 3 includes a second unit housing 30 for containing toner, a developing member 32 which is rotatably mounted in the second unit housing 30, a bracket 31 fixedly mounted on the second unit housing 30, and a first power receiving member 33 rotatably supported by the bracket 31. The first power receiving member 33 penetrates through the second end cover 5 and is configured to receive a driving force from the outside. The second unit housing 30 is configured to contain the toner. Therefore, the second unit 3 can also be regarded as a toner bin, and the second unit housing 30 can also be regarded as a toner bin housing. The developing member 32 is rotatably supported by the bracket 31 and includes a rotating shaft 321, a cover layer 322 wrapped on a circumferential surface of the rotating shaft 321, and a power receiving portion 323 provided at a longitudinal end of the rotating shaft 321. The power receiving portion 323 receives the driving force from the first power receiving member 33 to drive the developing member 32 to rotate, the cover layer 322 extends along the longitudinal direction of the rotating shaft 321, and the rotating shaft 321 is not completely covered by the cover layer 322 in the longitudinal direction.

The first unit 2 includes a first unit housing 20 for containing waste toner and a photosensitive member 21 rotatably mounted on the first unit housing 20. The photosensitive member 21 is configured to receive toner and develop the electrostatic latent image on a surface of the photosensitive member 21. Further, it is defined that a direction from the end where the photosensitive member is not installed pointing to the other end where the photosensitive member is installed in the processing cartridge 1 is the +Z direction. The first unit housing 20 is configured to contain waste toner generated during the development process. Therefore, the first unit 2 can also be called a waste toner bin, and the first unit housing 20 can also be called a waste toner bin housing. The photosensitive member 21 includes a photosensitive cylinder 211, a base 213 located at a longitudinal end of the photosensitive cylinder 211 and a second power receiving member 212 installed on the base 213. The second power receiving member 212 also penetrates through the second end cover 25 and is configured to receive a driving force from the outside, and further drive the photosensitive cylinder 211 to rotate. A diameter of the photosensitive cylinder 211 is f1, and a diameter of the base 213 is f2, where f1>f2.

Figure 6A:
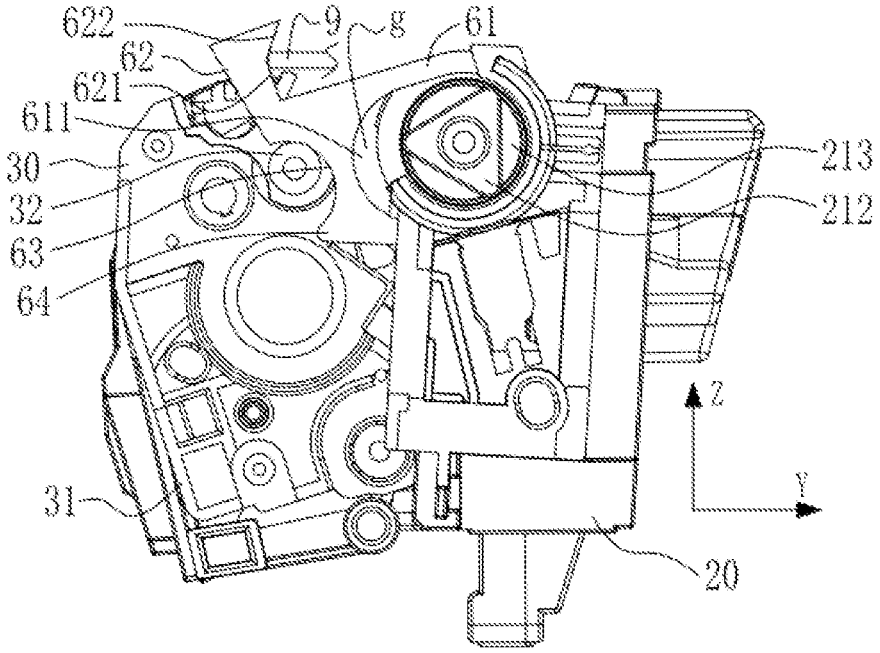
FIGS. 6A and 6B are lateral views longitudinal direction along the longitudinal direction of the processing cartridge when the movable assembly according to the first embodiment of the present disclosure is coupled to the force applying portion.

The processing cartridge 1 further includes a compression spring 7 installed between the first unit 2 and the second unit 3. When the processing cartridge 1 is in operation, the first power receiving member 33 and the second power receiving member 212 respectively receive driving force from the electronic photo imaging device to drive the developing member 32 and the photosensitive member 21 to rotate. Under the force from the compression spring 7, the first unit 2 and the second unit 3 approaches each other, and the photosensitive member 21 and the developing member 32 are in contact with each other. When the processing cartridge 1 is not in operation, under the action of force applying portion 9 in the electronic photo imaging device manual (as shown in FIG. 6A), the first unit 2 and the second unit 3 rotate relatively and are thereby separate from each other, and the photosensitive member 21 and the developing member 32 are out of contact from each other. It is appreciated that the member configured to force the first unit 2 and the second unit 3 to approach each other is not limited to the compression spring 7. For example, it can also be a tension spring installed between the first unit 2 and the second unit 3, or an elastic rubber installed between the first unit 2 and the second unit 3.

It should be emphasized that the existing developing methods of developing cartridges include contact developing and jump developing method. In the contact developing method, the surfaces of the photosensitive member 21 and the developing member 32 need to be kept in contact. In the jump developing method, the surfaces of the photosensitive member 21 and the developing member 32 needs to be spaced apart from each other. Therefore, the term "contact" in the present disclosure does not mean that the surface of the photosensitive member 21 must be in contact with the surface of the developing member 32. When the processing cartridge adopts the jump development method, the term "contact" means that a gap required for development is formed between the surfaces of the photosensitive member 21 and the developing member 32.

The first power receiving member 33 and the second power receiving member 212 both penetrate through the second end cover 5. The end on which the first power receiving member 33 and the second power receiving member 212 are provided in the processing cartridge 1 is called the driving end, and the other opposite end along the longitudinal direction is the non-driving end. Therefore, the first end cover 4 can also be called a non-driving end cover, and the second end cover 5 can also be called a driving end cover. The direction from the driving end cover 4 to the driving end cover 5 is the +X direction, and the direction from the second unit 3 to the first unit 2 is the +Y direction, and the installation direction of the processing cartridge 1 is the +Z direction. The second unit 3 and the first unit 2 are both integrated with the driving end cover 5 and the non-driving end cover 4 so as to realize the installation of the processing cartridge 1. The first unit 2, the non-driving end cover 4 and the driving end cover 5 are integrated by means of fixed installation without relative movement. The second unit 3 can move relative to the first unit 2, the non-driving end cover 4 and the driving end cover 5, and the specific moving manner may be that the second unit 3 and the first power receiving member 33 rotate in a coaxial manner.

The processing cartridge 1 further includes a movable assembly 6 provided therein, and at least a part of the movable assembly 6 can move between an initial position and a terminal position. When the movable assembly 6 is at the initial position, the first unit 2 and the second unit 3 approach each other, the photosensitive member 21 is in contact with the developing member 32. The movable assembly 6 is at least partially movable without any external force. At this time, the movable assembly 6 can be kept in contact with or separated from the second unit 3. When the movable assembly 6 receives the force from the force applying portion 9, at least a part of the movable assembly 6 can move from the initial position to the terminal position. In other words, the movable assembly 6 moves toward the direction of the second unit 3, and force the second unit 3. When the movable assembly 6 is at the terminal position, the first unit 2 and the second unit are separated from each other, and the photosensitive member 21 and the developing member 32 are out of contact. At this time, the movable assembly 6 is in an inactive state due to the force from the force applying portion 9. When the force from the force applying portion 9 is removed, the second unit 3 returns to the position close to the first unit 2, the movable assembly 6 returns to the initial position from the end position, in other words, the movable assembly 6 returns to the movable state from the non-movable state. Whether the movable assembly 6 is movable or non-movable refers to the movable assembly 6 relative to its installation position.

First Embodiment

Movable Assembly

Figure 3:
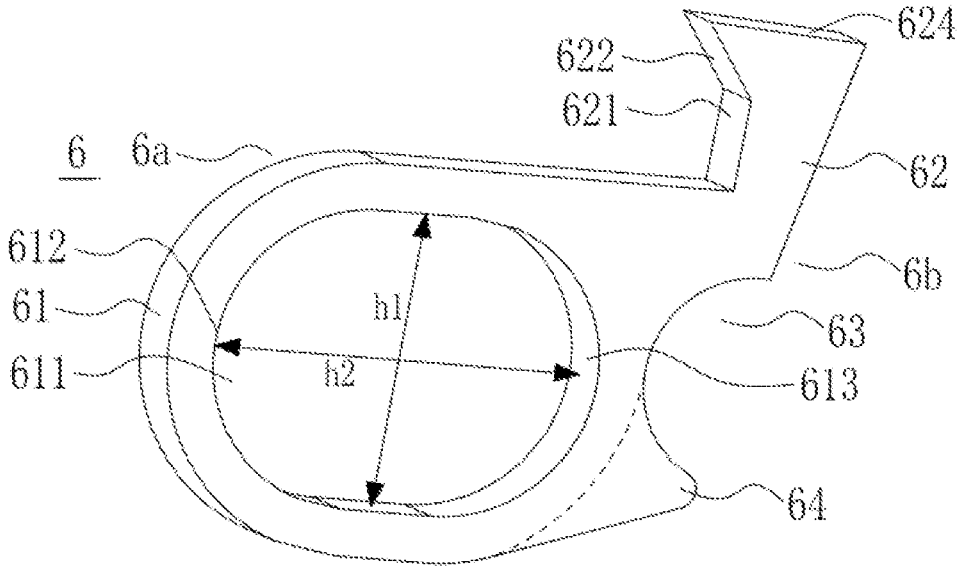
FIG. 3 is a perspective view of a movable assembly according to a first embodiment of the present disclosure.

FIG. 3 is a perspective view of a movable assembly according to the first embodiment of the present disclosure.

The movable assembly 6 includes a main body portion 61, a force bearing portion 62 connected to the main body portion 61 and a forcing portion 63 connected to the force bearing portion 62. The movable assembly 6 is movably arranged in the processing cartridge 1 via the main body portion 61. The force bearing portion 62 is configured to receive force from the force applying portion 9 and to transfer the force to the forcing portion 63. The forcing portion 63 is configured to force the first unit 2 and the second unit 3 to be separated from each other when the force bearing portion 62 is subject to force. After the force applied on the force bearing portion 62 is removed, the forcing portion 63 will be forced, so that the movable assembly 6 will return to the initial position from the terminal position, in other words, the movable assembly 6 is forced to return to the movable state from the non-movable state.

As shown in the figures, the main body portion 61 is formed with a coupling portion 611 configured to couple with the components of the processing cartridge 1. In certain embodiments, the coupling portion 611 is an elliptical hole with a first major axis end 612 and a second major axis end 613. The length of the major axis is h2, and the length of the short axis is h1. The force bearing portion 62 protrudes from the main body portion 61, and form a force receiving surface 621 for receiving force is formed. The forcing portion 63 is a groove connected to the force bearing portion 62 and recessed towards the direction of the coupling hole 611. In certain embodiments, the forcing portion 63, the coupling portion 62 and the main body portion 61 are integrally formed, so that when the movable assembly 6 is at the initial position, the entire movable assembly 6 is movable, and when the movable assembly 6 is at the terminal position, the entire movable assembly 6 is not movable.

Figure 4:
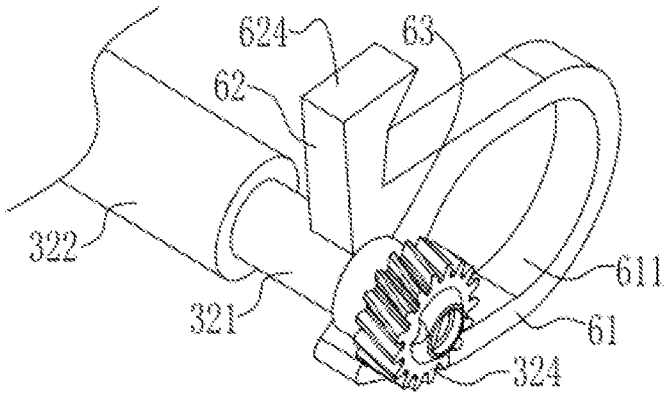
FIG. 4 is a diagram showing coupling of a movable assembly and a developing member according to the first embodiment of the present disclosure.

FIG. 4 is a diagram showing coupling of a movable assembly and a developing member according to the first embodiment of the present disclosure.

As mentioned above, when the force bearing portion 62 is subjected to a force, the first unit 2 and the second unit 3 will be forced to separate. The coupling of the moving assembly 6 and the developing member 32 is described as an example as follows.

The processing cartridge 1 further includes a developing gear 324 installed on the power receiving portion 323 for receiving driving force. When the movable assembly 6 is subjected to a force, the movable assembly 6 is coupled to the rotation shaft 321 between the developing gear 324 and the cover layer 322. The rotating shaft 321 is forced to drive the entire second unit 3 to rotate and further bring along the separation of the first unit 2 and the second unit 3, and finally the separation of the developing member 32 and the photosensitive member 21 is realized.

In some embodiments, the movable assembly 6 can further be coupled to other components of the second unit 3. For example, the toner supplying member 34 for supplying toner to the developing member 32 (shown in FIG. 2) is generally provided with a structure similar to the developing member, which also has a rotating shaft with a cover layer wrapped on its outer surface. Moreover, a longitudinal end of the toner supplying member is provided with a toner supplying member gear 341 for receiving the driving force (shown in FIG. 12). In contrast, the material wrapped on the toner supplying member 34 is different from that wrapped on the developing member 32, but the materials wrapped on both of the two are elastic. The developing member 32 and the toner supplying member 34 herein collectively referred to as a first rotating member, including a rotating shaft and a cover layer wrapped on the circumferential surface of the rotating shaft. The movable assembly 6 is coupled to the rotating shaft, and the position where the movable assembly 6 is coupled to the rotating shaft is located between the driving gears (collective name for the developing gear 324 and the toner supplying member gear 341) and the cover layer.

In some embodiments, in order to prevent the rotating shaft from sliding off the forcing portion 63 when the movable assembly 6 applies a force to the rotating shaft, as shown in FIG. 3, the movable assembly 6 further includes an lug portion 64 provided adjacent to the forcing portion 63. The lug portion 64 can be regarded as a protrusion extending from the main body portion 61 or the forcing portion 63. In certain embodiments, along the minor axis of the coupling hole 61 or the installation direction of the processing cartridge 1, the lug portion 64 and the force bearing portion 62 are located on both sides of the forcing portion 63, respectively. In certain embodiments, the force bearing portion 62 is located above the forcing portion 63, and the lug portion 64 is located below the forcing portion 63. When the forcing portion 63 is coupled to the rotating shaft, the lug portion 64 can support the rotating shaft from the lower part of the rotating shaft.

Movement of Movable Assembly

Figure 5A:
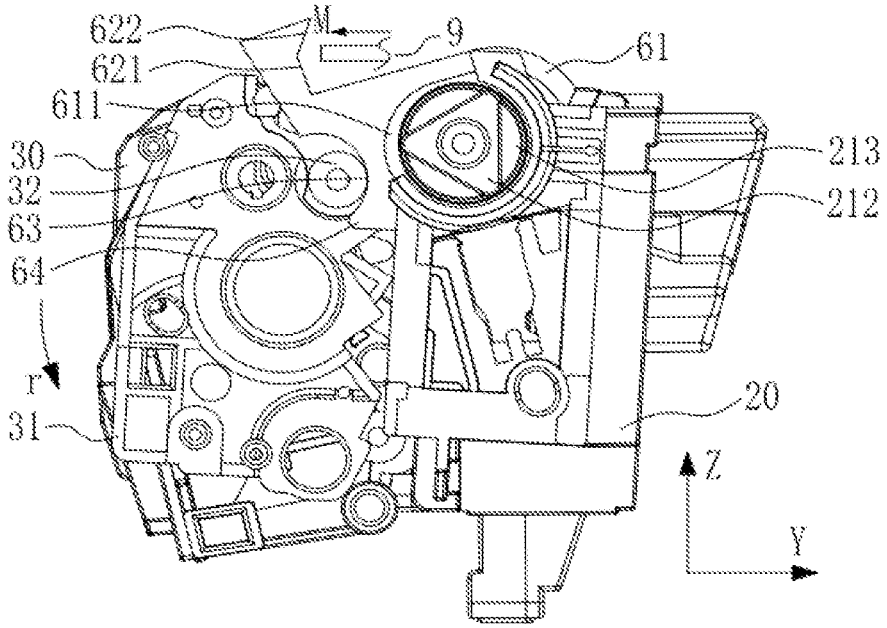
FIGS. 5A and 5B are lateral views longitudinal direction along the longitudinal direction of the processing cartridge when the movable assembly according to the first embodiment of the present disclosure is not coupled to the force applying portion.
Figure 5B:
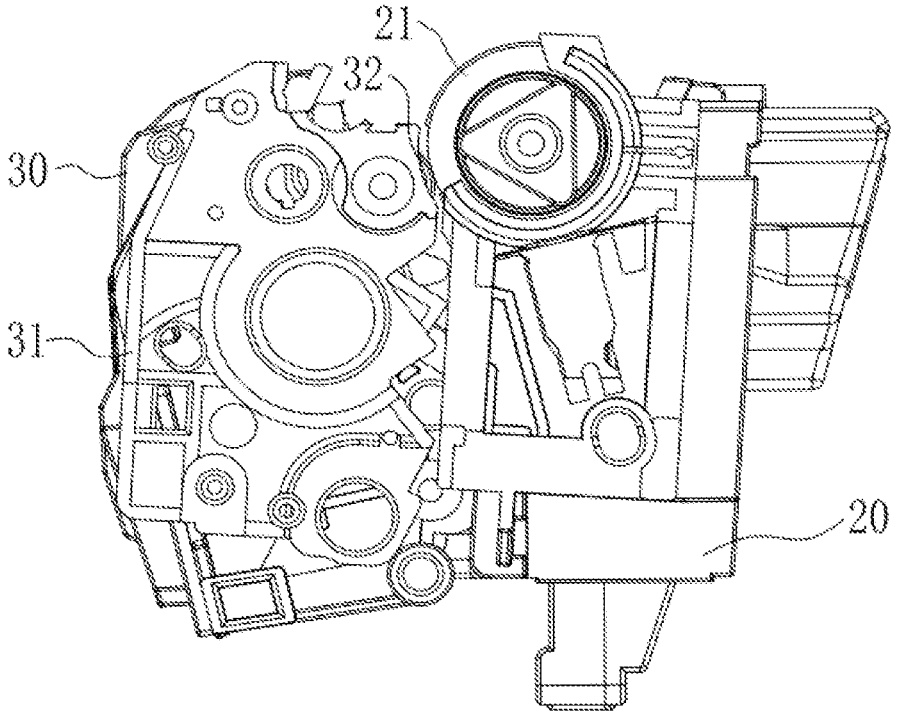
Figure 6B:
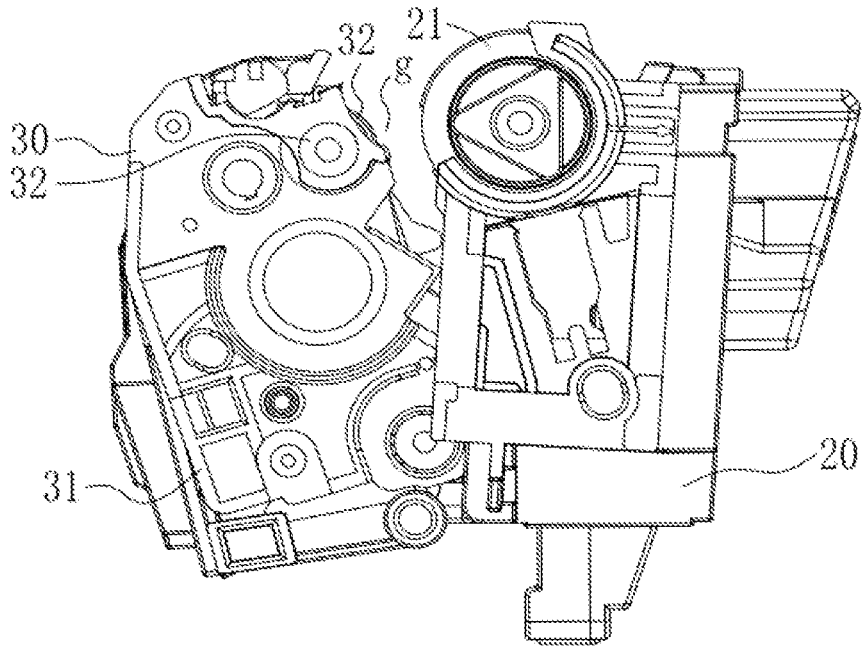
Figure 7:
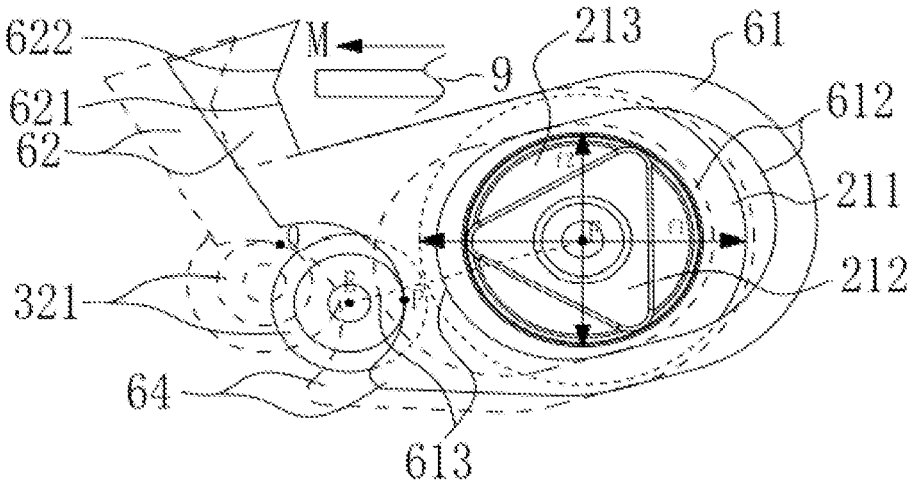
FIG. 7 is a simplified diagram showing relative movement among the movable assembly, the photosensitive member and the developing member.

FIGS. 5A and 5B are lateral views longitudinal direction along the longitudinal direction of the processing cartridge when the movable assembly according to the first embodiment of the present disclosure is not coupled to the force applying portion. FIGS. 6A and 6B are lateral views longitudinal direction along the longitudinal direction of the processing cartridge when the movable assembly according to the first embodiment of the present disclosure is coupled to the force applying portion. FIG. 7 is a simplified diagram showing relative movement among the movable assembly, the photosensitive member and the developing member.

As shown in FIGS. 5A and 5B, the movable assembly 6 is at the initial position, at this moment, the first unit 2 and the second unit 3 are approaching each other, the photosensitive member 21 and the developing member 32 are in contact, and the movable assembly 6 is not under any action of force and is kept in a movable state. In the movable state, the movable assembly 6 can be in contact with the rotating shaft or not. Even though the movable assembly 6 is in contact with the rotating shaft, the movable assembly 6 would not apply force to the rotating shaft. The force receiving surface is opposite to the force applying portion 9 on the external the processing cartridge 1.

As shown in FIGS. 6A and 6B, when the force applying portion 9 moves in the direction of M towards the force bearing portion 62 and starts to apply a force to the force receiving surface 621, the movable assembly 6/the forcing portion 63 moves towards the direction of the second unit 3. As the movable assembly 6 moves, the forcing portion 63 starts to apply a force to the rotating shaft, and the force is transmitted to the bracket 31 through the rotating shaft, and then transferred to the second unit housing 30 from the bracket 31, forcing the second unit 3 to rotate along a direction shown by r in FIG. 5A relative to the first unit 2, the first end cover 4 and the second end cover 5, so that the second unit 3 and the first unit 2 are separated from each other, and finally the developing member 32 is separated from the photosensitive member 21, a gap g is formed between the two, and the movable assembly 6 reaches the terminal position. Under the circumstance that the force applying portion 9 continues to apply a force to the force bearing portion 62, the developing member 32 and the photosensitive member 21 are kept separated from each other, and the movable assembly 6 is kept non-movable under the action of the force. At the same time, the compression spring 7 provided between the first unit 2 and the second unit 3 is compressed.

When the force applied to the force bearing portion 62 is removed, under the elastic reset force of the compression spring 7, the second unit 3 rotates in a direction opposite to the direction shown by r relative to the first unit 2, the first end cover 4 and the second end cover 5, and the second unit 3 returns to the state close to the first unit 2 shown in FIGS. 5A and 5B. At this time, the developing member 32 is in contact with the photosensitive member 21 again. As the second unit 3 rotates, the forcing portion 63 of the movable assembly 6 is forced by the rotating shaft and drives the movable assembly 6 to move from the terminal position to the initial position. When the developing member 32 returns to the position in contact with the photosensitive member 21, the movable assembly 6 returns from the terminal position to the initial position, and at this time, the movable assembly 6 is in a movable state again.

The processing cartridge 1 is installed to the electronic photo imaging device in an upside-down manner, that is, rotated 180° on the basis of the state shown in FIGS. 5A, 5B, 6A and 6A. In the case, the +Z direction is called downward, the −Z direction is called upward, and the movable assembly 6 is located below the processing cartridge 1, the rotation axis of the photosensitive member 21 is located below the rotation axis of the developing member 32, and the force receiving surface 621 does not face upwards. The force receiving surface 621 faces to the +Y direction or the +Z direction.

As shown in FIG. 7, when the developing member 32 and the photosensitive member 21 are in contact with each other, the center line of the two is EF, and the movable assembly 6 moves in a direction parallel to the line EF after receiving the force applied by the force applying portion 9. That is, under the action of the force applied by the force applying portion 9, the movable assembly 6 moves along a straight line. The force applying portion 9 applies force to the force bearing portion 62 in the direction shown by M. The line EF is not parallel to the straight line in which the force applying portion 9 moves. In order to prevent the force applying portion 9 from slipping off when applying force to the force bearing portion 62, the movable assembly 6 further includes an anti-dropping surface 622 provided adjacent to the force receiving surface 621. As shown in FIGS. 3, 5A and 6A, along +Z Direction, the anti-dropping surface 622 is located downstream of the force receiving surface 621, and the anti-dropping surface 622 at least partially faces the main body portion 61/−Z direction, Therefore, the anti-dropping surface 622 forms a hook surface opposite to the force receiving surface 621, and the force applying portion 9 is restrained from falling off from the force receiving surface 621.

The above describes the movement of the movable assembly 6 when after receiving the force and after the force is removed. Compared with the manner that the force bearing portion is fixedly installed in the toner bin described in the background portion, the movable assembly 6 according to the present disclosure is installed in a movable manner. Even if the processing cartridge 1 is collided or dropped, the movable assembly 6 will not be easily broken. The advantage of this installation manner is that there is no need to modify the structure of the processing cartridge 1, and the movable assembly 6 can be movably installed on the base 213 by directly using the structure of the existing photosensitive member 21. For the manufacturers of the processing cartridge 1, this method can greatly reduce the costs of manufacture, logistics, storage and installing, and ensure that the processing cartridge 1 according to the present disclosure is well connected with the conventional processing cartridge during production.

On the other hand, when the force applying portion 9 applies force to the movable assembly 6, the movable assembly 6 is directly in contact with a component of the second unit 3 and transfer the force via the component, and further results in the separation of the second unit 3 and the first unit 2. That is, the force applied by the force applying portion 9 is directly applied to the second unit 3 via the movable assembly 6, not only resulting in less loss of force, but also simplifying the structure between the movable assembly 6 and the second unit 3.

In certain embodiments, the movable assembly 6 is movably installed on the base 213 of the photosensitive member 21, and the movable assembly 6 moves in a direction parallel to the center line EF of the developing member 32 and the photosensitive member 21 when the two are in contact with each other. Therefore, it is not necessary to provide more space for the movement of the movable assembly 6 in the circumferential direction of the photosensitive member 21, so that the structure of the processing cartridge 1 is simplified. The required force for the separation of the developing member 32 and the photosensitive member 21 is minimum, which is beneficial for reducing the load of the force applying portion 9, thereby reducing the power consumption of the electronic photo imaging device.

In certain embodiments, in conjunction with FIGS. 5A and 7, in the process that the movable assembly 6 forces the second unit 3 to rotate, the contact point of the movable assembly 6 with the rotating shaft moves from point P to point Q. When the moving direction of the movable assembly 6 is parallel to the line EF, Point P and Point Q are located on two sides of the line EF, respectively, and the movable assembly 6 will not apply a force to the rotating shaft towards the +Z direction of the processing cartridge 1. Therefore, the sealing state between the developing member 32 and the second unit housing 30 is held. Similarly, due to fact that the movable assembly 6 will not rotate relative to the photosensitive member 21, the movable assembly 6 will not cause any impact to the sealing of the first unit housing 20.

As shown in FIG. 7, the movable assembly 6 is movably installed on the base 213 of the photosensitive member 21. Therefore, the size of the ellipse coupling hole 611 of the movable assembly 6 and the one of the photosensitive member 21 satisfy the relationship as follows: the length h2 of the major axis of the coupling hole 611 is larger than the diameter f1 of the photosensitive cylinder 211; and the length h1 of the minor axis of the coupling hole 611 is larger than the diameter f2 of the base 213, but smaller than the diameter 211 of the photosensitive cylinder 211.

By limiting the size of the coupling hole 611 to the above range, it can effectively ensure that the movable assembly 6 is installed on the base 213 in a movable manner, and the work of the photosensitive cylinder 211 will not be affected.

In an embodiment, when the movable assembly 6 is at the initial position, the developing member 32 is in contact with the photosensitive member 21, and the base 213 of the photosensitive member 21 is closer to the second major axis end 613 of the coupling hole 611 of the movable assembly. As shown by the long dashed line in FIG. 7, when the movable assembly 6 is at the terminal position, the developing member 32 is separated from the photosensitive member 21, and the base 213 of the photosensitive member 21 is closer to the first major axis end 612 of coupling hole of the movable assembly.

As shown in FIG. 7, when the movable assembly 6 is at the initial position, the forcing portion 63 and the rotating shaft 321 are coupled at point P, and the movable assembly 6 is at the terminal position, the forcing portion 63 is coupled to the rotating shaft 321 at the point Q. Especially, the movable assembly 6 is at the initial position, when the movable assembly 6 is forced by the force applying portion 9 to force the rotating shaft 321, the rotating shaft 321 may slip off from the bottom of the forcing portion 63 (along the +Z direction, upstream of the forcing portion 63), causing separation failure between the first unit 2 (the photosensitive member 21) and the second unit 3 (the developing member 32). When the movable assembly 6 is provided with a lug portion 64, the lug portion 64 can support the rotating shaft 321 from the bottom of the rotating shaft 321, thereby effectively preventing the rotating shaft 321 from slipping off the forcing portion 63.

As shown in FIG. 7, the movable assembly 6 moves paralleled to the line EF, thereby when the movable assembly 6 arrives at the terminal position, the coupling point of the movable assembly 6 and the rotating shaft 321 is farther away from the aforementioned point P along +Z direction.

Second Embodiment

Figure 8:
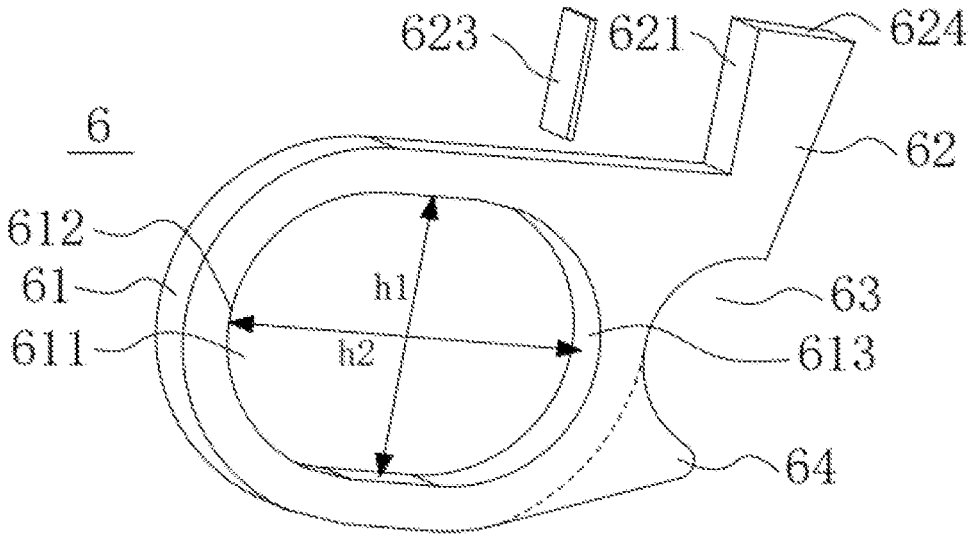
FIG. 8 is perspective view of a movable assembly according to a second embodiment of the present disclosure.

FIG. 8 is perspective view of the movable assembly according to a second embodiment of the present disclosure. The same components in this embodiment and the aforementioned embodiment will share the same reference signs. As shown in this figure, the movable assembly 6 in this embodiment is no longer provided with the anti-falling surface 622, and the force receiving surface 621 is provided as a smooth surface. The movable assembly 6 further includes a friction member 623 coupled to the force receiving surface 621. In certain embodiments, the friction member 623 is a component with a relatively large friction force, such as abrasive paper, sponge, etc., and the friction member 623 is attached to the force receiving surface 621 in an adhesive manner.

When the force applying portion 9 moves towards the force receiving surface 621, the force applying portion 9 will be coupled to the friction member 623, and the friction force generated between the force applying portion 9 and the friction member 623 prevents the force applying portion 9 from being out of contact with the movable assembly 6.

Third Embodiment

Figure 9:
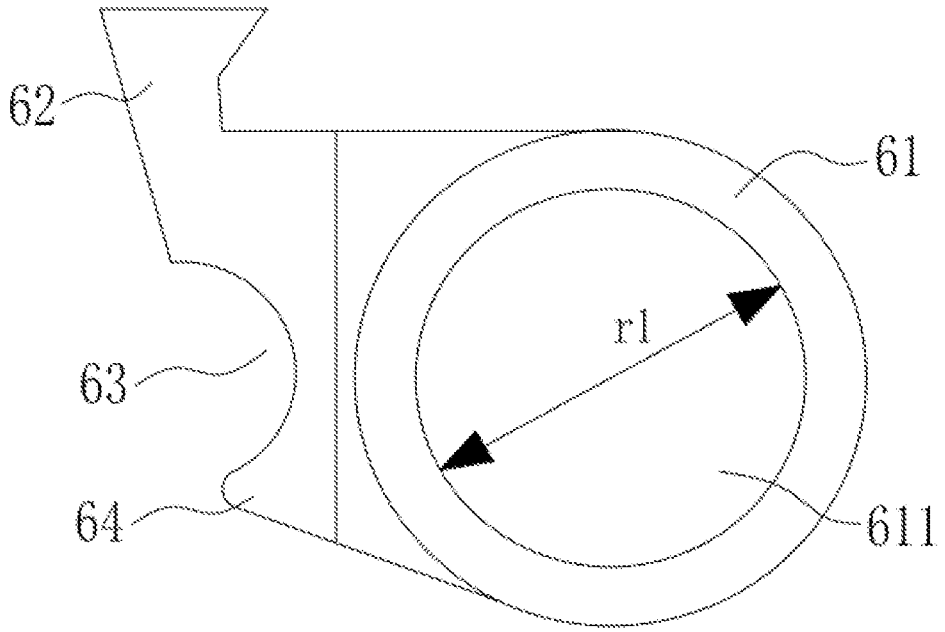
FIG. 9 is perspective view of a movable assembly according to a third embodiment of the present disclosure.

FIG. 9 is perspective view of the movable assembly according to the third embodiment of the present disclosure. The same components in this embodiment and the aforementioned embodiments will share the same reference signs. As shown in this figure, the movable assembly according to this embodiment are different from those according to the first and second embodiment above mainly in that the coupling portion 611 of the movable assembly 6 is no longer an ellipse, but a circle with a diameter r1, and it is satisfied that the diameter r1 is between the diameter f1 of the photosensitive cylinder 211 and the diameter f2 of the base 213, specifically: f2<r1<f1. In this embodiment, the movable assembly 6 no longer moves along a straight line, but does circular movement around the center of the coupling portion 611. Along the installation direction of the processing cartridge 1, the lug portions 64 and the force bearing portion 62 are located on two sides of the forcing portion 63, respectively.

Similarly, the movable assembly according to this embodiment can still implement the functions of the movable assembly in the above embodiments. That is, the movable assembly 6 is in a movable state before being subjected to the force applied by the force applying portion 9, the first unit 2 and the second unit 3 approach each other, and the photosensitive member 21 is in contact with the developing member 32, the movable assembly 6 is in contact with or separated from the corresponding components of the second unit 3. After subjected to the force applied by the force applying portion 9, the movable assembly 6 moves toward the second unit 3 and contacts the corresponding components of the second unit 3 until the moving assembly 6 is in the non-movable state. During this process, the first unit 2 and the second unit 3 are out of contact from each other, and the photosensitive member 21 and the developing member 32 are out of contact. After the force applied by the force applying portion 9 is removed, the movable assembly 6 returns to the movable state from the non-movable state.

Fourth Embodiment

Figure 10:
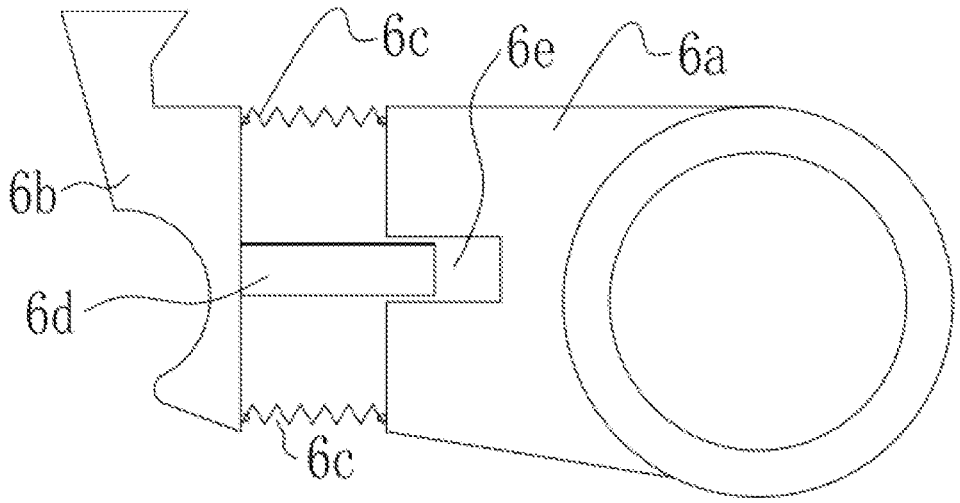
FIG. 10 is perspective view of a movable assembly according to a fourth embodiment of the present disclosure.

FIG. 10 is perspective view of the movable assembly according to the fourth embodiment of the present disclosure.

As mentioned above, the movable assembly 6 is integrally formed. However, in practice, the main body portion 61 can also be formed separately from the force bearing portion 62 and the forcing portion 63. With reference to FIG. 3, the movable assembly 6 can be considered to include an installing part **6*a* and an acting part 6*b* which are separately provided. Among them, the installing part 6*a* corresponds to the aforementioned main body portion 61 and is configured to combine the movable assembly 6 with the components in the processing cartridge, and the acting part 6*b* is corresponding to at least one of the aforementioned force bearing portion 62 and the forcing portion 63. When the force applying portion 9 applies a force, the acting part 6*b* acts on and interacts with corresponding components of the processing cartridge, so that the first unit 2 and the second unit 3 are separated from each other. At the same time, the photosensitive member 21 and the developing member 32** are out of contact.

In certain embodiments, the acting part **6*b* is movable relative to the installing part 6*a*. When the acting part 6*b* receives the force applied by the force applying portion 9, the straight line where the direction of movement of the acting part 6*b* lies on is parallel to the aforementioned line EF. Therefore, the movable extent of the entire movable assembly 6 is greater. When the processing cartridge 1 falls or collides, it is more beneficial to prevent the movable assembly 6** from being broken.

For the movable assembly 6 with the acting part **6*b* movable relative to the installing part 6*a***, there are two installation methods as follows:

a) The installing part **6*a* itself is movably installed. When the movable assembly 6 is at the initial position, the installing part 6***a* and the acting part 6*b* are both movable. When the movable assembly 6 is at the terminal position, the installing part 6*a* is movable, and the acting part 6*b* is non-movable. As in the first and second embodiment described above, the installing part 6*a* is elliptical, and as in the third embodiment, the installing part 6*a* is circular, which satisfies the situation: f2<r1<f1.

b) The installing part 6*a* itself is fixedly installed. When the movable assembly 6 is at the initial position, the installing part 6*a* is non-movable, and the acting part 6*b* is movable. When the movable assembly 6 is at the terminal position, the installing part 6*a* and the acting part 6*b* are both non-movable. At this time, regardless of whether the installing part 6*a* is elliptical or circular, the components coupled to the installing part 6*a* in the processing cartridge always match the installing part 6*a*, so that installing part 6*a* can be fixedly installed.

For the second installation manner mentioned above, when the acting part 6*b* does not receive the force applied by the force applying portion 9, the acting part 6*b* is at the movable initial position. When the acting part 6*b* receives the force applied by the force applying portion 9, the acting part 6*b* moves toward the second unit 3 relative to the installing part 6*a*. Under the further action of the force applying portion 9, the acting part 6*b* forces the first unit 2 and the second unit 3 separated from each other, and at the same time, the photosensitive member 21 and the developing member 32 are out of contact. At this time, the acting part 6*b* is located at the non-movable terminal position. When the force applying portion 9 no longer applies force to the acting part 6*b*, the acting part 6*b* returns to the movable initial position from the non-movable terminal position.

In this embodiment, the acting part 6*b* and the installing part 6*a* can adopt east one of the connection methods such as elastic connection, rack connection, magnetic connection, and rail connection. As shown in FIG. 10, the installing part 6*a* and the acting part 6*b* are connected by an elastic member 6*c*, so that the two can move relative to each other, and the acting part 6*b* has a tendency to approach the installing part 6*a*. Furthermore, the installing part 6*a* is also provided with a guide groove 6*e* and the acting part 6*b* is further provided with a protrusion 6*d* which can slide in the guide groove 6*e*. Therefore, the trajectory of the relative movement of the installing part 6*a* and the acting part 6*b* can be precisely controlled. When the two are magnetically connected, for example, the acting part 6*b* and the installing part 6*a* are respectively equipped with magnets that attract each other. At the initial position, the acting part 6*b* and the installing part 6*a* attract each other, and at the terminal position, the acting part 6*b* is pushed away from the installing part 6*a* by the force applied by the force applying portion 9. When the force applied by the force applying portion 9 is removed, the acting part 6*b* returns to the initial position where the acting part 6*b* is attracted by the installing part 6*a*.

Fifth Embodiment

According to the aforementioned embodiments, this embodiment further describes the installation position of the movable assembly 6. Based on the thoughts according to the technical scheme of the present disclosure, the installation position of the movable assembly 6 is not limited to the photosensitive member 21. As long as the movable assembly 6 can receive the force from the force applying portion 9 and applies the received force to the second unit 3 so as to force the second unit 3 to rotate relative to and thereby separate from the first unit 2 and finally disengage the developing member 32 from the photosensitive member 21. For example, the movable assembly 6 can be installed on at least any one of the first unit housing 20, the photosensitive member 21, the first end cover 4, the second end cover 5, the second unit housing 30 and the developing member 32.

For example, when the movable assembly 6 is movably installed on other components or the housing of the processing cartridge 1. The first unit housing 20 is provided with a coupled portion configured to combine with the coupling portion 611, or the first end cover 4 and the second end cover 5 are provided with the coupled portion. If this manner is adopted, the structure of the existing processing cartridge 1 needs to be modified. Although it does not benefit to the production connection of the processing cartridge 1, and also increases the aforementioned various costs, the technical solution according to this embodiment is still effective for solving the technical problems faced in the background art.

Sixth Embodiment

Figure 11:
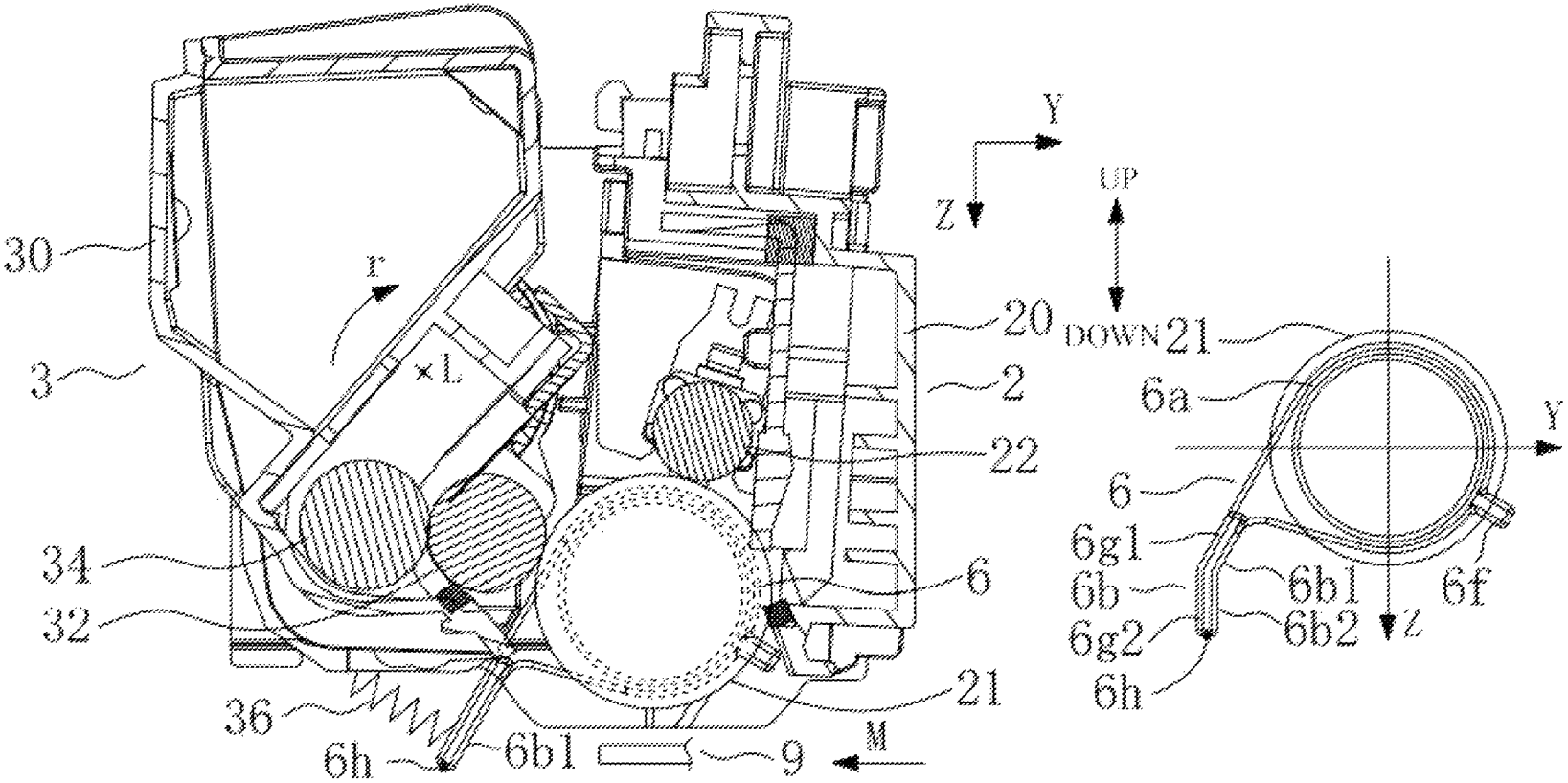
FIG. 11 is a perspective view of an inverse processing cartridge according to a sixth embodiment of the present disclosure.

FIG. 11 is a perspective view of a processing cartridge placed inversely according to the sixth embodiment of the present disclosure.

In the aforementioned embodiment, as shown in FIGS. 3 and 8, the movable assembly 6 (acting part 6*b*) has an end surface 624. When the cartridge 1 is installed in the imaging device, the end surface 624 is opposite to the force applying portion 9 and presses the force applying portion 9 to the retracted position. However, when the processing cartridge 1 is not in operation, the force applying portion 9 also needs to apply a force to the force receiving surface 622 to force the developing member 32 to separate from the photosensitive member 21. Therefore, the force applying portion 9 needs to move a certain distance in the direction opposite to the M direction (as shown in FIG. 11) so as to be no longer pressed by the end face 624. When it is necessary to disengage the developing member 32 from the photosensitive member 21, the force applying portion 9 first needs to move a long distance in the M direction to apply a force to the force receiving surface 622. In general, the movement procedure of the force applying portion 9 is relatively complicated, and the structure of the imaging device is not simplified enough.

Regarding this, the movable assembly 6 according to this embodiment is still installed at least partially in an movable manner, and the structure thereof is further optimized, effectively preventing the movable assembly 6 from being broken due to the collision or falling of the processing cartridge 1, and simplifying the movement procedure of the force applying portion 9, and thereby simplifying the structure of the imaging device.

When the processing cartridge 1 is mounted to the imaging device, the rotation axis of the photosensitive member 21 is located below the rotation axis of the developing member 32. The force receiving surface 6*b*1 of the movable assembly 6 configured for coupling with the force applying portion 9 does not face upwards. In certain embodiments, the force receiving surface 6*b*1 faces the +Z and +Y directions, so that the force applying portion 9 can be smoothly in contact with the force receiving surface 6*b*1.

Along the Z direction, the free end 6*h* of the movable assembly 6 is not opposite to the force applying portion 9, but the force receiving surface 6*b*1 is opposite to the force applying portion 9. Therefore, when the processing cartridge 1 is installed and taken out along the Z direction, the force applying portion 9 neither needs to be protruded, nor needs to move in the direction opposite to the direction shown by M, to avoid interference with the processing cartridge 1. The force applying portion 9 only needs to move in the direction shown by M to apply a force on the movable assembly 6 and move in the direction opposite to the direction shown by M to be out of contact with the movable assembly 6. The movement of the force applying portion 9 is thereby simplified, and accordingly, the structure of the imaging device is simplified. In certain embodiments, when the processing cartridge 1 moves towards the +Z direction, the free end 6*h* is located in the −Y direction of the force applying portion 9. The movable assembly 6 will not interfere with the force applying portion 9. In addition, when the processing cartridge 1 is not in operation, the force applying portion 9 can be coupled to the movable assembly 6 by moving in the direction shown by M, and when the processing cartridge 1 is in operation, the force applying portion 9 moves in the direction opposite to the direction shown by M to the position before the processing cartridge 1 moves towards the +Z direction. It can be seen that, compared with the moving distance of the force applying portion in the existing imaging device, the moving distance of the force applying portion 9 in this embodiment is smaller.

Figure 12:
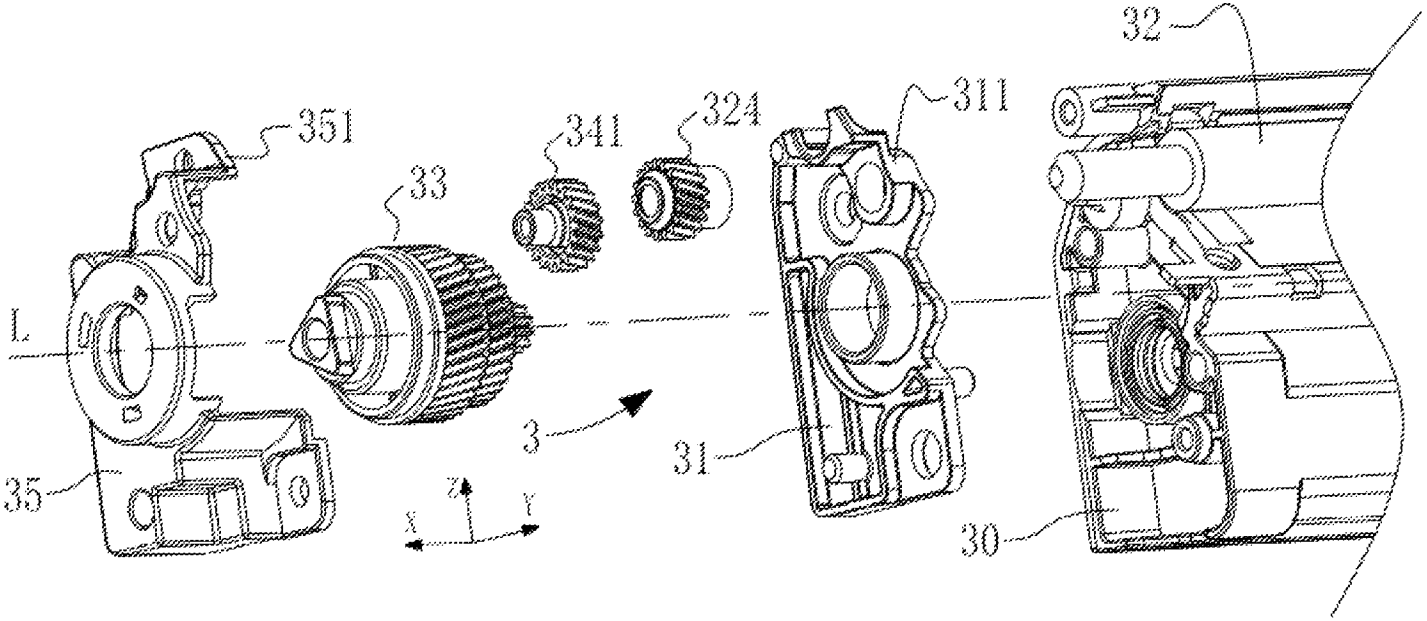
FIG. 12 is an exploded diagram of part of components of a toner bin of a processing cartridge according to the sixth embodiment of the present disclosure.
Figure 13:
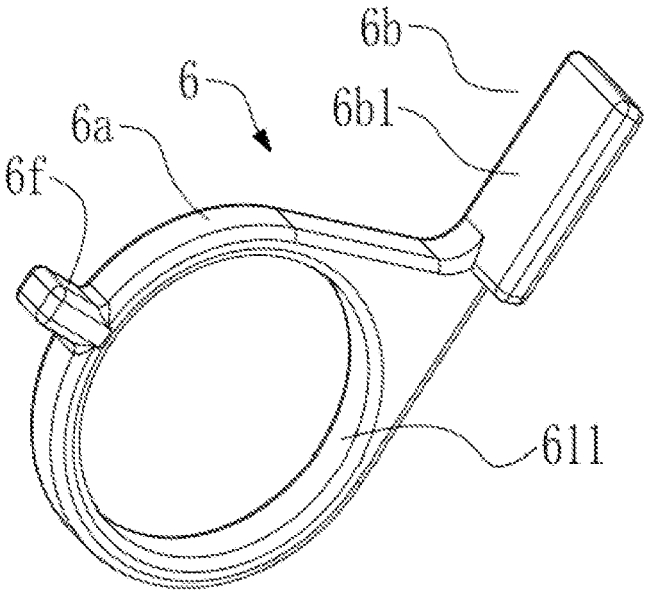
FIG. 13 is a perspective view of a movable assembly in a processing cartridge according to the sixth embodiment of the present disclosure.

FIG. 12 is an exploded diagram of part of the components of the toner bin of the processing cartridge according to the sixth embodiment of the present disclosure. FIG. 13 is a perspective view of the movable assembly in the processing cartridge according to the sixth embodiment of the present disclosure.

The toner bin 3 further includes a bracket 31 installed on the same side as the second end cover 5, a power receiving member 33, a developing member gear 324, and a supplying member gear 341. The power receiving member 33 meshes with both the developing member gear 324 and the supplying member gear 341 at the same time, and the power receiving member 33 transmits the driving force received from the outside to the developing member 32 and a supplying member 34 via the developing member gear 324 and the supplying member gear 341, so as to drive the developing member 32 and the supply member 34 to rotate. The power receiving member 33, the developing member 32 and the supplying member 34 are all supported 31 by the bracket 31, the developing member gear 324 and the supplying member gear 341 are fixedly installed at the longitudinal ends of the developing member 32 and the supply member 34, respectively.

Correspondingly, a transmission portion configured to be coupled to the movable assembly 6 is provided in the toner bin 3, and when the movable assembly 6 receives a force applied by the force applying portion 9, the movable assembly 6 transmits the force to the toner bin 3 through the transmission portion, thereby forcing the toner bin 3 and the waste toner bin 2 to be separated from each other. For example, the transmission portion may be a transmission surface 311 provided on the bracket 31, or provided on the toner bin housing 30.

Figure 14A:
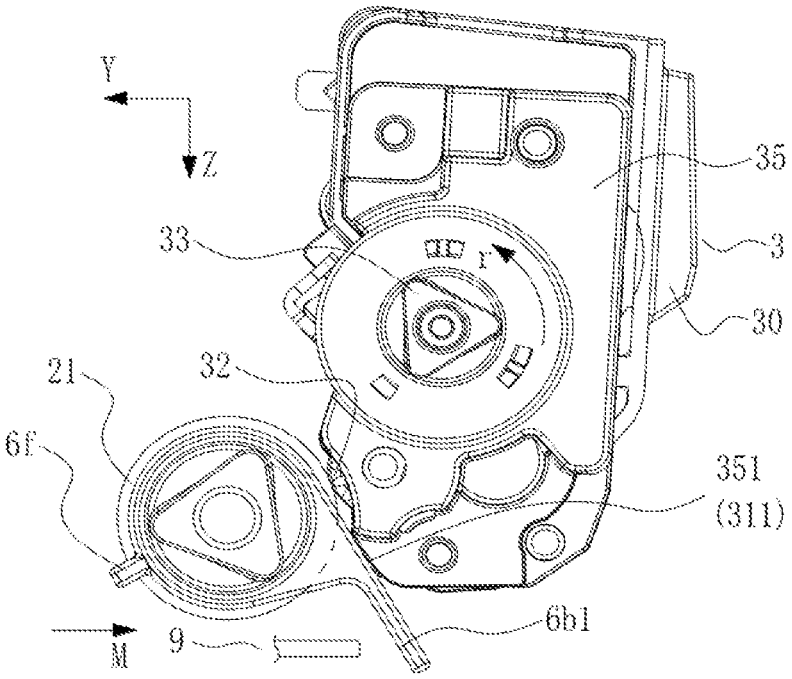
FIGS. 14A and 14B are diagrams showing status of a processing cartridge before and after being coupled to a force applying portion according to the sixth embodiment of the present disclosure.

In certain embodiments, the toner bin 3 further includes a protective cover 35 provided in the +X direction of the bracket, and the protective cover 35 is configured to prevent the power receiving member 33, the developing member gear 324 and the supplying member gear 341 from falling off. The transmission portion may also be a transmission surface 351 provided on the protective cover 35. In certain embodiments, the transmission surface 311/351 is provided as an inclined surface, as shown in FIG. 14A, the transmission surface 311/351 inclines toward the −Y and +Z directions, or in other words, along the −Y direction, the transfer surface 311/351 is gradually away from the developing member 32 and faces to the +Y and +Z directions.

The provided transmission surface 311/351 makes the coupling of the movable assembly 6 and the toner bin 3 more smoothly, so that the abrasion of the movable assembly 6 can be reduced. It can be understood that the transmission surface 311/351 is not necessarily provided. As the transmission surface 311/351 is not provided, the movable assembly 6 is directly coupled to the corresponding position of the toner bin 3. Similarly, the force can be transmitted to the toner bin 3 in order to force the developing member 32 and the photosensitive member 21 to separate from each other.

As mentioned above, the movable assembly 6 includes an installing part 6*a* and an acting part 6*b* that are connected to each other, and the installing part 6*a* is configured to install the movable assembly 6. For example, the movable assembly 6 is installed in the waste toner bin 2 via the installing part 6*a*, or is installed at the first end cover 4 or the second end cover 5. Hereinafter, the movable assembly 6 installed in the waste toner bin 2 via the installing part 6*a* is taken as an example for illustration.

In certain embodiments, the movable assembly 6 is installed on the photosensitive member 21 via the installing part 6*a*, and the acting part 6*b* is formed by protruding from the installing part 6*a*. In certain embodiments, a ring 611 for coupling with the photosensitive member 21 is formed in the installing part 6*a*, and the acting part 6*b* is a flat plate formed by protruding from the acting part 6*b*. After the installing part 6*a* is installed, the acting part 6*b* can rotate with the installing part 6*a*. As shown in FIG. 11, when the movable assembly 6 is installed on the photosensitive member 21, the two are arranged concentrically, and one surface of the acting part 6*b* is formed to be a force receiving surface 6*b*1 for coupling with the force applying portion 9. The force receiving surface 6*b*1 can be a smooth surface or a friction member attached to the smooth surface, so as to increase the frictional force when coupling with the force applying portion 9. When the acting part 6*b* receives the force applied by the force applying portion 9, the installing part 6*a* rotates around the rotation axis of the photosensitive member 21, and the acting part 6*b* transmits the force to the transmission portion.

In certain embodiments, the movable assembly 6 is also provided with a stopper 6*f* which is configured to restrict the rotation of the movable assembly 6 and prevent the acting part 6*b* (the force receiving surface 6*b*1) from failing to reach the predetermined position under extreme circumstance. In certain embodiments, the stopper 6*f* is a protrusion from the installing part 6*a* along the radial direction. Alternatively, the stopper 6*f* can also be a protrusion protruding from the installing part 6*a* along the rotation axis thereof.

Figure 14B:
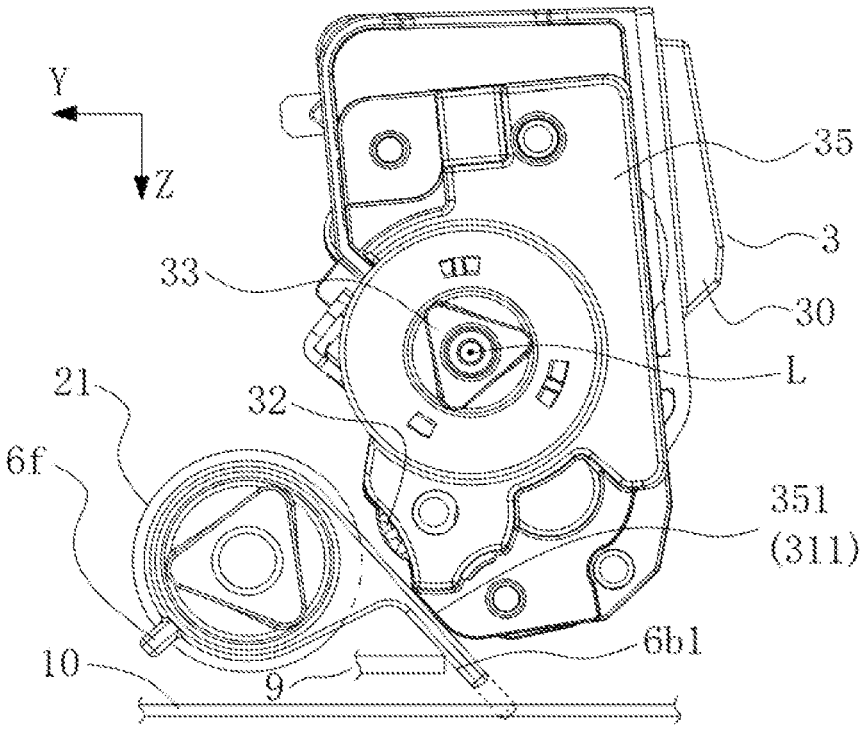

FIGS. 14A and 14B are diagrams showing the status of the processing cartridge before and after being coupled to the force applying portion according to the present disclosure.

In order to show the change of the state of the processing cartridge 1 more clearly, the waste toner bin 2 in FIGS. 14A and 14B only show the photosensitive member 21 and movable assembly 6. When the processing cartridge 1 is in operation, as shown in FIG. 14A, the surface of the developing member 32 and the surface of the photosensitive member 21 contact with each other. At this time, the force applying portion 9 in not in contact with the acting part 6*b* of the movable assembly 6, and the acting part 6*b* contacts or does not contact with the transmission portion.

When the processing cartridge 1 is not in operation, as shown in FIG. 14B, the force applying portion 9 gradually approaches the force receiving surface 6*b*1 in the direction shown by M. When the force applying portion 9 starts to force the force receiving surface 6*b*1 and thus apply a force, the acting part 6*b* drives the installing part 6*a* to rotate around the rotation axis of the photosensitive member 21, and a surface opposite to the force receiving surface 6*b*1 on the acting part 6*b* gradually approaches and thus contacts with the transmission surface 311/351, so that the force can be transmitted to the toner bin 3. Finally, the toner bin 3 rotates around the axis L in the direction shown by r and is thereby disengaged from the waste toner bin 2. At the same time, the developing member 32 and the photosensitive member 21 are separated from each other.

When the processing cartridge 1 needs to operate again, the force applying portion 9 moves in the direction opposite to the direction shown by M to release the forcing on the force receiving surface 6*b*1. Under the action of the elastic member 7 located between the toner bin 3 and the waste toner bin 2, the toner bin 3 rotates in the direction opposite to the direction shown by r and thereby return to the position close to the waste toner bin 2. At this time, the developing member 32 also returns to the position in contact with the photosensitive member 21. The acting part 6*b* of the movable assembly 6 is urged by the rotating toner bin 3 to drive the installing part 6*a* to rotate around the rotation axis of the photosensitive member 21 back to the initial position.

When the movable assembly 6 is installed on the second end cover 5, for example, the second end cover 5 is provided with a fitting portion configured to fit with the installing part 6*a*. When the installing part 6*a* is provided with a circle 611, the fitting portion is a column protruding from the second end cover 5, and the installing part 6*a* is sleeved on the column.

Seventh Embodiment

The same components in this embodiment and the sixth embodiment will share the same reference signs. The difference between the two is the structure of the movable assembly 6, as shown in FIG. 11, the acting part 6*b* includes a first protrusion 6*g*1 protruding from the installing part 6*a* and a second protrusion 6*g*2 protruding from the first protrusion 6*g*1. The first protrusion 6*g*1 has a first force receiving surface 6*b*1, and the second protrusion 6*g*2 has a second force receiving surface 6*b*2.

When the processing cartridge 1 is arranged upside down as shown in FIG. 11, none of the first force receiving surface 6*b*1 and the second force receiving surface 6*b*2 are facing upwards. The first force receiving surface 6*b*1 faces downward, and the second force receiving surface 6*b*2 faces to the +Y direction, that is, the second force receiving surface 6*b*2 is parallel to the up-and-down direction (vertical direction) of the processing cartridge 1, and the angle formed between the first force receiving surface 6*b*1 and the second force receiving surface 6*b*2 is an obtuse angle. Similarly, along the Z direction, the free end 6*h* of the movable assembly 6 (the free end of the second protrusion 6*g*2) is not opposite to the force applying portion 9. When the processing cartridge 1 moves along the +Z direction, the free end 6*h* is located at −Y direction of the force applying portion 9. Therefore, the force applying portion 9 neither needs to protrude or retract, nor needs to move in the direction opposite to the direction shown by M, so as to avoid interfering with the processing cartridge 1. The force applying portion 9 only need to move in the direction shown by M to apply a force to the movable assembly 6 and move in the direction opposite to the direction shown by M to be out of contact with the movable assembly 6, so that the structure of the imaging device is simplified. Compared with the moving distance of the force applying portion of the existing imaging device, the moving distance of the force applying portion 9 in this embodiment is smaller.

Eighth Embodiment

The same components in this embodiment and the sixth and the seventh embodiment will share the same reference signs. The movable assembly 6 can rotate around its rotation axis, therefore, when the force applying portion 9 moves towards the movable assembly 6 (acting part 6*b*), the movable assembly 6 (acting part 6*b*) is located at the predetermined position for receiving force. In certain embodiments, the movable assembly 6 keeps coupled to the toner bin 3, as shown in FIG. 11, the processing cartridge 1 further includes a holding member 36 configured to keep the acting part 6*b* (force receiving surface 6*b*1) at the predetermined position for receiving force.

As shown in the figures, the holding member 36 is located between the movable assembly 6 and the toner bin 3 (the toner bin housing 30) or between the movable assembly 6 and the waste toner bin 2 (the waste toner bin housing 20). In certain embodiments, the holding member 36 is an elastic member, such as a compression spring, a tension spring, an elastic rubber, or the like. The predetermined force receiving position is the position where the acting part 6*b* contacts with the transmission portion. Once the force applying portion 9 starts to contact with the acting part 6*b*, the force can be transmitted to the toner bin 3. At the same time, when the processing cartridge 1 moves along the +Z direction, the acting part 6*b* is held at a predetermined position for force receiving, thereby effectively preventing the interference between the movable assembly 6 and the force applying portion 9.

In certain embodiments, the stopper 6*f* is configured to restrict the rotation of the movable assembly 6. Therefore, the stopper 6*f* can also be regarded as another embodiment of the holding member 36, as shown in FIG. 11, the stopper 6*f* is arranged that when the processing cartridge 1 is installed, the movable assembly 6 is held at the predetermined position for force receiving of the acting part 6*b*.

Ninth Embodiment

The same components in this embodiment and the aforementioned embodiments will share the same reference signs. This embodiment is described as above that the first end cover 4 and the second end cover 5 are independent components and the toner bin 3 and the waste toner bin 2 are coupled via the first end cover 4 and the second end cover 5.

This embodiment will describe the deformation of the first end cover 4 and the second end cover 5, that is, the first end cover 4 is decomposed into two end sub-covers which are coupled to the toner bin 3 and the waste toner bin 2, respectively. The second end cover 5 is also decomposed into two end sub-covers which are coupled to the toner bin 3 and the waste toner bin 2, respectively. At this time, the end sub-cover of the first end cover 4 which are respectively coupled to the toner bin 3 and the waste toner bin 2 will become a part of the toner bin 3 and a part of the waste toner bin 2, respectively. Correspondingly, the end sub-cover of the second end cover 5 which are respectively coupled to the toner bin 3 and the waste toner bin 2 will become a part of the toner bin 3 and a part of the waste toner bin 2, respectively.

In this embodiment, the powder bin 3 and the waste toner bin 2 are still coupled by the first end cover 4 and the second end cover 5. For example, the powder bin 3 and the waste toner bin 2 are coupled via the two end sub-covers of the first end cover 4 and the two end sub-covers of the second end cover 5, and the coupling manner thereof is preferred to be a coupling method with a pin, so that the powder bin 3 and the waste toner bin 2 can rotate relatively. Alternatively, the end sub-cover of which the second end cover 5 is coupled to the powder bin can be the same as the protective cover 35.

In this embodiment, the movable assembly 6 can be installed on one of the waste toner bin housing 20, the end sub-cover of the first end cover 4 coupled to the waste toner bin, the end sub-cover of the second end cover 5 coupled to the waste toner bin, and the photosensitive member 21.

As shown in FIG. 11, the processing cartridge 1 further includes a charging member 22 rotatably installed in the waste toner bin housing 20, and the charging member 22 is in contact with the photosensitive member 21 and is configured to charge the surface of the photosensitive member 21. In certain embodiments, the installing part 6*a* of the movable assembly 6 can also be installed on the charging member 22. Furthermore, since the photosensitive member 21 and the charging member 22 are both rotatably installed in the waste toner bin housing 20. The photosensitive member 21 includes a cylindrical rotating shaft and a cover layer (photosensitive layer) covering the outer surface of the rotating shaft, and the charging member 22 includes a cylindrical rotating shaft and a cover layer covering the outer surface of the rotating shaft. Therefore, the photosensitive member 21 and the charging member 22 can also be collectively referred to as a second rotating member. The installing part 6*a* of the movable assembly 6 is installed on the second rotating member in the waste toner bin 2.

Tenth Embodiment

Figure 15:
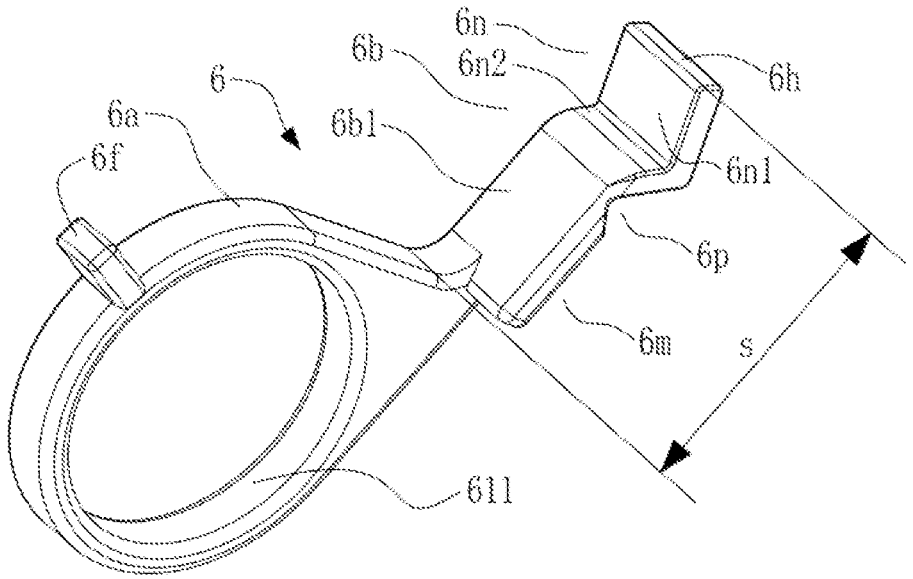
FIG. 15 is a perspective view of a movable assembly according to a tenth embodiment of the present disclosure.
Figure 16:
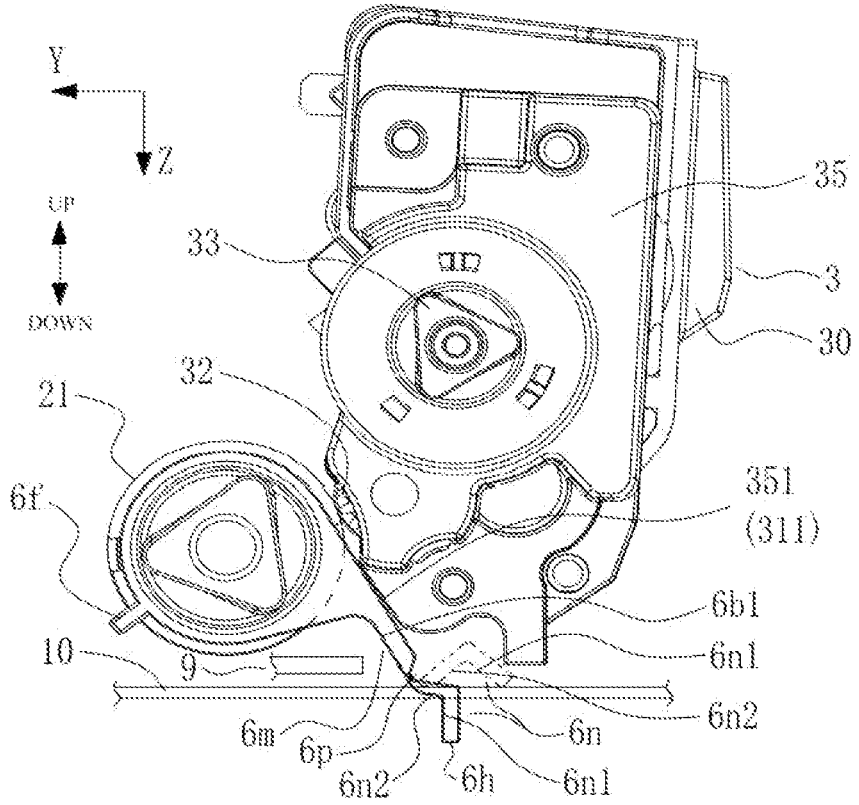
FIG. 16 is a diagram showing status of a processing cartridge installed to an imaging device according to the tenth embodiment of the present disclosure.
Figure 17:
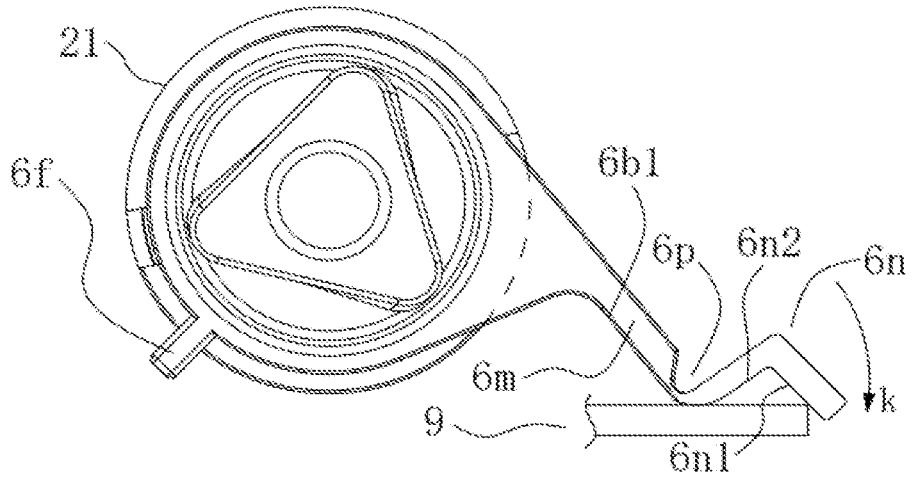
FIG. 17 is a diagram showing coupling of a movable assembly and a force applying portion according to the tenth embodiment of the present disclosure.

FIG. 15 is a perspective view of the movable assembly according to the tenth embodiment of the present disclosure. FIG. 16 is a diagram showing the processing cartridge installed to the imaging device according to the tenth embodiment of the present disclosure. FIG. 17 is a diagram showing coupling of the movable assembly and the force applying portion according to the tenth embodiment of the present disclosure.

This embodiment mainly describe the improvement of the structure of the movable assembly 6. The same components in this embodiment and the aforementioned embodiments will share the same reference signs.

Regarding the processing cartridge 1 provided with the movable assembly 6 referred to in the sixth embodiment, in practice, the inventors find that the force applying portion 9 may cross the free end 6*h* and thereby causing the disengaging from the force receiving surface 6*b*1 during applying a force to the force receiving surface 6*b*1. Therefore, extending the acting part 6*b* is commonly adopted. However, after the acting part 6*b* is extended, when processing cartridge 1 is installed on the imaging device, the free end 6*b* of movable assembly may interfere with the guide rail 10 in the imaging device, as shown by the dashed line in FIG. 14B.

In this embodiment, at least the acting part 6*b* of the movable assembly 6 is configured to be variable in length to overcome the deficiency of the interference of the extended acting part 6*b* with the guide rail 10. Therefore, as an entirety, the length of the movable assembly 6 will also change.

As shown in FIG. 15, the movable assembly 6 in this embodiment includes an installing part 6*a* and an acting part 6*b* that are connected to each other, and the installing part 6*a* is configured to install the movable assembly 6 to the corresponding components of the developing cartridge, and the acting part 6*b* extends outward from the installing part 6*a* to couple with the force applying portion 9 in the imaging device and receive the force applied by the force applying portion 9 to force the developing member 32 and the photosensitive member 21 to separate from each other 20, or in other words, to force the first unit 2 and the second unit 3 to separate from each other.

The acting part 6*b* includes a first portion 6*m* connected with the installing part 6*a* and a second portion 6*n* connected with the first portion 6*m*. At least one of the first portion 6*m* and the second portion 6*n* is deformable, so that the length s of the acting part 6*b* is variable. The length s of the acting part 6*b* thereof refers to the length from the connection position the acting part 6*b* and the acting part up to the free end 6*h* of the movable assembly, which is measured along the extension direction of the acting part 6*b*.

The first portion 6*m* and the second portion 6*n* are integrally formed, the first portion 6*m* forms the force receiving surface 6*b*1, and the second portion 6*n* is deformable. For example, the second portion 6*n* includes a bent portion 6*p*, a blocking surface 6*n*1 and a pressing surface 6*n*2 provided therein. As shown by the dashed line in FIG. 16, when the processing cartridge 1 is installed, none of the force receiving surface 6*b*1, the blocking surface 6*n*1, and the pressing surface 6*n*2 faces upwards. The free end 6*h* of the movable assembly is in contact with the guide rail 10. Under the extrusion of the gravity of the processing cartridge 1, the bent portion 6*p* is deformed, and the interference between the movable assembly 6 and the guide rail 10 disappears, so that the processing cartridge 1 can be installed smoothly. At this time, the movable assembly 6 is located at the non-movable initial position.

As shown in FIG. 17, the figure only shows the photosensitive member 21, the movable assembly 6 and the force applying portion 9. When the force applying portion 9 starts to couple with the acting part 6*b*, once the force applying portion 9 crosses the force receiving surface 6*b*1, the force applying portion 9 will start to contact the second portion 6*n* until the force applying portion 9 abuts against the blocking surface 6*n*1. That is, the movable assembly 6 starts to move from the initial position to the terminal position. For example, the movable assembly 6 rotates around the axis of rotation. During this process, the force applying portion 9 squeezes the bent portion 6*p*. The first portion 6*m* has already abutted against the surface 351/311, therefore, the second portion 6*n* will rotate in the direction shown by k in FIG. 17 with the bent portion 6*p*. When the blocking surface 6*n*1 abuts against the force applying portion 9, the second portion 6*n* stops rotating, and the force applying portion 9 also stops moving. At this time, the movable assembly 6 reaches the terminal position, the force applied by the force applying portion 9 can also be transmitted to the second unit 3 through the pressing surface 6*n*2/the blocking surface 6*n*1, Finally, the second unit 3 rotates in the direction shown by r in FIG. 14A, the first unit 2 and the second unit 3 are separated from each other. At the same time, the photosensitive member 21 and the developing member 32 are separated from each other. It can be seen that the blocking surface 6*n*1 and the pressing surface 6*n*2 can also be regarded as a force receiving surface. When the force applying portion 9 moves in the direction opposite to the direction shown by M, the force applied by the force applying portion 9 disappears and under the action of the elastic restoring force of an elastic member 7, the second unit 3 urges the movable assembly 6 through the transmission surface 351/311 to be restored, that is, the movable assembly 6 returns to the initial position from the terminal position, the first unit 2 and the second unit 3 return to a position close to each other again, and the photosensitive member 21 and the developing member 32 are also in contact again.

Under the premise that the length s of the acting part 6*b* is variable and the acting part 6*b* is integrally formed, this embodiment can also have multiple implementation manners. For example, the positions of the first portion 6*m* and the second portion 6*n* are interchanged. Furthermore, the purpose of the present invention can be achieved by the connection the bent portion 6*p* and the installing part 6*a*, or the replacement of the bent portion 6*p* with an elastic material, which will not be listed here.

Eleventh Embodiment

Figure 18:
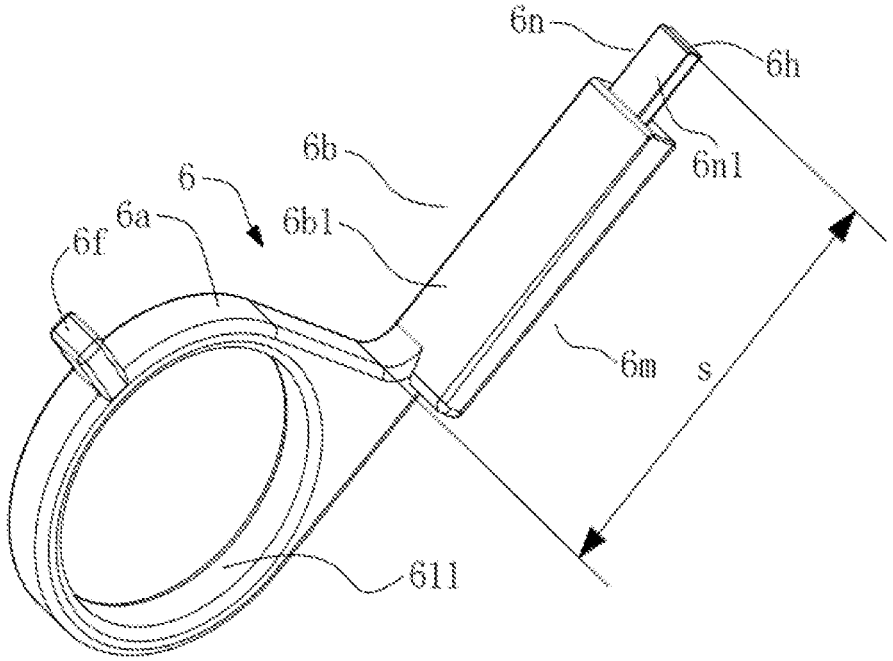
FIG. 18 is a perspective view of a movable assembly according to an eleventh embodiment of the present disclosure.

FIG. 18 is a perspective view of the movable assembly according to the eleventh embodiment of the present disclosure.

This embodiment aims at changing the acting part 6*b* in the tenth embodiment. The acting part is formed separately and further includes the first portion 6*m* and the second portion 6*n*. Along the extension direction of the acting part 6*b*, the first portion 6*m* and the second portion 6*n* can protrude and retract relatively. As shown in FIG. 18, the first portion 6*m* is fixedly connected with the installing part 6*a* and the second portion 6*n* can protrude and retract relative to the first portion 6*m*. Therefore, the length s thereof is variable in the extension direction of the acting part 6*b*/the moving direction of the acting part 6*b* after receiving the force applied by the force applying portion 9. Correspondingly, the length of the movable assembly 6 is variable as well.

Similarly, after the processing cartridge 1 provided with the movable assembly 6 according to this embodiment is installed in the imaging device, the free end 6*h* of the movable assembly interferes with the guide rail 10. Under the gravity of the processing cartridge 1, the second portion 6*n* retracts towards the first portion 6*m* inside, so that the processing cartridge 1 can be installed smoothly. At this time, neither of the force receiving surface 6*b*1 formed on the first portion 6*m* nor the blocking surface 6*n*1 formed on the second portion 6*n* faces upward.

When the force applying portion 9 starts to contact the acting part 6*b*, the installing part 6*a* starts to rotate around the center of the coupling portion 611 thereof, and the surface of the first portion 6*m* which is opposite to the force receiving surface 6*b*1 starts to force the transmission surface 351/311 and thereby makes the second unit 3 to rotate relative to the first unit 2 so that the second unit 3 and the first unit 2 are separated from each other. At the same time, the photosensitive member 21 and the developing member 32 are also separated from each other.

When the force applying portion 9 is no longer in contact with the acting part 6*b*, under the elastic restoring force of the elastic member 7, the second unit 3 forces the movable assembly 6 to rotate around the opposite direction to restore. At the same time, the first unit 2 and the second unit 3 approach each other again, and the photosensitive member 21 and the developing member 32 are in contact again as well.

Twelfth Embodiment

Figure 19:
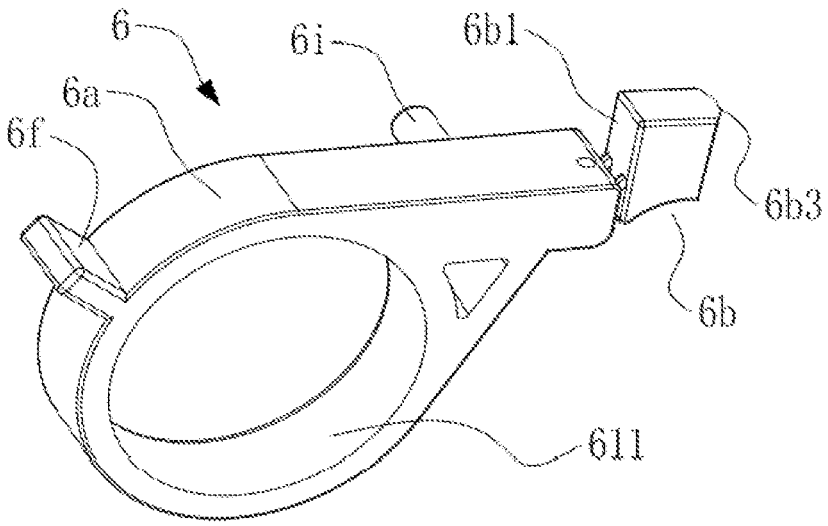
FIG. 19 is a perspective view of a movable assembly according to a twelfth embodiment of the present disclosure.
Figure 20:
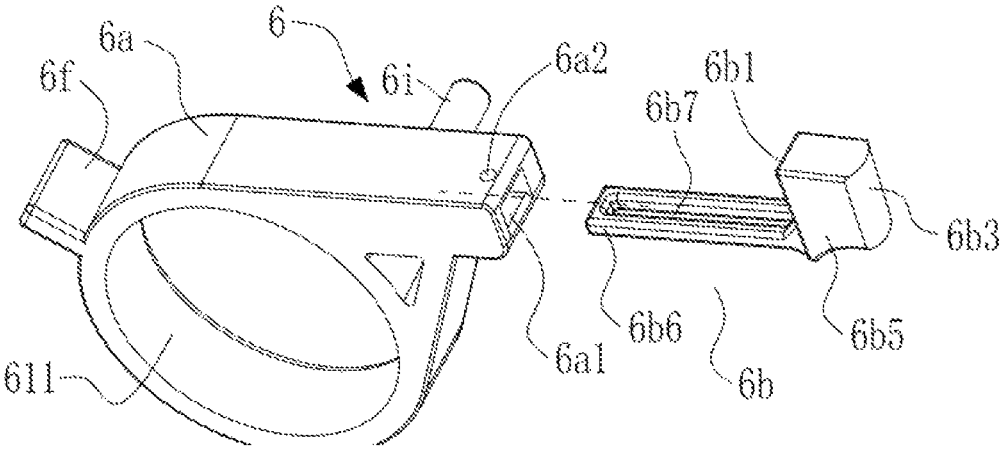
FIG. 20 is an exploded diagram of components of the movable assembly according to the twelfth embodiment of the present disclosure.
Figure 21:
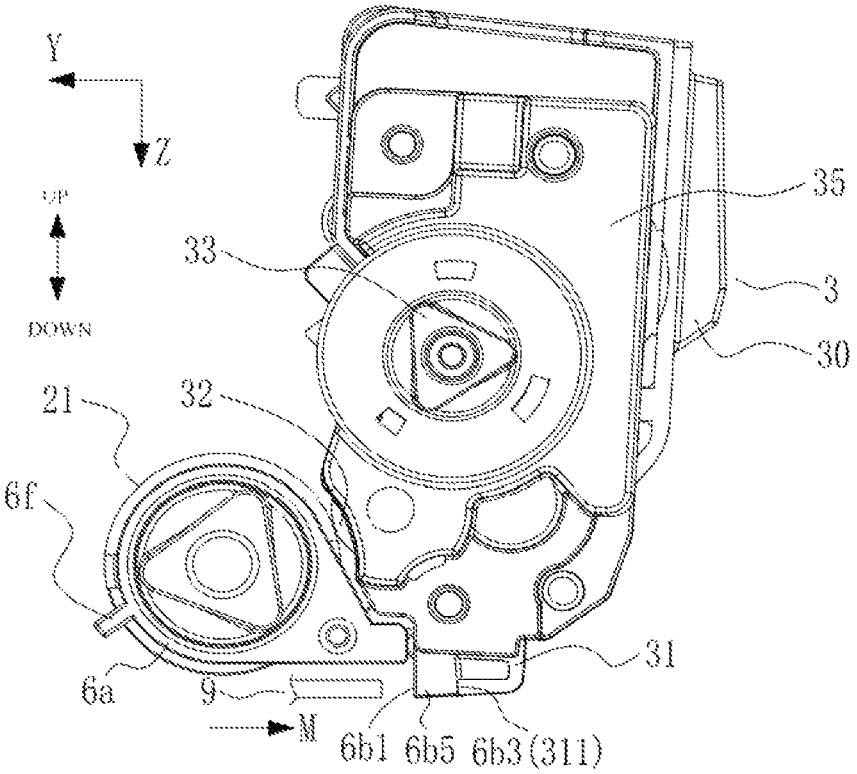
FIG. 21 is a diagram showing status of the processing cartridge before being coupled to the force applying portion according to the twelfth embodiment of the present disclosure.

FIG. 19 is a perspective view of the movable assembly according to the twelfth embodiment of the present disclosure. FIG. 20 is an exploded diagram of the components of the movable assembly according to the twelfth embodiment of the present disclosure. FIG. 21 is a diagram showing the processing cartridge before being coupled to the force applying portion according to the twelfth embodiment of the present disclosure.

According to the actual test situation, the movable assembly according to this embodiment has been further improved. As shown in FIG. 19, the movable assembly 6 includes an installing part 6*a* and an acting part 6*b* that are connected to each other. The installing part is installed through the coupling portion 611, and the acting part 6*b* is configured to be coupled to the force applying portion 9 and receives the force applied by the force applying portion 9 to force the first unit 2 and the second unit 3 to separate from each other. The acting part 6*b* is movable relative to the installing part 6*a*. For example, the acting part 6*b* can protrude and retract relative to the installing part 6*a* in a direction that is substantially parallel to the moving direction of the force applying portion 9, and therefore, the length thereof along the extension direction of the acting part 6*b* is variable.

As shown in FIG. 20, the installing part 6*a* is provided with a installing hole 6*a*1, and the acting part 6*b* includes an acting block 6*b*5 and a protrusion 6*b*6 which are connected to each other. The protrusion 6*b*6 is contained by the installing hole 6*a*1 and can move in the installing hole 6*a*1. The acting block 6*b*5 is formed with a force receiving surface 6*b*1 and the force output surface 6*b*3 which are opposite to each other. The force receiving surface 6*b*1 is configured to receive the force applied by the force applying portion 9, and the force output surface 6*b*3 transmits the force to the transmission surface 351/311 of the toner bin.

In order to prevent the protrusion 6*b*6 from slipping out of the installing hole 6*a*1, the movable assembly 6 achieves this purpose through the coupling method with a pin. Further referring to FIG. 20, the installing part 6*a* is provided with a pin hole 6*a*2, the protrusion 6*b*6 is provided with an elongated hole 6*b*7, and the pin (not shown) passes through the pin hole 6*a*2 and the elongated hole 6*b*7, so as to prevent the acting part 6*b* and the installing part 6*a* from separating from each other.

As shown in FIG. 21, in order to show the structure related to the present disclosure in the processing cartridge 1 more clearly, the first unit housing 20 and the second end cover 5 are omitted in this figure. After the processing cartridge 1 is installed in the imaging device, the force receiving surface 6*b*1, the force output surface 6*b*3, and the transmission surface 311 do not face upwards. In certain embodiments, the force receiving surface 6*b*1 and the transmission surface 311 face the +Y direction, or face the direction opposite to the moving direction M, the force output surface 6*b*3 faces the −Y direction, or faces opposite to the moving direction M of the force applying portion 9. Therefore, when the force applying portion 9 moves to the force receiving surface 6*b*1, the two can be coupled more smoothly.

When the force applying portion 9 applies a force to the force receiving surface 6*b*1, the acting part 6*b* starts to move in the direction shown by M. The length of the acting part 6*b* is variable under the action of the protrusion 6*b*6 and the installing hole 6*a*1, or in other words, in the moving direction of the acting part 6*b*, the length of the movable assembly 6 is variable. Therefore, the acting part 6*b* can move with the movement of the force applying portion 9. In this process, the installing part 6*a* can remain stable without being affected by the movement of the acting part 6*b*. Furthermore, even if the stroke of the force applying portion 9 is too long, and the acting part 6*b* is restricted by the pin and thereby cannot continue to move in the direction shown by M, the acting part 6*b* can rotate around the axis (the rotation axis of the photosensitive member) with the mounting part 6*a* without the unfavorable result of separation of the acting part 6*b* and the installing part 6*a*.

In certain embodiments, during the process that the movable assembly 6 is forced by the force applied by the force applying portion 9, in order to prevent the instability caused by the swinging of the movable assembly 6, as shown in FIGS. 19 and 20, the movable assembly 6 also includes a restriction column 6*i* provided on the installing part 6*a*. The restriction column 6*i* is configured to abut against components other than the movable assembly 6 in the processing cartridge 1, for example, the restriction column 6*i* abuts against the second end cover 5. Furthermore, the force output surface 6*b*3 and the transmission surface 311 are configured as arc surfaces that cooperate with each other. Therefore, the movable assembly 6 can finally stably transfer the force to the second unit 3, even if the acting part 6*b* deflects.

Thirteenth Embodiment

Figure 22:
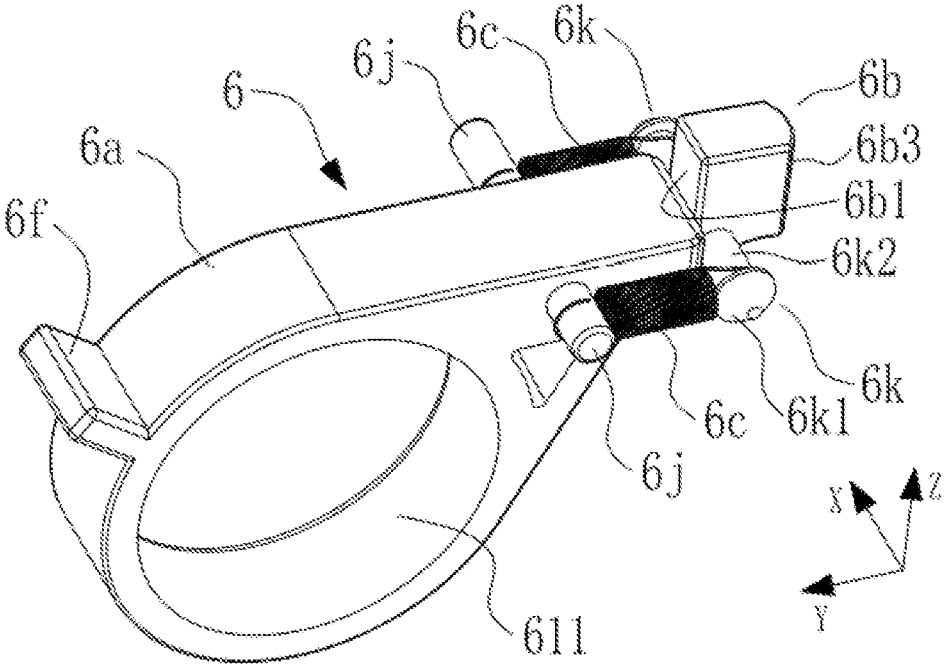
FIG. 22 is a perspective view of the movable assembly according to a thirteenth embodiment of the present disclosure.
Figure 23:
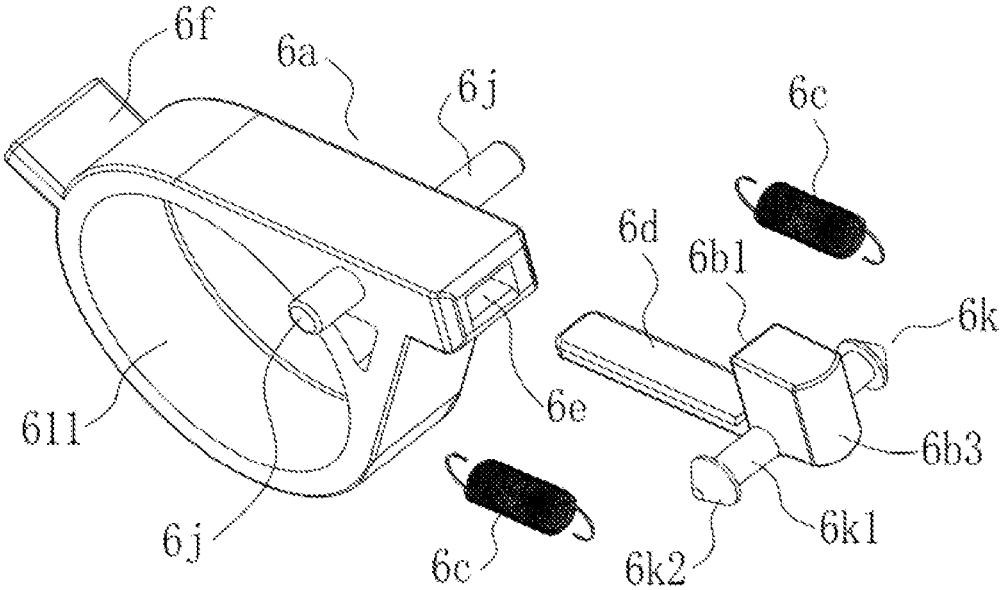
FIG. 23 is an exploded diagram of components of the movable assembly according to the thirteenth embodiment of the present disclosure.
Figure 24:
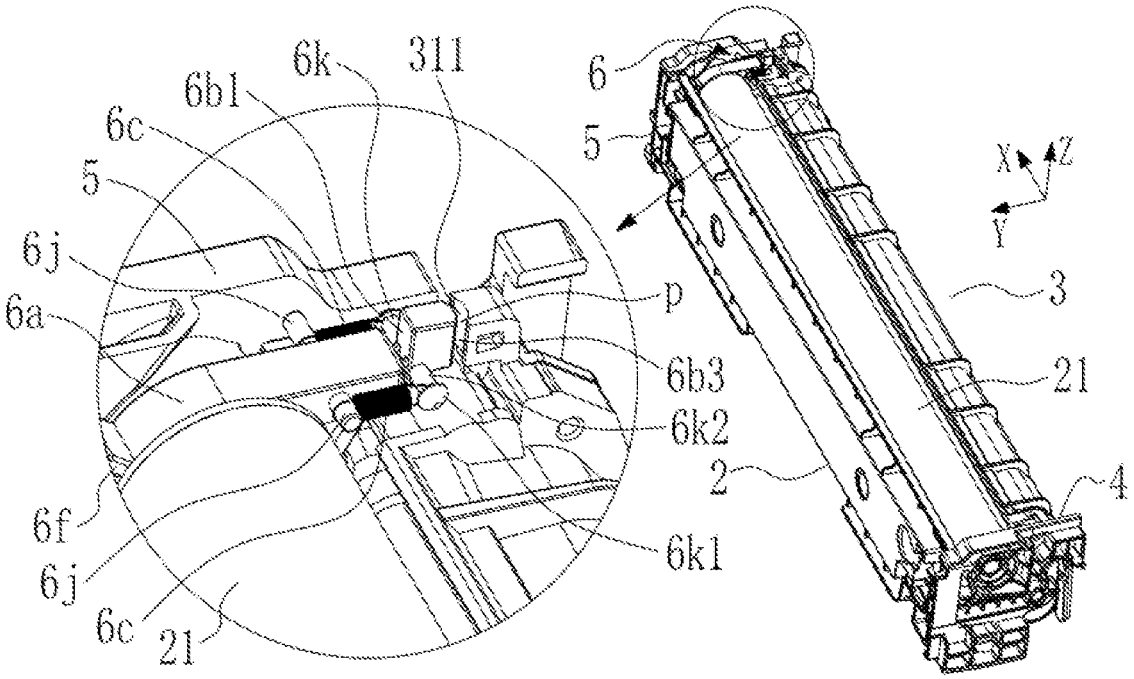
FIG. 24 is a diagram showing the movable assembly assembled to a processing cartridge according to the thirteenth embodiment of the present disclosure.

FIG. 22 is a perspective view of the movable assembly according to the thirteenth embodiment of the present disclosure. FIG. 23 is an exploded diagram of the components of the movable assembly according to the thirteenth embodiment of the present disclosure. FIG. 24 is a diagram showing the movable assembly assembled to the processing cartridge according to the thirteenth embodiment of the present disclosure.

This embodiment is mainly developed on the basis of the twelfth embodiment. Similarly, the movable assembly 6 according to this embodiment includes an installing part 6*a* and an acting part 6*b* that are connected to each other, and the acting part 6*b* is movable relative to the installing part 6*a*, so that the length of the movable assembly 6 in the extension direction of the acting part 6*b* is variable.

The difference from the twelfth embodiment is that the installing part 6*a* and the acting part 6*b* in this embodiment are no longer connected by pins, but by an elastic member 6*c*. When the force applied by the force applying portion 9 is removed, even if the compression spring 7 between the first unit 2 and the second unit is aging and thereby cannot generate enough thrust to force the second unit 3 to rotate towards the direction close to the first unit 2. Under the action of the elastic restoring force of the elastic element 6*c* without relying on the urging action of the second unit 3 on the acting part 6*b*, the acting part 6 can return to the initial position more quickly and smoothly. When the processing cartridge 1 is not installed in the electronic photo imaging device or when the cartridge 1 is in operation in the electronic photo imaging device, the acting part 6*b* will not move relative to the installing part 6*a* easily under the action of the elastic member 6*c*. For example, when the electronic photo imaging device is transported or when vibrating occurs during the working process of the electronic photo imaging device, the acting part 6*b* in the twelfth embodiment may slide in the installing hole under the guidance of the protrusion 6*b*6.

Two elastic members 6*c* are provided. Along the X direction, the two elastic members 6*c* are provided on both sides of the installing part 6*a*, respectively. One end of each elastic member 6*c* is connected with the installing part 6*a*, and the other end is connected with the acting part 6*b*. Under the action of the elastic members 6*c*, the acting part 6*b* tends to approach the installing part 6*a*.

As shown in FIG. 22, the movable assembly 6 further includes first positioning columns 6*j* respectively located on both sides of the installing part 6*a* along the x direction, and second positioning columns 6*k* respectively located on both sides of the acting part 6*b*. In certain embodiments, the elastic members 6*c* are tension springs, and the first columns 6*j* and the second positioning columns 6*k* respectively extend away from the installing part 6*a* or away from the acting part 6*b* in the x direction, and both ends of the tension springs 6*c* are respectively connected to the first positioning column 6*j* and the second positioning column 6*k*. At this time, the tension springs 6*c* are located outside the installing part 6*a* and the acting part 6*b* and thereby can be easily and quickly installed and removed. In some embodiments, the tension springs 6*c* can also be installed in the installing grooves (not shown) of the installing part 6*a* and the acting part 6*b*. The first positioning column 6*j* and the second positioning column 6*k* do not extend from the installing part 6*a* and the acting part 6*b*, but are provided in the installing grooves. At this time, the difficulty of installing the tension springs 6*c* is increased, but it is beneficial to reduce the size of the movable assembly 6 in the x direction, thereby reducing the size of the processing cartridge 1.

In certain embodiments, at least one of the first positioning column 6*j* and the second positioning column 6*k* includes a connecting portion connected with the elastic member 6*c* and the anti-falling portion for preventing the elastic member 6*c* from falling out. In certain embodiments, the second positioning column 6*k* includes a connecting portion 6*k*1 connected with the acting part 6*b* and an anti-falling portion 6*k*2 provided on the connecting portion 6*k*1. One end of the tension spring 6*c* is located between the acting part 6*b* and the anti-falling portion 6*k*2. During the movement of the acting part 6*b* relative to the installing part 6*a*, the tension spring 6*c* will not be disconnected from the connecting portion 6*k*1. Similarly, the first positioning column 6*j* can also abut against the second end cover 5 to ensure that the movable assembly 6 can stably transfer the force to the second unit 3.

As shown in FIG. 23, the same as in the above embodiment, the installing part 6*a* in this embodiment is provided with a guide groove 6*e*, and the acting part 6*b* is provided with a protrusion 6*d* that can be guided by the guide groove 6*e*. Alternatively, the guide groove 6*e* is provided on the acting part 6*b*, the protrusion 6*d* is provided on the installing part 6*a*, and the elastic members 6*c* are still located between the installing part 6*a* and the acting part 6*b* and make the acting part 6*b* have a tendency to approach the acting part 6*a*. Along the Y direction, the force receiving surface 6*b*1 and the force output surface 6*b*3 are oppositely provided on the acting part 6*b*. The receiving surface 6*b*1 is closer to the installing part 6*a*/the force applying portion 9 than the force output surface 6*b*3. When the force applying portion 9 moves towards the acting part 6*b* in the −Y direction, the acting part 6*b* can contact the force applying portion 9 earlier. Correspondingly, the stroke of the acting part 6*b* is longer, and the angle of which the second unit 3 rotates relative to the first unit 2 is greater. It can be understood that in the case of low requirements of the angle of which the second unit 3 rotates relative to the first unit 2, along the Y direction, the force receiving surface 6*b*1 can also be provided not closer to the installing part 6*a*/the force applying portion 9 than the force output surface 6*b*3. That is, along the Y direction, the distance from the force receiving surface 6*b*1 to the installing part 6*a*/the force applying portion 9 is equal to the distance from the force output surface 6*b*3 to the installing part 6*a*/the force applying portion 9, or the force receiving surface 6*b*1 is farther away from the installing part 6*a*/the force applying portion 9 than the force output surface 6*b*3. The force applying portion 9 needs to pass through a long stroke to abut against the force receiving surface 6*b*1. In case that the total stroke of the force applying portion 9 is constant, the stroke of the movement that the force applying portion 9 urges the action part 6*b* via the force receiving surface 6*b*1 is shortened, and finally the angle of which the acting part 6*b* forces the second unit 3 relative to rotate relative to the first unit 2 is reduced.

As shown in FIG. 24, after the movable assembly 6 is installed, a gap p is formed between the force output surface 6*b*3 and the transmission surface 311 in the second unit 3. That is, the force output surface 6*b*3 is not in contact with the transmission surface 311. When the force applying portion 9 abuts against the force receiving surface 6*b*1 in the −y direction, the acting part 6*b* needs to move a certain distance along the −y direction before the force output surface 6*b*3 can abut against the transmission surface 311. In this way, the momentary force applied by the force applying portion 9 to the force receiving surface 6*b*1 can be prevented from being excessively large, which is transferred to the second unit 3, so that the loss of the transmission surface 311 is great and even the components which is provided with the transmission surface 311 in the second unit 3 is broken. At the same time, the gap p can further prevent the external force from being applied to the acting part 6*b* when the second unit 3 is not required to rotate relative to the first unit 2, so that the force is transmitted to the second unit 3.

Alternatively, the elastic members 6*c* may also be a tension springs installed between the acting part 6*b* and the second unit housing 30, or the elastic members 6*c* may also be compression springs installed between the acting part 6*b* and the first unit 2, or the elastic members 6*c* may also be torsion springs abutting against the acting part 6*b*. Under the action of the elastic members 6*c*, the acting part 6*b* has a tendency to approach the installing part 6*a*.

Fourteenth Embodiment

Figure 25:
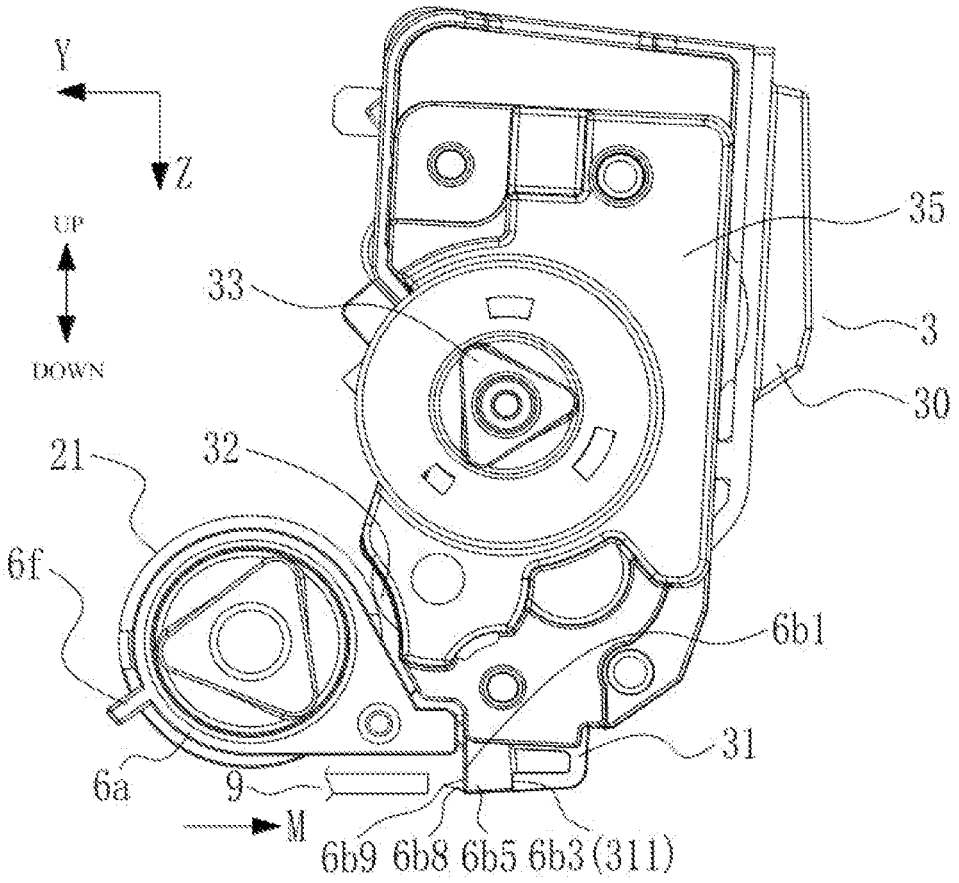
FIG. 25 is a diagram showing status of a processing cartridge before being coupled to a force applying portion according to a fourteenth embodiment of the present disclosure.

FIG. 25 is a diagram showing the processing cartridge before being coupled to the force applying portion according to the fourteenth embodiment of the present disclosure.

Unlike the surface-to-surface contact formed between the force applying portion 9 and the movable assembly 6 in the above-mentioned embodiments, in this embodiment, a surface-to-point contact is formed between the force applying portion 9 and the movable assembly 6. As shown in this figure, the movable assembly 6 further includes a cone 6*b*8 extending in a direction close to the first unit 2/the photosensitive member 21, and the cone 6*b*8 extends from the force receiving surface 6*b*1, and the top/tip portion 6*b*9 of the cone 6*b*8 faces the force applying portion 9.

When the force applying 9 abuts against the cone 6*b*8, a surface-to-point contact is formed between the two, and the force applied by the force applying 9 is concentrated on the cone 6*b*8 by the top/tip part 6*b*9. In this embodiment, the size of the component (the cone 6*b*8 or the top/tip 6*b*9) of the movable assembly 6 for receiving force is reduced, especially along the up-and-down direction of the processing cartridge, the size of the cone 6*b*8 is smaller than the size of the force receiving surface 6*b*1, so that the size of the processing cartridge in the up-and-down direction can be effectively controlled.

Fifteenth Embodiment

Figure 26A:
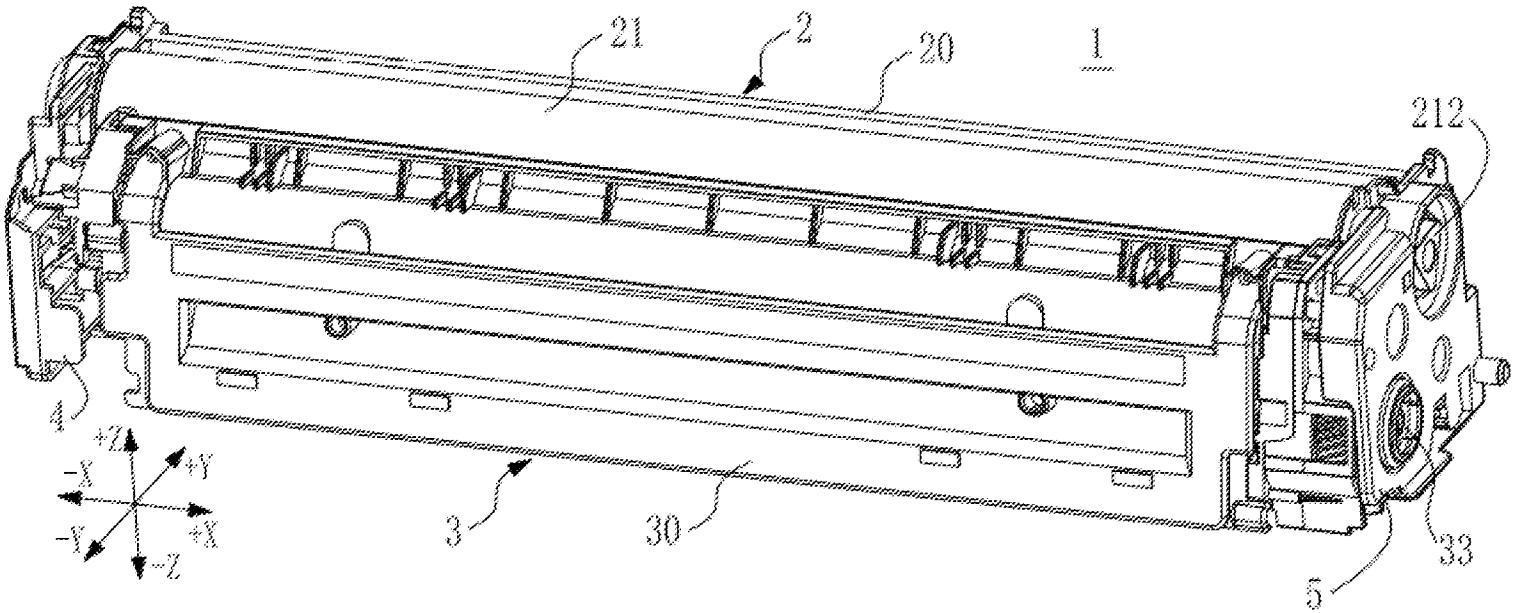
FIGS. 26A and 26B are perspective views of a processing cartridge according to a fifteenth embodiment of the present disclosure.
Figure 26B:
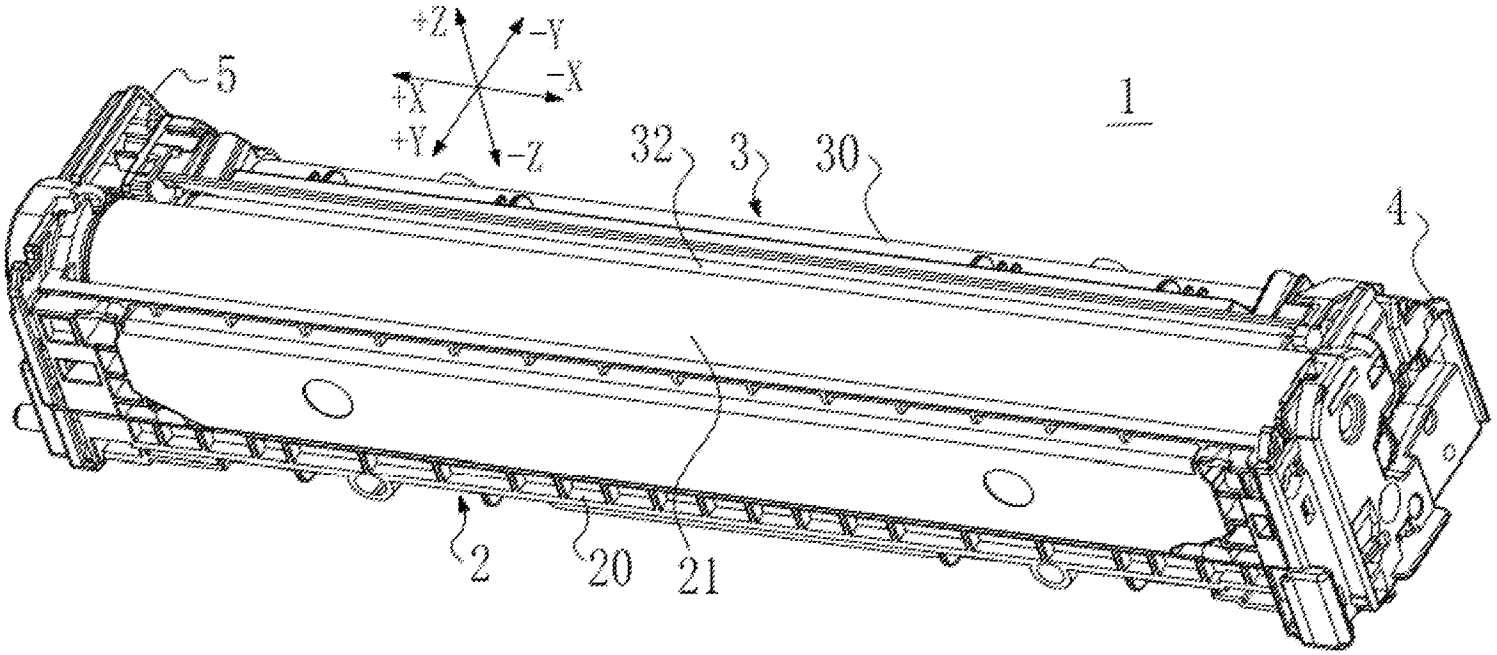
Figure 27:
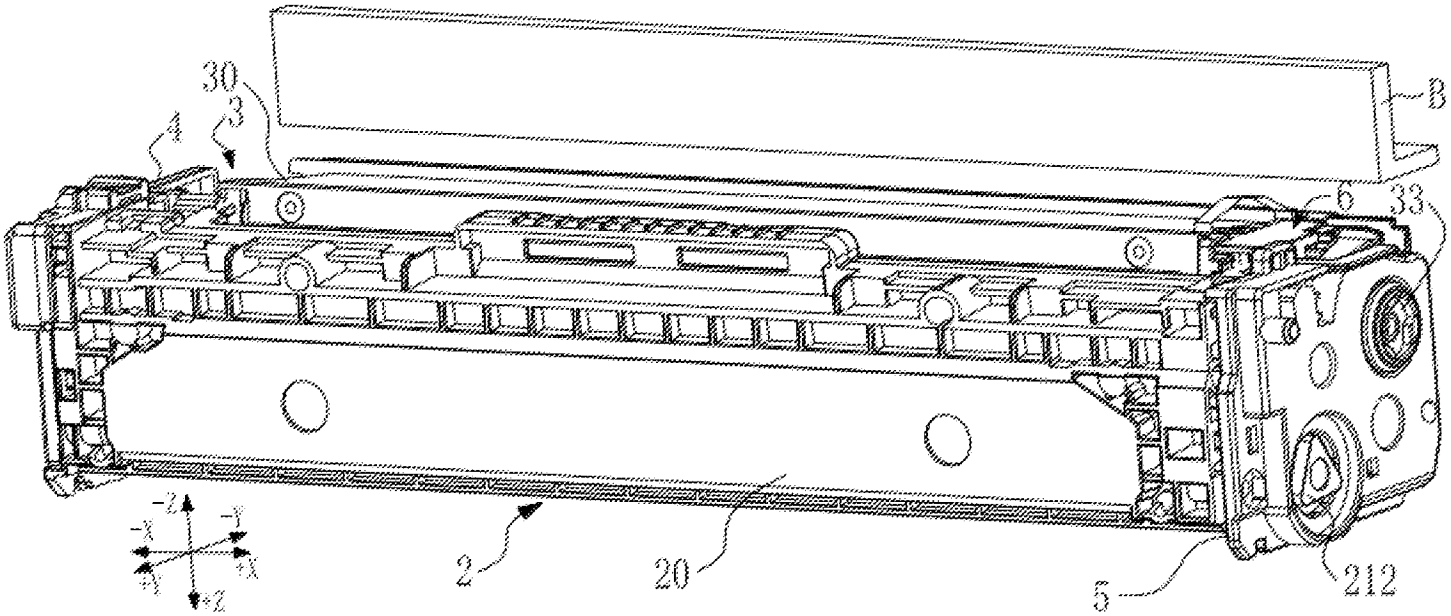
FIG. 27 is a diagram showing status of the processing cartridge to be installed according to the fifteenth embodiment of the present disclosure.

FIG. 26A and 26B are perspective views of the processing cartridge according to the fifteenth embodiment of the present disclosure. FIG. 27 shows the processing cartridge to be installed according to the fifteenth embodiment of the present disclosure.

As shown in this figure, the processing cartridge 1 includes a developing unit 3 (the second unit) and an imaging unit 2 (the first unit) which are relatively rotatable, a first end cover 4 and a second end cover 5 located at the two longitudinal ends of the processing cartridge, respectively, and a developing member 11 and a photosensitive member 21 rotatably installed on the developing unit 3 and the imaging unit 2, respectively. The photosensitive member 21 is exposed to the outside.

The processing cartridge 1 in this embodiment also has the same longitudinal direction X, lateral direction Y, and vertical direction Z as in the above embodiments. The developing unit 3 includes a developing frame 30 (the second unit housing) and a second power receiving member 33 installed in the +X direction of the developing unit. Unlike the above-mentioned embodiments, the movable assembly 6 in this embodiment is provided above the processing cartridge 1. When the processing cartridge 1 is installed onto the imaging device, the movable assembly 6 is located in the −Z direction of the processing cartridge.

The imaging unit 2 includes an imaging frame 20 (the first unit housing) and a first power receiving member 212 installed in the +X direction of the imaging unit. The developing member 11 and the photosensitive member 21 are rotatably installed in the developing frame 30 and the imaging frame 20, respectively. After the processing cartridge 1 is installed in the imaging device, the first power receiving member 212 and the second power receiving member 22 will be connected to the power output member provided in the imaging device, respectively, and starts to rotate under driven by the power output member. The second power receiving member 33 rotates around the rotation axis L rotates and transmits the driving force to the developing member 11 so that the developing member 11 rotates. The first power receiving member 212 rotates around the rotation axis L1 rotates and transmits the driving force to the photosensitive member 21 so as to drive the photosensitive member 21 to rotate.

As shown in FIG. 27, the processing cartridge 1 is installed upside down, that is, the side (upper) where the photosensitive member 21 is installed is installed in a manner of being placed in the lower part, and then the processing cartridge 1 is urged forward until reaching the predetermined installation position. Along the front-to-rear direction of the processing cartridge 1, the imaging device is also provided with a reinforcing plate B for reinforcing the overall strength, that is, the processing cartridge 1 has to pass through the reinforcing plate B when moving along the front-to-rear direction.

Figure 28:
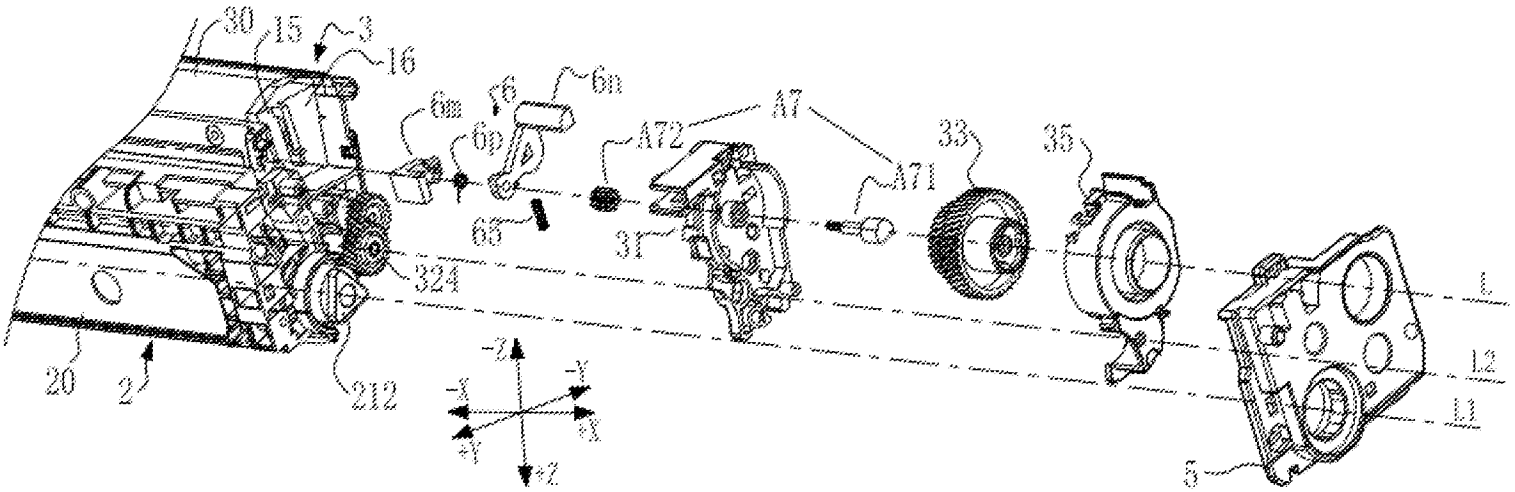
FIG. 28 is an exploded diagram of part of components of a driving end in the processing cartridge according to the fifteenth embodiment of the present disclosure.

FIG. 28 is an exploded diagram of part of the components of the driving end in the processing cartridge according to the fifteenth embodiment of the present disclosure. FIGS.

29A and 29B are perspective views of separating force receiving member in the processing cartridge according to the fifteenth embodiment of the present disclosure.

As shown in FIG. 28, the +X direction end of the developing member 11 is equipped with a developing member gear 324 for receiving the driving force of the second power receiving member 33, the processing cartridge 1 also includes a protective cover 35 for protecting the second power receiving member 33 and a bracket 31 for supporting the second power receiving member 212, a movable assembly 6 movably installed therein, and an unlocking mechanism A7. The movable assembly 6 and the unlocking mechanism A7 are combined in a detachable manner. Therefore, the movable assembly 6 has a locked state and an unlocked state of being unlocked by the unlocking mechanism A7.

When the movable assembly 6 is at the locked state (the first state), at least part of the movable assembly 6 retracts back into the processing cartridge 1. At this time, the movable assembly 6 does not interfere with the imaging device. When the movable assembly 6 is at the unlocked state, at least part of the movable assembly 6 protrudes out of the processing cartridge 1. At this time, the movable assembly 6 is in the second state of receiving the separating force from the imaging device, when the developing unit 3 and the imaging unit 2 are separated from each other and meanwhile the developing member 11 and the photosensitive member 21 are separated from each other. When the movable assembly 6 is in the first state, the movable assembly 6 is locked. Unlike the detaching mechanism of the processing cartridge in the patent EP1977289 A, if the first force receiving portion 75 of the cartridge is touched by an external force, the second force receiving portion 70 will protrude, at this time, the second force receiving portion will has the risk of being broken. However, the movable assembly 6 according to the present disclosure will not protrude despite of any external force.

The force to unlock the movable assembly 6 comes from the unlocking mechanism A7, and the unlocking mechanism A7 and the second power receiver 33 are coupled to each other. With the rotation of the second power receiving member 33, the unlocking mechanism A7 starts to move, and thereby unlocks the movable assembly 6.

As shown in this figure, the movable assembly 6 includes a sliding member (installing part) 6*m*, a separating force receiving part (acting part) 6*n*, and a first elastic member (holding member) 6*p* and a second elastic member 65. The separating force receiving member 6*n* is rotatably supported by the sliding member 6*m* and is guided by the sliding member 6*m*, and the holding member 6*p* is coupled to the separating force receiving member 6*n* to keep the force receiving member 6*n* not inclined in the up and down direction of the processing cartridge 1. The second elastic member 65 is configured to provide power for the extension of the separating force receiving member 6*n*. When the movable assembly 6 is in the first state, the second elastic member 65 is elastically deformed. When the movable assembly 6 is unlocked, the elastic restoring force of the second elastic member 65 causes the separating force receiving member 6*n* to protrude out of the processing cartridge 1.

In certain embodiments, the holding member 6*p* is a torsion spring, the second elastic member 65 is a compression spring, and the movable assembly 6 is installed in the +X direction of the developing frame 30. Further, the movable assembly 6 is installed between the developing frame 30 and the frame 31 to ensure that the movable assembly 6 will not shake or fall off in the X direction of the processing cartridge 1. When the processing cartridge 1 is in operation, the photosensitive member 21 can rotate along the rotation axis L1, and the developing member 11 can rotate along the rotation axis L2. The separating force receiving member 6*n* is coaxial with the first power receiving member 212. That is, the separating force receiving member 6*n* can rotate around the rotation axis L, and the rotation axes L1, L2, and L are parallel.

Figure 29A:
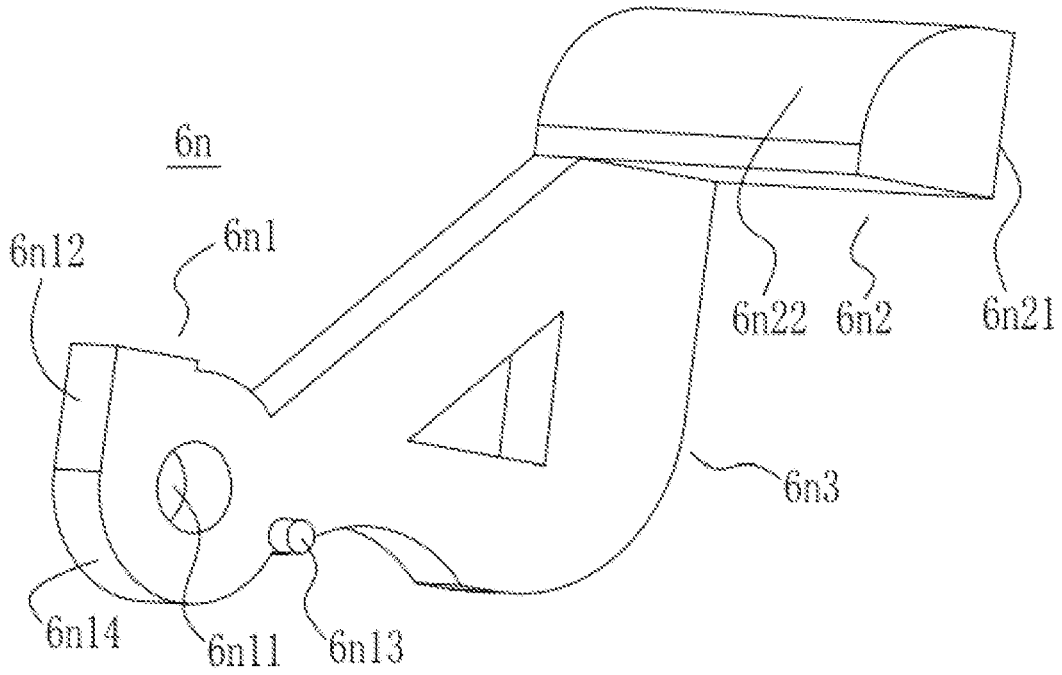
FIGS. 29A and 29B are perspective views of a separating force receiving member in the processing cartridge according to the fifteenth embodiment of the present disclosure.
Figure 29B:
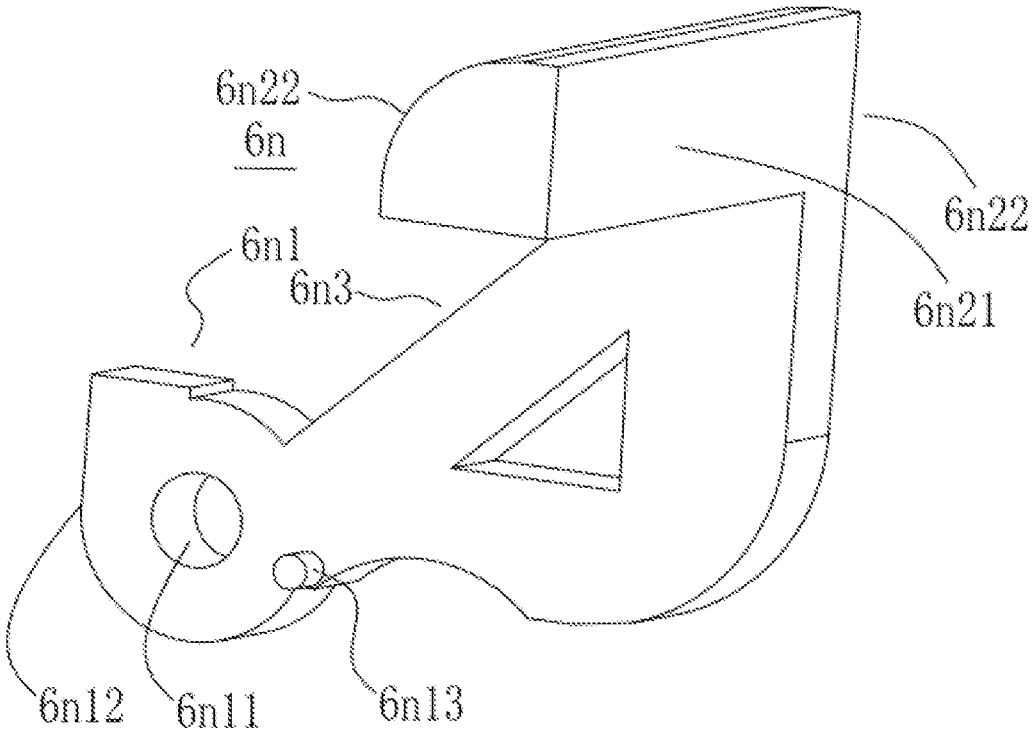

As shown in FIGS. 29A and 29B, the separating force receiving member 6*n* includes a rotating portion 6*n*1, a force receiving portion 6*n*2, and a connecting portion 6*n*3. The rotating portion 6*n*1 is coupled to the sliding member 6*m*, the force receiving portion 6*n*2 is configured to receive separating force, and the connecting portion 6*n*3 connects the rotating portion 6*n*1 and the force receiving portion 6*n*2.

Figure 31A:
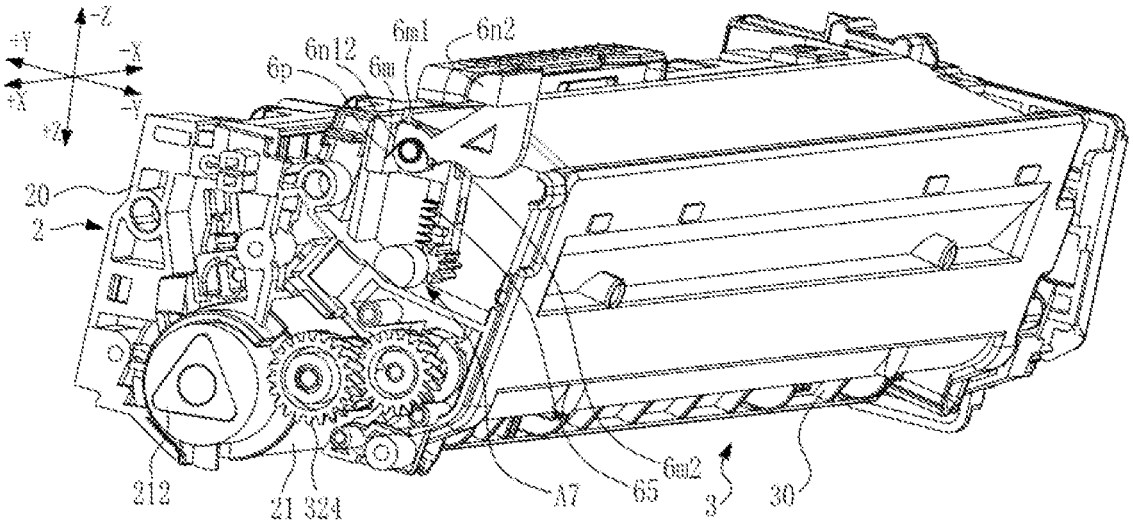
FIGS. 31A, 31B and 31C are diagrams showing the separating force receiving member in the processing cartridge in a second state according to the fifteenth embodiment of the present disclosure.
Figure 31B:
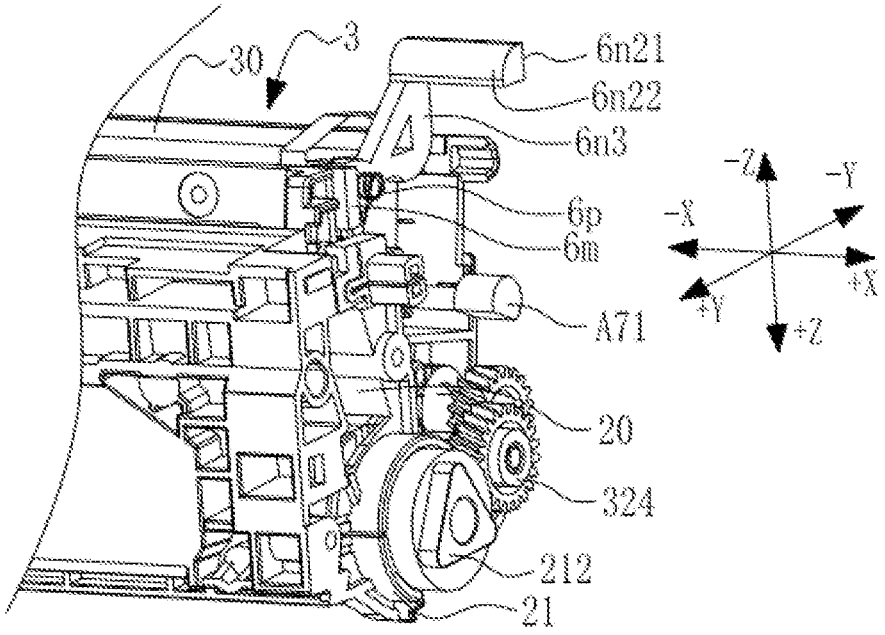
Figure 31C:
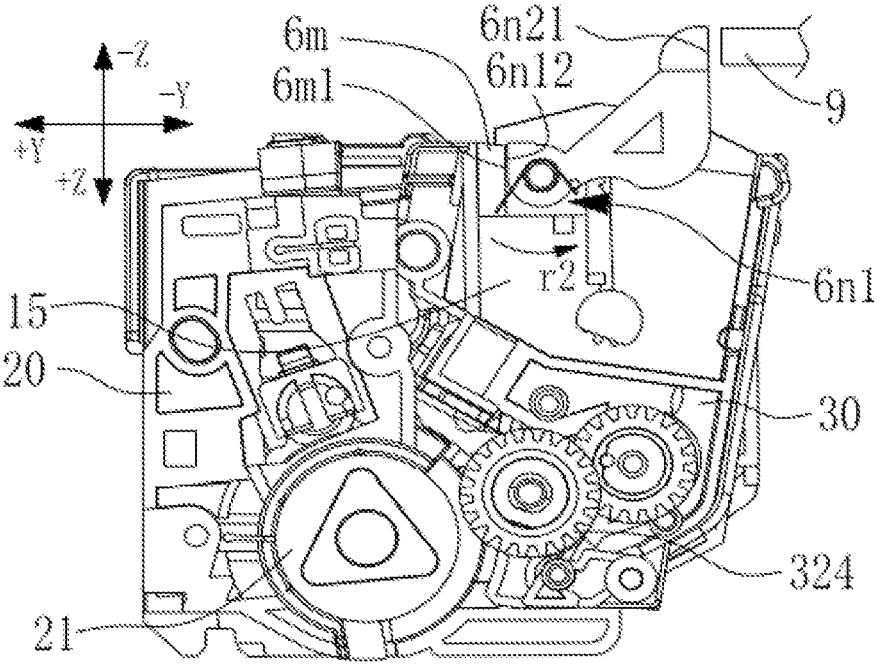
Figure 32A:
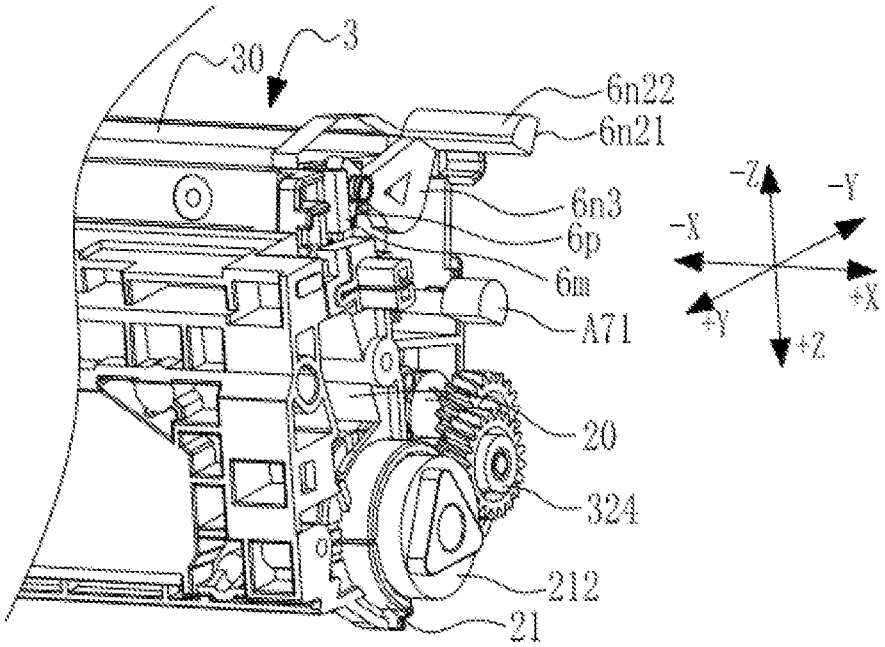
FIGS. 32A and 32B are diagrams showing the separating force receiving member in the processing cartridge in a third state according to the fifteenth embodiment of the present disclosure.
Figure 32B:
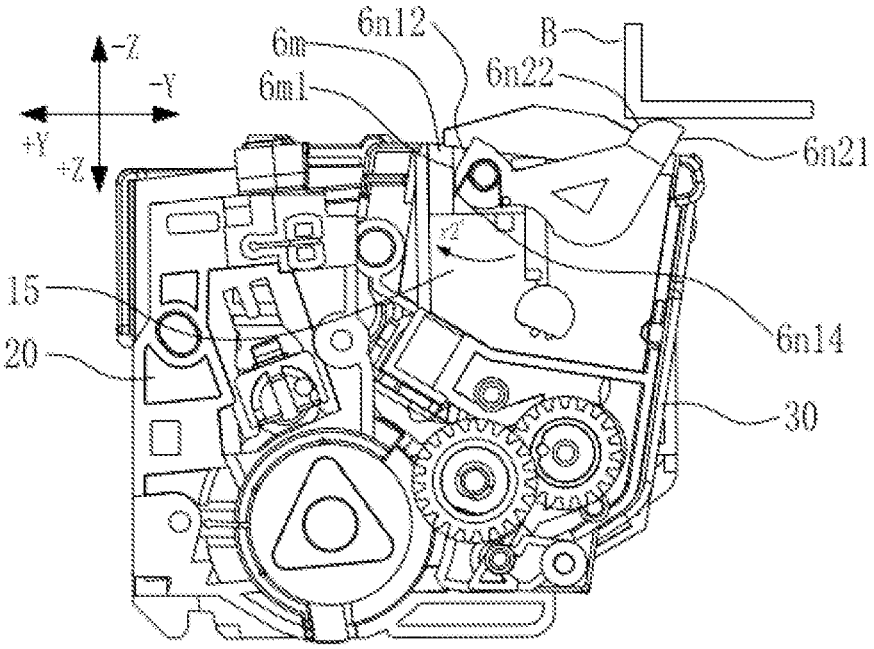

The rotating portion 6*n*1 includes a rotation center 6*n*11 and a force transmission surface 6*n*12 provided along the circumference of the rotation center 6*n*11, and a turning surface 6*n*14. The force transmission surface 6*n*12 is configured to transmit the separating force received by the force receiving portion 6*n*2, the turning surface 6*n*14 is configured to avoid interference between the rotating portion 6*n*1 and external components when the separating force receiving part 6*n* is turned (inclined). In certain embodiments, the force transmission surface 6*n*12 and the turning surface 6*n*14 are arranged adjacent to each other, so that the separating force receiving member 6*n* can be rapidly switched between the state of transmitting the separating force and turning over. The force receiving part 6*n*2 includes a first force receiving surface 6*n*21 and a second force receiving surface 6*n*22. The first force receiving surface 6*n*21 is configured to contact the force applying portion 9 (as shown in FIG. 31C) provided in the imaging device and to receive the receiving force applied by the force applying portion 9, and thereby to force the developing member 11 and the photosensitive member 21 to separate from each other. When the processing cartridge 1 is moved backwards (detaching process), the second force receiving surface 6*n*22 is pressed by the blocking member B (as shown in FIG. 32B), so that the separating force receiving member 6*n* rotates around the rotation axis L rotates and thereby makes the movable assembly 6 reach the third state from the second state. At this time, the movable assembly 6 can smoothly pass the position where the blocking member B is located. Furthermore, the separating force receiving member 6*n* further includes a protrusion 6*n*13 provided therein, and the holding member 6*p* is in contact with protrusion 6*n*13.

As described above, since the separating force receiving member 6*n* is supported by the sliding member 6*m*, the state of the separating force receiving member 6*n* is consistent with the state of the movable assembly 6. That is, when the movable assembly 6 is in the first state, the separating force receiving member 6*n* is also at the locked first state, at this time, at least a part of the separating force receiving member 6*n* is retracted into the processing cartridge 1, and will not interfere with the imaging device. When the movable assembly 6 is in the second state where it is unlocked and extended and can receive the separation force of the imaging device, the separation force receiving member 6*n* is also in the second state where it is unlocked and extended and can receive the separation force of the imaging device. When the movable assembly 6 is in the third state where it is in contact with the blocking member B, the separating force receiving member 6*n* is also in the third state where it is in contact with the blocking member B and rotate around the rotation axis L under the action of the blocking member B. That is, when the separating force receiving member 6*n* is in the second state, the separating force receiving member 6*n* can rotate around the rotation axis L, and can reciprocate between the second state and the third state under the action of an external force.

The installing and detaching processes of the processing cartridge 1 will be described below.

Figure 30A:
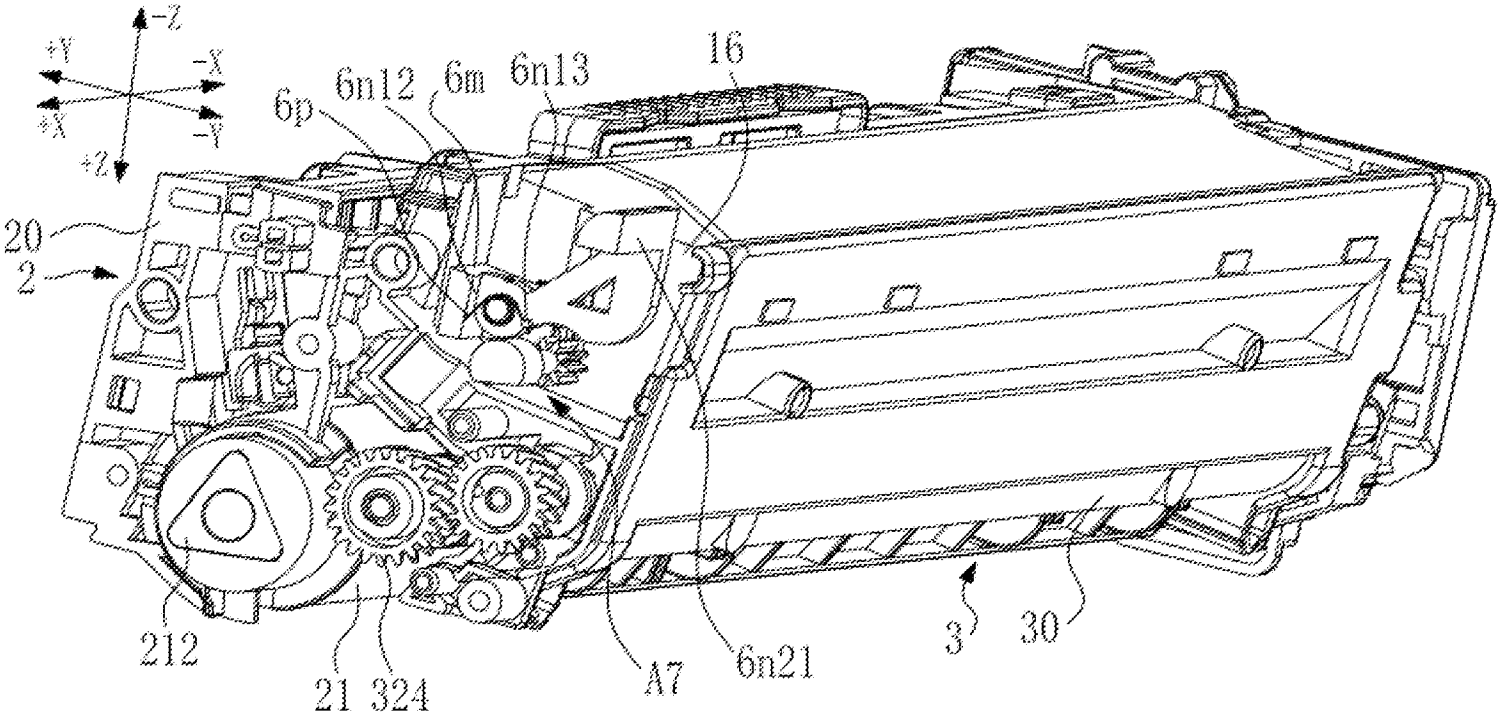
FIGS. 30A and 30B are diagrams showing the separating force receiving member in the processing cartridge in a first state according to the fifteenth embodiment of the present disclosure.
Figure 30B:
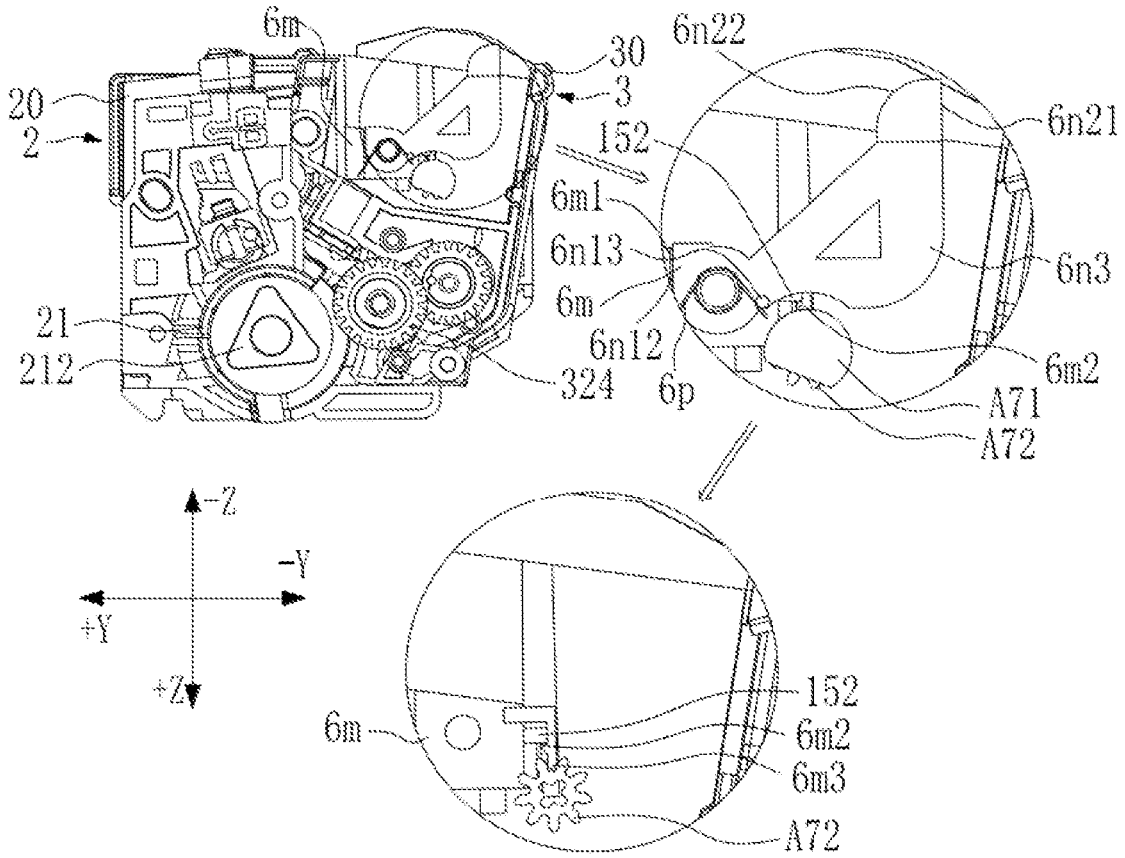

FIGS. 30A and 30B are diagrams showing the separating force receiving member in the processing cartridge in the first state according to the fifteenth embodiment of the present disclosure. FIGS. 31A, 31B and 31C are diagrams showing the separating force receiving member in the processing cartridge in the second state according to the fifteenth embodiment of the present disclosure. FIGS. 32A and 32B are diagrams showing the separating force receiving member in the processing cartridge in the third state according to the fifteenth embodiment of the present disclosure.

Firstly, the unlocking mechanism A7 will be described with reference to FIG. 28. The unlocking mechanism A7 includes a force transmission member A71 and an unlocking member A72 which are with each other. The force transmission member A71 is coupled to the first power receiving member 212 and passes through the bracket 31. The unlocking member A72 is coupled to the movable assembly. Through the movement of the force receiving member A71, the unlocking member A72 unlocks the separating force receiving member 6*n*. In certain embodiments, the developing frame 30 is provided with a guide rail (guide member) 15 and an accommodating portion 16. The sliding member 6*m* slides in the up-and-down direction in the guide rail 15, and a part of the separating force receiving member 6*n* can be accommodated by the accommodating portion 16, and after the separating force receiving member 6*n* is installed, the force transmission surface 6*n*12 is opposite to one of the side walls 6*m*1 of the sliding member 6*m*. In certain embodiments, the side wall 6*m*1 opposite to the force transmission surface 6*n*12 is also a planar surface. One end of the torsion spring 6*p* abuts against the sliding member 6*m*, and the other end abuts against the protrusion 6*n*13, the separation force receiving member 6*n* is held not to be inclined with respect to the up-and-down direction of the processing cartridge 1.

As shown in FIGS. 30A and 30B, the guide rail 15 is provided with a coupling portion 152, and the sliding member 6*m* is provided with a buckle 6*m*2 and an unlocked member 6*m*3 arranged adjacent to the buckle 6*m*2. When the buckle 6*m*2 is coupled to the coupling portion 152, the separating force receiving member 6*n* (the movable assembly 6) is locked and the second elastic member 65 is compressed. At this time, at least a part of the separating force receiving member 6*n* is located in the processing cartridge 1. The rotating portion 6*n*1 is located on the upper part of the guide rail 15 along with the sliding member 6*m*, a part of the connecting portion 6*n*3 and the force receiving portion 6*n*2 is accommodated by the accommodating portion 16. Under the action of the holding member 6*p*, along the up-and-down direction of the processing cartridge 1, the separating force receiving member 6*n* will not be inclined.

The processing cartridge 1 is installed in the imaging device. Before starting to work, the first power receiving member 212 will rotate by a certain angle along with the force output member coupled therewith. As the first power receiving member 212 rotates, the force transmission member A71 and the unlocking member A72 coupled to the first power receiving member 212 also start to rotate. During the rotation of the unlocking member A72, the unlocking member A72 gradually toggles the unlocked part 6*m*3 so as to disengage the buckle 6*m*2 from the coupling portion 152. Finally, the separating force receiving member 6*n* (movable assembly 6) is unlocked. Under the action of the elastic restoring force of the second elastic member 65, the movable assembly 6 entirely moves along the up-and-down direction of the processing cartridge 1. For example, the movable assembly 6 moves towards the bottom of the processing cartridge 1 until the movable assembly 6 reaches the second state shown in FIGS. 31A-31C. At this time, at least a part of the movable assembly 6 extends out of the processing cartridge 1. As the unlocked member 6*m*3 moves downward with the sliding member 6*m*. Even though the unlocking member A72 still rotates with the rotation of the first power receiving member 212, the unlocked member 6*m*3 has been disengaged from the unlocking member A72. Therefore, the moving unlocking member A72 will not interfere with the unlocked member 6*m*3.

As shown in FIGS. 31A and 31B, while the movable assembly 6 moves towards the bottom of the processing cartridge 1, the force receiving member 6*n* will not be inclined with respect to the up and down direction of the processing cartridge 1 under the holding action of the holding member 6*p*. Since the holding member (torsion spring) 6*p* is close to the rotation center 6*n*11, a large force needs to be applied to the torsion spring 6*p* to keep the connecting portion 6*n*3 and the force receiving portion 6*n*2 of the separating force receiving member 6*n* not inclined. In the present disclosure, since the sliding member 6*m* and the separating force receiving member 6*n* are planar surfaces faced with each other. That is, the flat force transmission surface 6*n*12 is opposite to the flat side wall 6*m*1. Even if the force applied by the torsion spring 6*p* is too large, the separation force receiving member 6*n* will not rotate unnecessarily, thereby ensuring that the separating force receiving member 6*n* is stably held.

When the movable assembly 6 is in the second state, the first force receiving surface 6*n*21 faces the front of the processing cartridge 1, and is opposite to the force applying portion 9 in the imaging device. When the force applying portion 9 moves in the +Y direction of the processing cartridge 1, the first force receiving surface 6*n*21 can receive the separating force, as shown in FIG. 31C, the separating force receiving member 6*n* has a tendency to rotate in the direction shown by r2. The separating force is transmitted to the developing frame 30 via the force transmission surface 6*n*12, the side wall 6*m*1 and the guide rail 15. Finally, the developing frame 30 is separated from the imaging frame 20, and at the same time, the developing member 11 and the photosensitive member 21 are also separated from each other.

The detaching process of the processing cartridge 1 is described with reference to FIGS. 32A and 32B below.

When the processing cartridge 1 is detached, it must firstly move in the +Y direction, and then be lifted in the −Z direction. When the separating force applied by the force applying portion 9 is removed, the developing frame 30 and the imaging frame 20 resume contact, and at the same time, the developing member 11 and the photosensitive member 21 also resumes contact, but the separating force receiver 6*n* is still in the second state, that is, the force receiver is located outside the processing cartridge 1. When the processing cartridge 1 is moved in the +Y direction, the force receiving portion 6*n*2 may interfere with the blocking member B in the imaging device, and then affect the detaching of the processing cartridge 1.

As described above, the rotating portion 6*n*1 of the separating force receiving member 6*n* is provided with a turning surface 6*n*14. In certain embodiments, the turning surface 6*n*14 is non-planar. For example, the turning surface

6n14 is a curved surface, that is, when the separating force receiving member 6n has a tendency to rotate in r2' direction opposite to r2 direction, the side wall 6m1 will not interfere with the rotating portion 6n1 of the separating force receiving member 6n. As shown in FIGS. 32A and 32B, as the processing cartridge 1 moves in the backward direction, the blocking member B applies a force opposite to the direction of the separation force to the movable assembly 6 so as to press the second force receiving surface 6n22, the separation force receiving member 6n rotate along the rotation axis L in r2' direction opposite to r2 direction, the force transmission surface 6n12 gradually moves away from the side wall 6m1, and the turning surface 6n14 gradually approaches the side wall 6m1, the torsion spring 6p is elastically deformed. Since the turning surface 6n14 is non-planar, the side wall 6m1 will not block the rotation of 6n1, the force receiving portion 6n2 can move to a position where it does not interfere with the stopper B. At this time, along the Z direction of the processing cartridge 1, the separating force receiving member 6n is in the third state of incline (turning over). For example, the separating force receiving member 6n is inclined towards the −Y direction of the processing cartridge 1. In certain embodiments, the second force receiving surface 6n22 is a curved surface, and the second force receiving surface 6n22 can smoothly transit to the position where it is pressed the blocking member B. The incline (turning over) of the separating force receiving member 6n means the position along the Z direction of the processing cartridge 1 when at least a part of the separating force receiving member 6n, especially the part for receiving the separating force (the first force receiving surface 6n21) being pressed by the blocking member B, different from position when the part for receiving the separating force (the first force receiving surface 6n21) receiving the separating force applied by the force applying portion 9.

After the separating force receiving member 6n passes through the blocking member B, the separating force receiving member 6n is restored to the second state under the action of the restoring force of the torsion spring 6p. That is, after the processing cartridge 1 is detached, at least the force receiving portion 6n2 of the separating force receiving member 6n is located outside the processing cartridge 1. When the processing cartridge 1 needs to be installed again, the user needs to firstly press the movable assembly 6 (the separating force receiving member 6n) in the +Z direction along the Z direction of the processing cartridge 1, so that the sliding member 6m moves along the guide rail 15 in the +Z direction, and the force receiving portion 6n2 enters the accommodating cavity 16. Finally, the movable assembly 6 retracts back to the first state in the processing cartridge 1 again.

It can be known by the above description that during the period when the processing cartridge 1 is assembled to the imaging device until the processing cartridge 1 is installed to the imaging device again, the movable assembly 6 (the separating force receiving member 6n) moves from the first state of not being capable of receiving the separating force to the second state of being capable of receiving the separating force. During the process of the processing cartridge 1 being out of contact from the imaging device, when the movable assembly 6 (the separating force receiving member 6n) interfere with the blocking member B, the movable assembly 6 (the separating force receiving member 6n) moves from the second state to the third state, and after passing through the blocking member B, the movable assembly 6 (the separating force receiving member 6n) is restored from the third state to the second state until the processing cartridge 1 is out of contact from the imaging device. Along the Z direction of the processing cartridge 1, the third state of the separating force receiving member 6n is between the first state and the second state. Before the processing cartridge 1 needs to be installed again, the movable assembly 6 (the separating force receiving member 6n) moves from the second state to the first state under the action of external force. Through the coupling of the buckle 6m2 and the coupling portion 152, the separating force receiving member 6n is locked again, and thus the processing cartridge 1 can be smoothly installed to the imaging device.

Taking the rotation axis L2 of the developing member 11 as a reference, when the movable assembly 6 (the separating force receiving member 6n) is in the first, the second or the third state, along the Z direction of the processing cartridge 1, the distance between the first force receiving surface 6n21 (the surface for receiving the separating force) and the rotation axis L2 gradually increases, and thus the processing cartridge 1 can be smoothly installed in the imaging device, and receive the separating force stably. Also, it can be removed from the imaging device smoothly.

Sixteenth Embodiment

Figure 33:
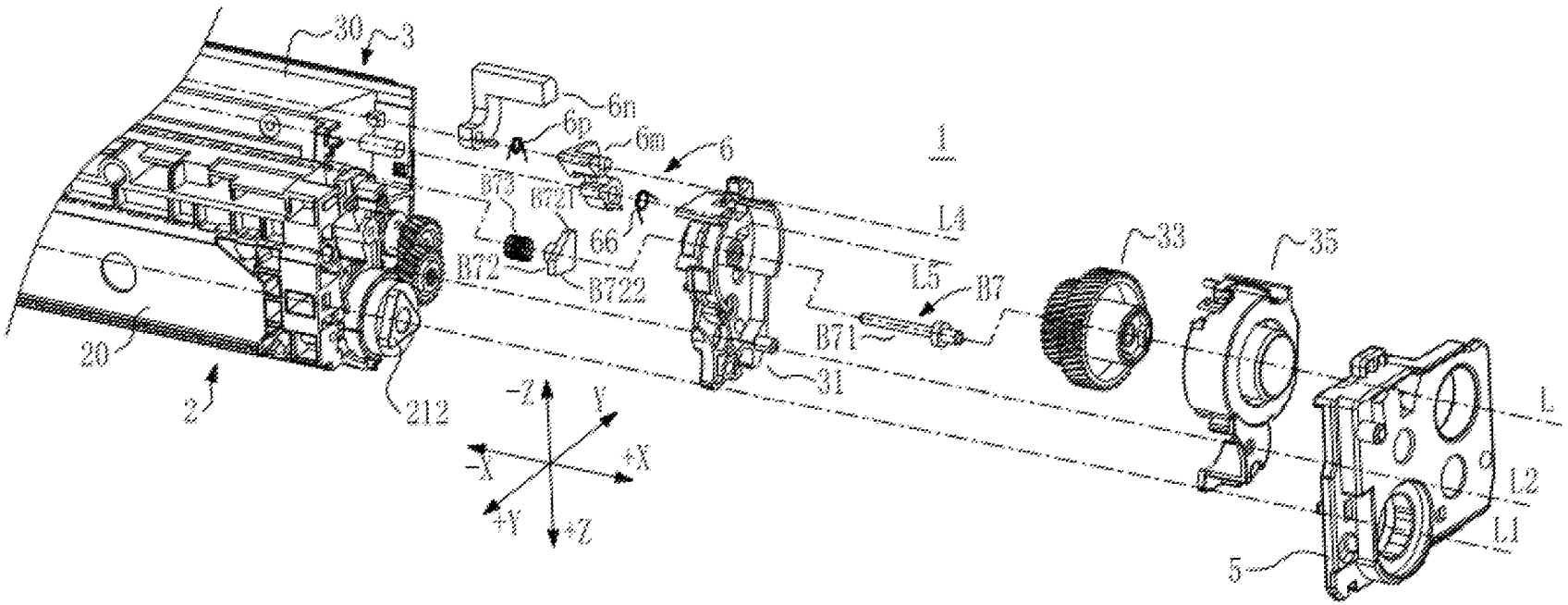
FIG. 33 is an exploded diagram of part of components of a driving end in a processing cartridge according to a sixteenth embodiment of the present disclosure.
Figure 34A:
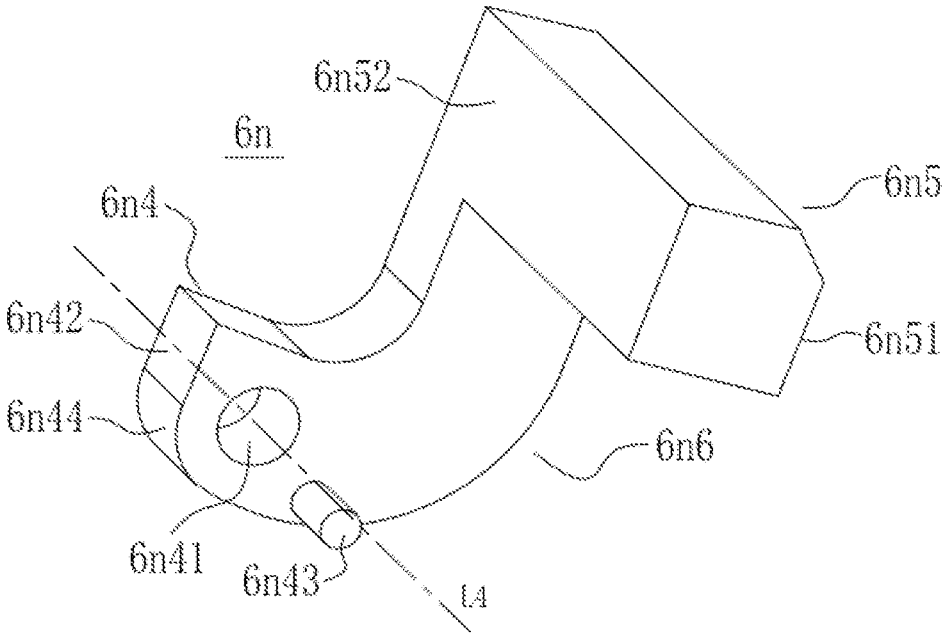
FIG. 34A is a perspective view of a first movable assembly in the processing cartridge according to the sixteenth embodiment of the present disclosure.
Figure 34B:
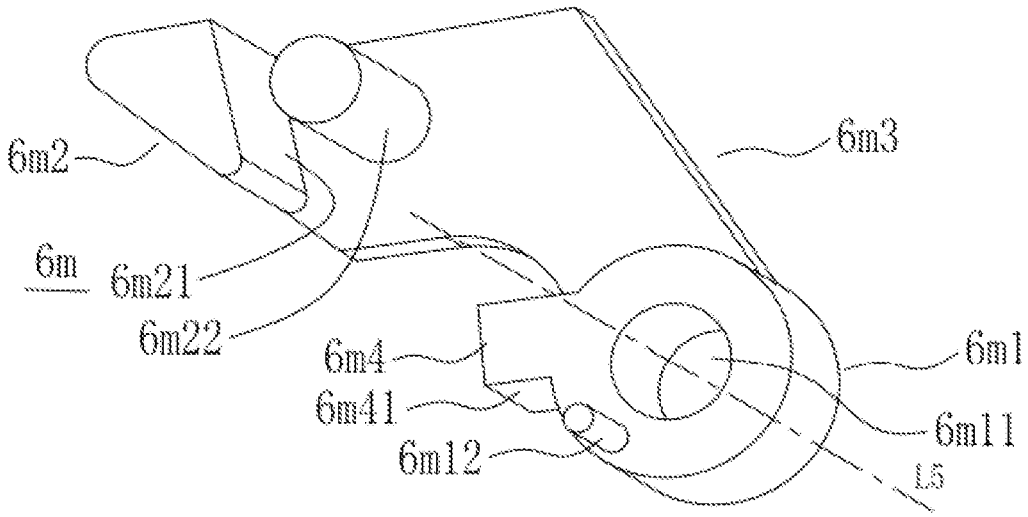
FIG. 34B is a perspective view of a second movable assembly in the processing cartridge according to the sixteenth embodiment of the present disclosure.

FIG. 33 is an exploded diagram of part of the components of the driving end in the processing cartridge according to the sixteenth embodiment of the present disclosure. FIG. 34A is a perspective view of the first movable assembly in the processing cartridge according to the sixteenth embodiment of the present disclosure. FIG. 34B is a perspective view of the second movable assembly in the processing cartridge according to the sixteenth embodiment of the present disclosure.

In this embodiment, the entire structure of the processing cartridge 1 is unchanged. The difference from the fifteenth embodiment is that the structure of the movable assembly and the unlocking mechanism are redesigned. Hereinafter, the same components in this embodiment and the fifteenth embodiment will share the same reference signs.

As shown in FIG. 33, the unlocking mechanism B7 in this embodiment is installed in the processing cartridge 1 in a movable manner in the X direction. Among them, the movable assembly 6 and the unlocking mechanism B7 are coupled in a detachable manner, and thus, the movable assembly 6 has a locked state and an unlocked state unlocked by the unlocking mechanism B7.

The movable assembly 6 includes a plurality of movable members coupled with each other. At least a part of the plurality of movable members can move with respect to the developing frame 30. At least one movable member can move along the rotation axis L1 of the photosensitive member 21 or the rotation axis L2 of the developing member 11. As the movable assembly 6 is locked, the movable member cannot rotate. As the movable assembly 6 is unlocked, the movable member can rotate.

In certain embodiments, the movable member includes a first movable member (acting part) 6n and a second movable member (installing part) 6m that can move relative to each other. A first holding member 6p coupled to the first movable member 6n and the second holding member 66 coupled to the second movable member 6m, the first holding member 6p and the second holding member 66 are respectively configured to keep the first movable member 6n and the second movable member 6m at the holding position (the movable assembly 6 is in the second state described as below). The unlocking mechanism B7 includes a force transmission member B71, a stopper B72 and a restoring member B73. Among them, the force transmission member B71 is configured to receive the external force and transmit the force to the stopper B72, so that the stopper B72 restricts the movable assembly 6. After the external force is removed, the stopper B72 will be restored to the unrestricted movable assembly 6 under the action of the restoring force of the restoring member B73. As shown in this figure, the stopper B72 is provided with a restricting surface B721 and a contact surface B722. The restricting surface B721 is configured to restrict the movable assembly 6 and the contact surface B722 is in contact with the developing frame 30 for transmitting the separating force to the developing frame 30.

In this embodiment, the first movable member 6*n* and the second movable member 6*m* can rotate around the rotation axes L4 and L5, respectively. The rotation axes L4 and L5 are both paralleled with the rotation axes L1 and L2. The first movable member 6*n* is supported and guided by the second movable member 6*m*. Before the processing cartridge 1 is installed at the predetermined position and after the processing cartridge 1 disengages from the predetermined position, the movable assembly 6 is not locked and cannot receive the separating force for disengaging the he developing member 11 and the photosensitive member 21. The processing cartridge 1 can be smoothly assembled and detached by the rotation of the first movable member 6*n* relative to the second movable member 6*m*. When the processing cartridge 1 reaches the predetermined position, the movable assembly 6 is locked, the first movable member 6*n* cannot rotate relative to the second movable member 6*m*, and the movable assembly 6 can receive the separation force for disengaging the he developing member 11 and the photosensitive member 21.

In certain embodiments, the movable assembly 6 is installed at the end of the developing frame 30 in the +X direction, the unlocking mechanism B7 passes through the bracket 31. For example, the force transmission member B71 passes through the bracket 31, and the force transmission member B71 also passes through the second power receiving member 33 to be exposed. When the processing cartridge 1 reaches the predetermined position, the force transmission member B71 receives the external force, and the stopper B72 locks the movable assembly 6. Before the processing cartridge 1 is installed at the predetermined position and after it is disengaged from the predetermined position, the force transmission member B71 no longer receives external force, and the stopper B72 unlocks the movable assembly 6 under the action of the reset member B73. The movable assembly 6 can also be installed on the bracket 31 in the +X direction. At this time, the force transmission member B71 no longer needs to pass through the bracket 31, which is beneficial to reduce the assembly process of the processing cartridge 1.

As shown in FIG. 34A, the first movable member 6*n* includes a first force transmission portion 6*n*4, a first force transmission portion 6*n*5, and a first connecting portion 6*n*6 which connects the first force transmission portion 6*n*4 with the first force transmission portion 6*n*5. The first force transmission portion 6*n*5 is configured to receive the external force. The first force transmission portion 6*n*4 is configured to transmit the external force. The first force transmission portion 6*n*4 includes the first rotation portion 6*n*41, on the surface of which is provided with a first force transmission surface 6*n*42 and a turning surface 6*n*44. The first rotation portion 6*n*41 rotates around the rotation axis L4, and the first force transmission surface 6*n*42 and the turning surface 6*n*44 are arranged adjacent to each other. Thus, first movable member 6*n* can rapidly switch between transferring force outward and turning over. In certain embodiments, the turning surface 6*n*44 is a curved surface.

Similarly with the aforementioned embodiments, the first force transmission portion 6*n*4 further includes a protrusion 6*n*43 provided on the first rotation portion 6*n*41, the first holding member 6*p* is preferred to as a torsion spring 6*p*. One end of the first holding member 6*p* abuts against the second movable member 6*m* and the other end of which abuts against the protrusion 6*n*43. The first force transmission portion 6*n*5 is configured to receive the external force, which includes a first force receiving surface 6*n*51 for receiving the separating force and a second force receiving surface 6*n*52 for receiving the rotating force.

As shown in FIG. 34B, the second movable member 6*m* includes a second force receiving portion 6*m*2, a second force transmission portion 6*m*1, and a second connecting portion 6*m*3 which connects the second force transmission portion 6*m*1 with the second force receiving portion 6*m*2. The second force receiving portion 6*m*2 is configured to receive the force (separating force) transmitted from the first movable portion 6*n*. The second force transmission portion 6*m*1 is configured to transmit the force (separating force). The second force receiving portion 6*m*2 is provided with a third force receiving surface 6*m*21 opposite to the first force transmission surface 6*n*42. The second force transmission portion 6*m*1 includes a second rotating portion 6*m*11, on the surface of which is provided with a second force transmission surface 6*m*41. The second rotating portion 6*m*11 rotates around the rotation axis L5. In certain embodiments, the first force transmission surface 6*n*42, the third force receiving surface 6*m*21, and the second force transmission surface 6*m*41 are all planar surfaces.

Similarly, the second movable member 6*m* is also provided with a protrusion 6*m*12, and the second holding member 66 is preferably a torsion spring. One end of the torsion spring abuts against the developing frame 30 or the bracket 31, and the other end abuts against the protrusion 6*m*12. Further, the first rotating portion 6*n*41 and the second rotating portion 6*m*11 are all round holes. The second movable portion 6*m* is further provided with a cylinder 6*m*22. The first rotating portion 6*n*41 is coupled to the cylinder 6*m*22. The developing frame 30 or the bracket 31 is also provided with a cylinder, and the second rotating portion 6*m*11 is coupled to the cylinder.

Furthermore, the second force transmission surface 6*m*41 is a surface of the extension bump 6*m*4 extending from the surface of the second rotating portion 6*m*11. The extension bump 6*m*4 protrudes toward the direction close to the second force receiving portion 6*m*2 to prevent the extension bump 6*m*4 from interfering the rotation of the second movable member 6*m*.

Figure 35A:
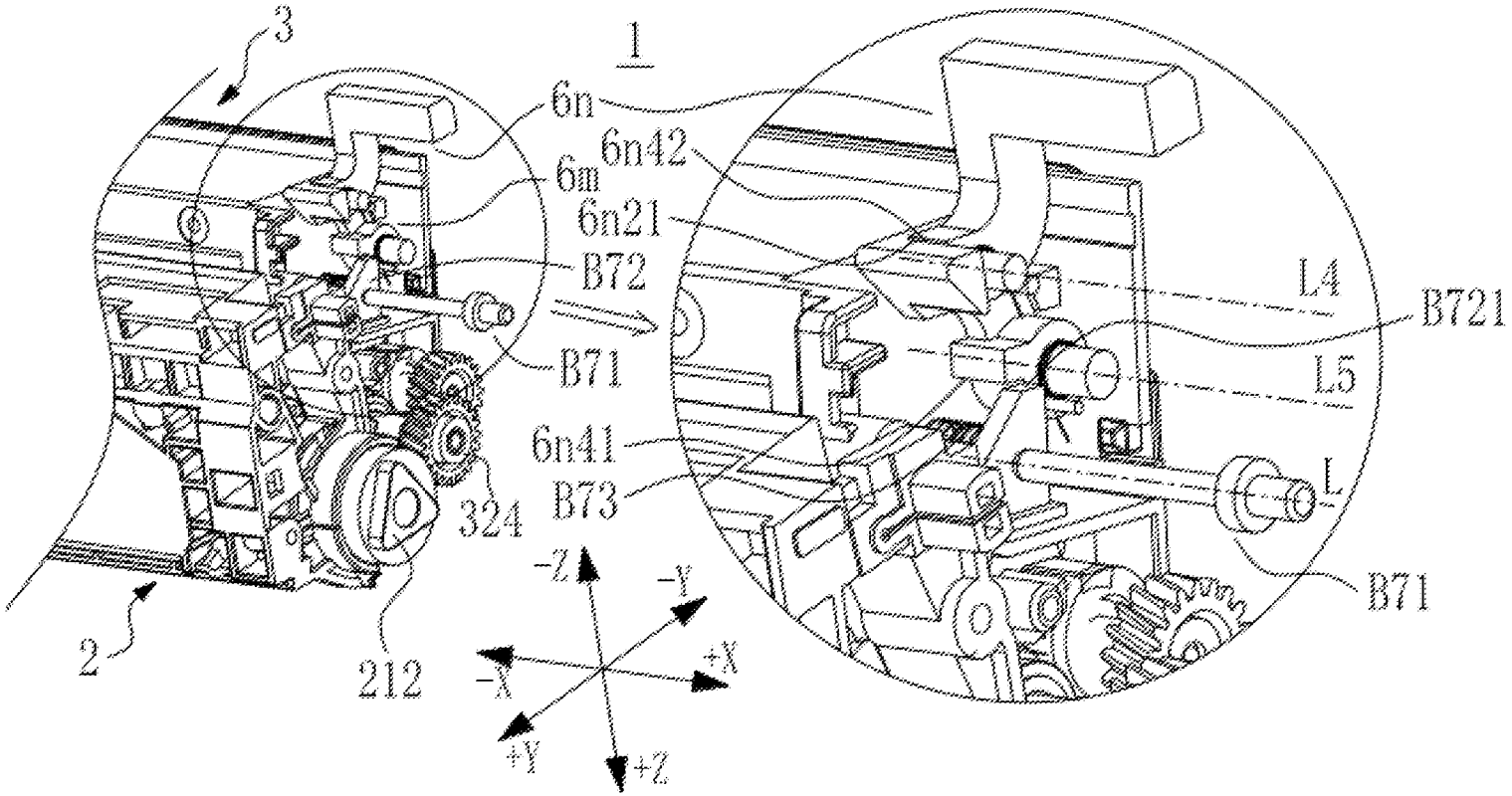
FIGS. 35A, 35B and 35C are diagrams showing movement of a separating force receiving member when the processing cartridge is being installed according to the sixteenth embodiment of the present disclosure.
Figure 35B:
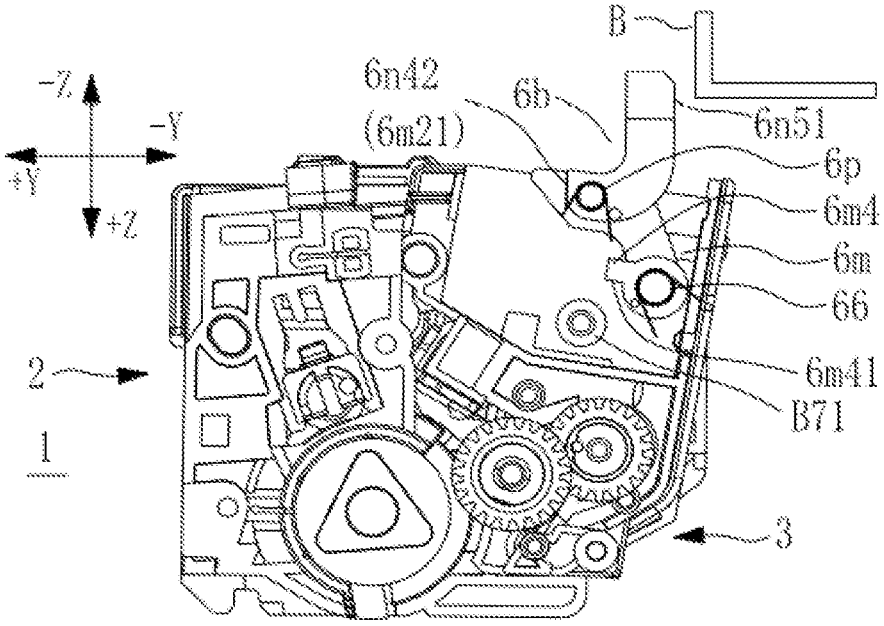
Figure 35C:
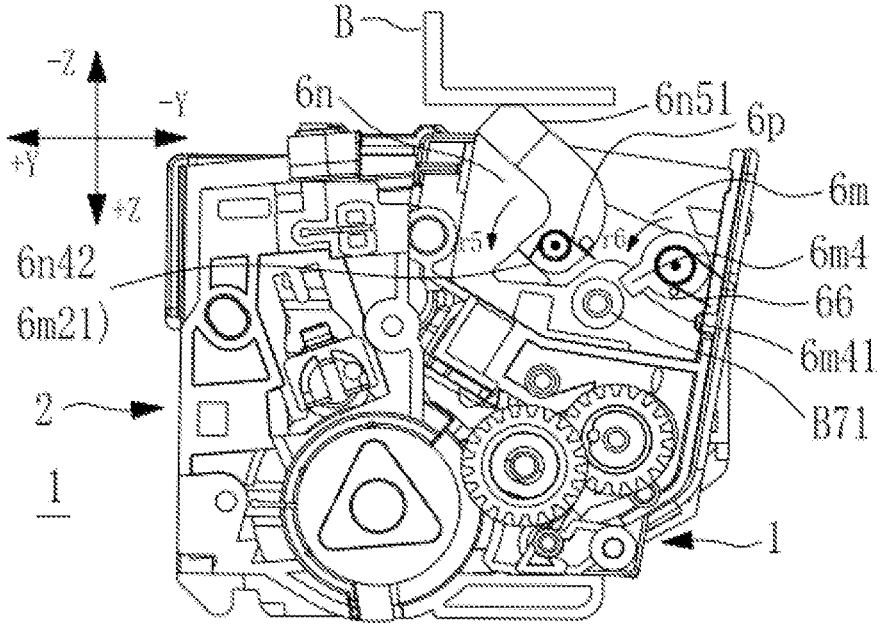

FIGS. 35A, 35B and 35C are diagrams showing the movement of the separating force receiving member when the processing cartridge according to the sixteenth Embodiment is being installed.

Before the processing cartridge 1 is installed at the predetermined position, the movable assembly 6 is in the protruding state. At this time, at least a part of the movable assembly 6 is located outside the processing cartridge 1, but the movable assembly 6 is not locked. As shown in FIG. 35A, in the Z direction of the processing cartridge 1, the second force transmission surface 6*m*41 is not opposite to the restricting surface B721, or in other words, in the X direction of the processing cartridge 1, the second force transmission surface 6*m*41 and the restricting surface B721 are staggered from each other. Therefore, when the first movable member 6*n* is under the action of external force, the first movable member 6*n* and the second movable member 6*m* can move relative to each other.

As shown in FIG. 35B, when the processing cartridge 1 moves towards the −Y direction in the Y direction, the blocking member B and the first movable member 6*n* will form an interference. When the first movable member 6*n* touches the blocking member B, the blocking member B applies a blocking force in the opposite direction of the separating force to the first force receiving surface 6*n*51 of the first movable member 6*n*. As shown in FIG. 35C, the first movable member 6*n* can rotate along the direction shown by r5 in the figure. At the same time, the first movable member 6*n* transfers the blocking force to the third force receiving surface 6*m*21 through the first force transmission surface 6*n*42 and thereby causes the first movable member 6*n* and the second movable member 6*m* to respectively overcome the holding force of the torsion spring 6*p* and the torsion spring 66 and rotate along the direction respectively shown by r5 and r6. In this embodiment, r5 and r6 are in the same direction which are counterclockwise. Along the up-and-down direction of the processing cartridge 1, the rotation centers of the first movable member 6*n* and the second movable member 6*m* are not in the same straight line. There exists two situations: in the direction from back to front, when the rotation center of the first movable member 6*n* is in the upstream of the rotation center of the second movable member 6*m*, r5 and r6 are preferably in the same direction. Further, when the rotation center of the first movable member 6*n* is in the downstream of the rotation center of the second movable member 6*m*, r5 and r6 are preferably opposite to each other. This design is beneficial to reduce the space required by the movable assembly 6 in the Z direction and will not affect the arrangement of the developing member gear 324. When the first movable member 6*n* and the second movable member 62 rotate, only the space in the Y direction needs to be provided, which is beneficial to reduce the space occupied by the processing cartridge 1 and the imaging device in the up-and-down direction.

In order to show the movement of the components in the movable assembly 6 more clearly, the stopper B72 is omitted in FIG. 35C. Since the stopper B72 do not restrict the movable assembly 6 (the second movable member 6*m*), when the first movable member 6*n* transmits the blocking force to the second movable member 6*m*, both the first movable member 6*n* and the second movable member 6*m* can rotate in the counterclockwise direction in FIG. 35C. Therefore, at least a part of the movable assembly 6 retracts back into the processing cartridge 1. At this time, the movable assembly 6 (the first movable member 6*n*) is in the first state, at least the first movable part 6*n* is inclined, and the first movable part 6*n* is inclined in the +Y direction and is pressed by the blocking member B, and the processing cartridge 1 can smoothly pass through the blocking member B. When the processing cartridge 1 passes through the blocking member B, under the action of the torsion spring 6*p* and the torsion spring 66, the first movable member 6*n* and a second movable member 6*m* rotate around the direction opposite to r5 and r6 in FIG. 35C, and the movable assembly 6 returns to the second state in which at least a part of the movable assembly 6 is located outside the processing cartridge 1.

Figure 36A:
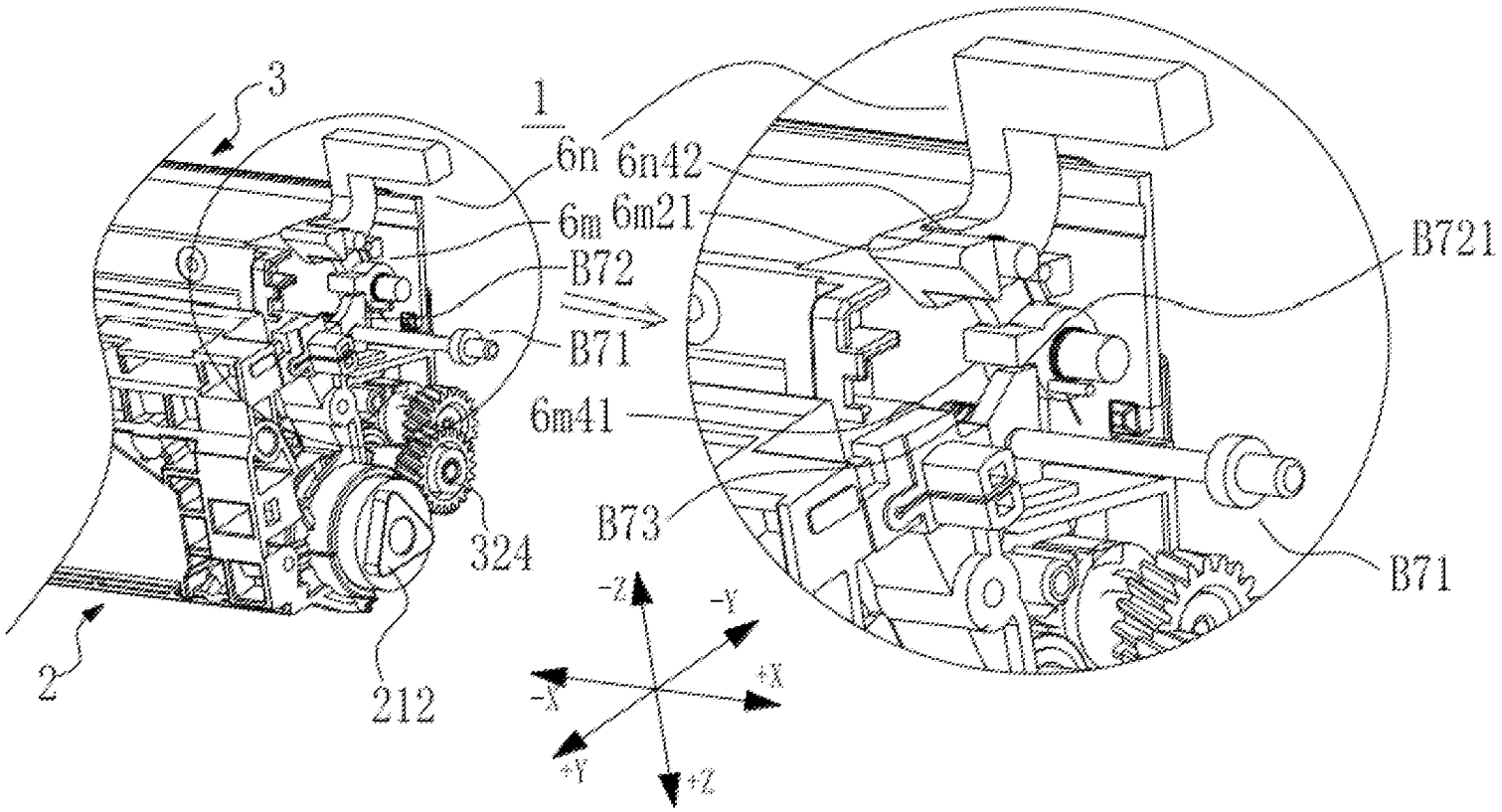
FIGS. 36A and 36B are diagrams showing separating force receiving member receiving the separating force after the processing cartridge is installed in a predetermined position according to the sixteenth embodiment of the present disclosure.
Figure 36B:
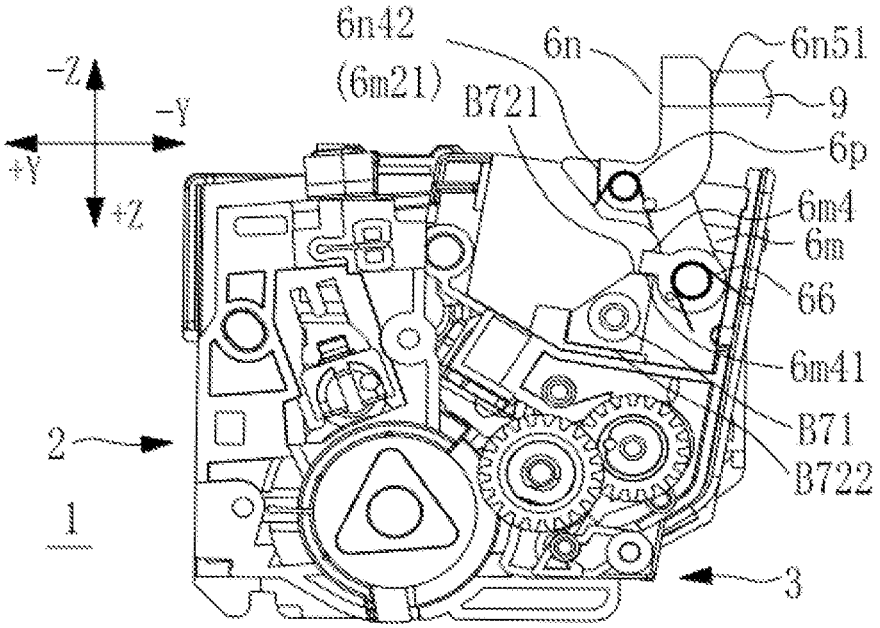

FIGS. 36A and 36B are diagrams showing the separating force receiving member according to the sixteenth embodiment receiving the separating force after the processing cartridge is installed in the predetermined position.

When the processing cartridge 1 is installed to the predetermined position, the force transmission member B71 receives the force from the imaging device and moves to the inside of the processing cartridge 1. In the embodiments of the present disclosure, the force transmission member B71 moves in the −X direction, and at the same time, forces the stopper B72 to overcome the restoring force of the restoring member B73, so that the stopper B72 reaches the position of restricting the movable assembly 6. At this time, the movable assembly 6 is locked, and in the Z direction of the processing cartridge 1, the restricting surface B721 is opposite to the second force transmission surface 6*m*41.

As shown in FIGS. 36A and 36B, the movable assembly 6 (the first movable member 6*n*) is in the second state, and the force applying portion 9 and the first force receiving surface 6*n*51 are opposite to each other. When the force applying portion 9 applies a separating force to the first force receiving surface 6*n*51, the first movable member 6*n* transmits the separating force to the second movable member 6*m* through the first force transmission surface 6*n*42 and the third force receiving surface 6*m*21. Since the second movable member 6*m* is restricted (locked) by the stopper B72, the separation force transmitted to the second movable member 6*m* will be transmitted to the restricting surface B721 through the second force transmission surface 6*m*41. Further, the separation force is transferred to the developing frame 30 through the contact surface B722, causing the developing frame 30 to be separated from the imaging frame 20, and the developing member 11 and the photosensitive member 21 are separated from each other.

Figure 37A:
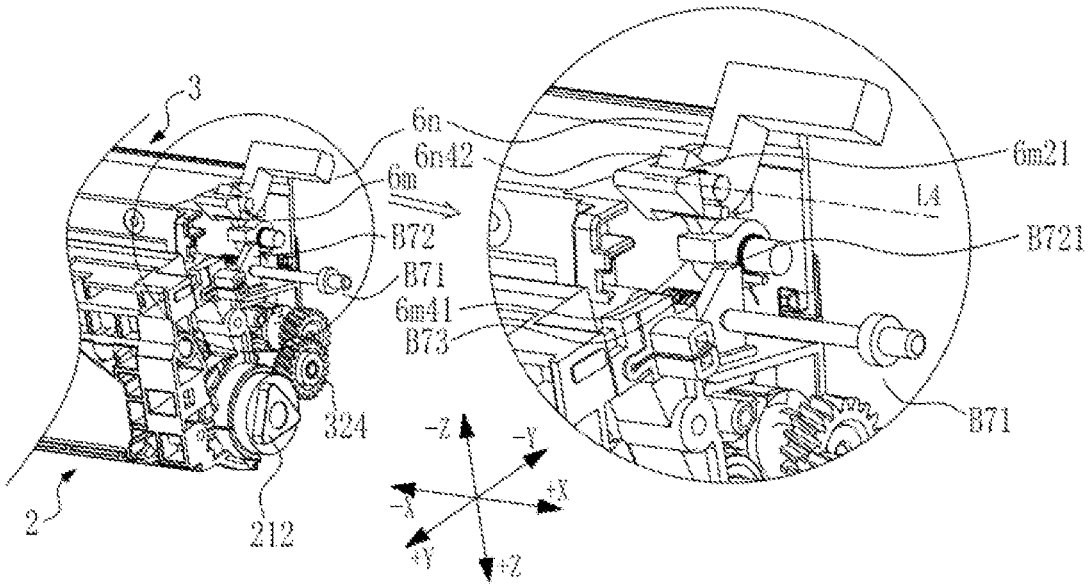
FIGS. 37A and 37B are diagrams showing movement of the separating force receiving member when the processing cartridge is being taken out according to the sixteenth embodiment of the present disclosure.
Figure 37B:
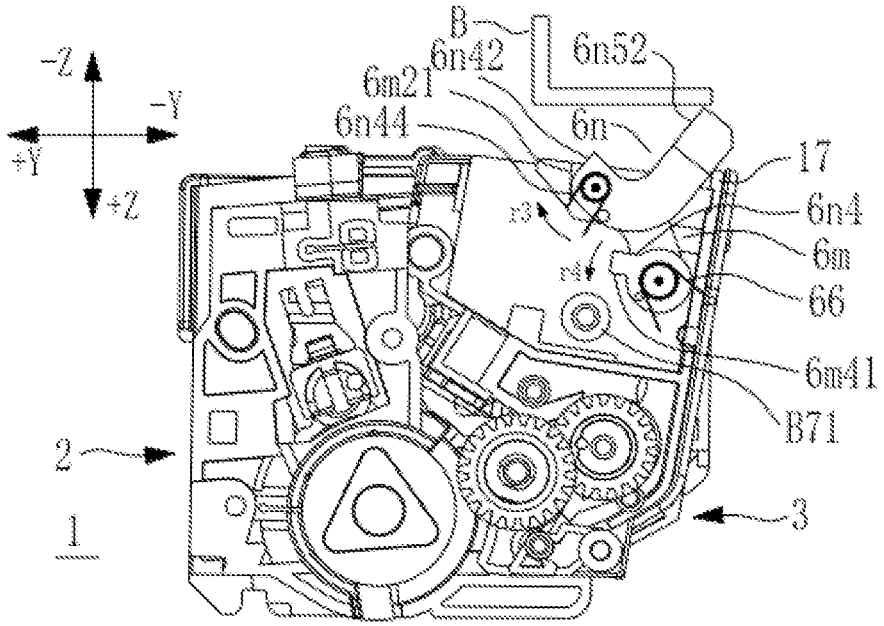

FIGS. 37A and 37B are diagrams showing the movement of the separating force receiving member according to the sixteenth embodiment when the processing cartridge is being taken out.

When the processing cartridge 1 needs to be taken out (detached) from the imaging device, the processing cartridge 1 firstly needs to be detached from the predetermined position. When the force transmission member B71 no longer receives the force from the imaging device, and the stopper B72 moves to the position where the restricting surface B721 is no longer opposite to the second force transmission surface 6*m*41 under the action of the restoring force of the restoring member B73. That is, the movable assembly 6 is no longer locked, but the movable assembly 6 still maintains in a protruding state in which at least a part of the movable assembly 6 is kept outside the processing cartridge 1.

As shown in FIGS. 37A and 37B, as the processing cartridge 1 moves backward, the second force receiving surface 6*n*52 of the first movable member 6*n* gradually approaches the blocking member B. As described above, an arc-shaped turning surface 6*n*44 is provided adjacent to the first force transmission surface 6*n*42. When the two are in contact, the second force receiving surface 6*n*52 receives the blocking force from the blocking member B, and the first movable member 6*n* starts to rotate clockwise along the direction shown by r3, until the first movable member 6*n* is completely pressed by the blocking member B. At this time, the movable assembly 6 (the first movable member 6*n*) is in the third state of incline (turning over), and the first movable member 6*n* is inclined in the −Y direction. Finally, the processing cartridge 1 smoothly pass through the blocking member B. Then, under the action of the first holding member 6*p*, at least a part of the first movable member 6*n* is located outside the processing cartridge 1 again, and the movable assembly 6 returns to the second state again. Similarly, in this embodiment, on the basis of the rotation axis L2 of the developing member 11, when the movable assembly 6 is in the first, third, and second states, along the Z direction of the processing cartridge 1, the distance between the first force receiving surface **6*n*21** (the surface for receiving the separating force) and the rotation axis L2 gradually increases.

Under extreme situations, as shown in FIG. 37B, when the first movable member **6*n* rotates in the direction shown by r3 and is in contact with the housing 17 of the developing frame 30, but the first movable member 6*n* is still not pressed by the blocking member B, there will still be interference between the first movable member 6*n* and the blocking member B. At this time, the processing cartridge 1 will not be capable of being taken out continuously. For the movable assembly 6 involved in this embodiment, when the processing cartridge 1 moves in the +Y direction, the stopper B72 has already removed the restriction on the movable assembly 6. As the processing cartridge 1 continues to move in the +Y direction, the blocking member B will press the first force transmission portion 6*n*5 of the first movable member 6*n* and transmits the pressing force to the second force receiving portion 6*m*2 of the second movable member 6*m* through the first rotation portion 6*n*41, and thereby causes the second movable member 6*m* to rotate in the direction shown by r4 in FIG. 37B, so that in the up-and-down direction of the processing cartridge 1, at least part of the movable assembly 6 retracts back to the processing cartridge 1. That is, the rotation of the second movable member 6*m* provides space for the first movable member 6*n*** to avoid interference with the blocking member B. In this embodiment, r3 and r4 are preferably opposite to each other.

The above describes the embodiments in which the movable assembly 6 includes two movable members that can move relative to each other. However, the purpose of the present disclosure can be achieved by combining the structures according to the fifteenth embodiment and the sixteenth embodiment. That is, the second movable member **6*m* in the sixteenth embodiment configured to be expandable and contractible in the Z direction, and the first movable member 6*n* still maintained rotatable. In other words, the number of movable members included in the movable assembly 6 is more than two. By means of that the adjacent movable members are configured to be relatively movable, one of the movable members is configured to receive the separating force, and one movable member is configured to transmit the separating force to the developing frame 30**, the objective of the present disclosure can also be achieved.

In the same way, the incline (turning over) of the movable assembly 6 in this embodiment means that along the Z direction of the processing cartridge 1, at least a part of the movable assembly 6, especially the position of the part (first force receiving surface **6*n*51) for receiving the separating force when pressed by the blocking member B, which is different from the position of the part (first force receiving surface 6*n*51) for receiving the separating force when receiving the separating force applied by the force applying portion 9**.

As described above, during the process of installation and removing the processing cartridge 1, the movable assembly 6 has the first state, the second state, and the third state. In the first state and the third state, the movable assembly 6 cannot receive the separation force. In the second state, the movable assembly 6 can receive the separation force. In the first state, at least a part of the movable assembly 6 retracts back into the processing cartridge 1 or is inclined (turned over), so that the blocking member B no longer interferes with the movement of the process cartridge 1. In the second state, at least a part of the movable assembly 6 extends out of the processing cartridge 1. In the third state, at least a part of the movable assembly 6 retracts into the processing cartridge 1 again or is inclined (turned over). In the same way, the blocking member B no longer interferes with the movement of the processing cartridge 1. Therefore, the processing cartridge 1 can be smoothly installed and removed.

According to the above description, for the sixteenth embodiment, the first state and the third state are interchangeable. That is, during the process of installing the processing cartridge 1, the state in which at least a part of the movable assembly 6 (the first movable member **6*n*) is inclined (turned over) in the +Y direction is regarded as the third state. During the process of taking out the processing cartridge 1, the state in which at least part of the movable assembly 6 (the first movable member 6*n*) is inclined (turned over) in the −Y direction is regarded as the first state. In the Y direction of the processing cartridge 1**, the second state is provided between the first state and the third state.

When the processing cartridge 1 including the movable assembly 6 is detachably assembled on the main body of the imaging device, it is only needed to apply a separating force on a force applying portion of the main body of the imaging device, unlike the separating mechanism in the processing cartridge according to EP 1977289 A in which the imaging device needs to be provided with two force applying portions. Therefore, the structure of the imaging device fit for the processing cartridge according to the present disclosure is simplified, the cost thereof can be reduced and miniaturization is easier to be realized.

As described above, at least a part of the movable assembly 6 can be installed in a movable manner. Even if the processing cartridge 1 falls down or collides, due to the fact that the movable assembly 6 has a certain amount of space to move, the risk that the movable assembly is broken can be greatly reduced.

What is claimed is:

1. A processing cartridge detachably installed in an imaging device having a force applying portion, comprising a first unit and a second unit coupled to each other, and a movable assembly capable of being coupled to the force applying portion and receiving a force applied by the force applying portion;

wherein when the processing cartridge is being assembled to the imaging device, the first unit and the second unit are capable of being switched between a state of approaching each other and a state of separating from each other, wherein the movable assembly comprises an installing part and an acting part that are capable of moving relative to each other and connectable with each other, the movable assembly is installed in the processing cartridge by the installing part, the acting part is coupled to the force applying portion and configured to receive a force applied by the force applying portion, to force the first unit and the second unit to switch from the state of approaching each other to the state of separating from each other;

the acting part is retractable relative to the installing part; and the acting part comprises an acting block, and a guide block guided by the installing part.

2. The processing cartridge according to claim 1, wherein the installing part is installed in the processing cartridge in a manner of being rotatable around an axis, and at least a part of the acting part is movable relative to the installing part.

3. The processing cartridge according to claim 1, wherein the installing part is installed in the processing cartridge in a manner of being rotatable around an axis, and a length of the movable assembly is variable in a movement direction of the acting part.

4. The processing cartridge according to claim 1, wherein the installing part is installed in the processing cartridge in a manner of being slidably guided by a guide member, and at least a part of the acting part is movable relative to the installing part.

5. The processing cartridge according to claim 4, further comprising an unlocking mechanism coupled to the movable assembly, wherein when the movable assembly is locked by a locking mechanism, at least a part of the movable assembly retracts back into the processing cartridge, and when the movable assembly is no longer locked by the locking mechanism, at least a part of the movable assembly protrudes out of the processing cartridge and receives a force from the force applying portion.

6. The processing cartridge according to claim 5, further comprising a power receiving member configured to receive power to drive a rotating member in the second unit to rotate, wherein the unlocking mechanism is coupled to the power receiving member, and as the power receiving member rotates, the unlocking mechanism unlocks the movable assembly.

7. The processing cartridge according to claim 5, wherein the unlocking mechanism is installed in a manner of being movable along a longitudinal direction of the processing cartridge.

8. The processing cartridge according to claim 1, wherein the processing cartridge further comprises an elastic member abutting against the acting part, and under an action of the elastic member, the acting part has a tendency to approach the installing part.

9. The processing cartridge according to claim 1, wherein a gap is formed between the acting part and a component forced by the acting part before the acting part receives a force applied by the force applying portion.

10. The processing cartridge according to claim 1, wherein an extending and retracting direction of the acting part is substantially parallel to a movement direction of the force applying portion.

11. The processing cartridge according to claim 1, wherein the movable assembly further comprise a restriction column provided on the installing part, and the restriction column is configured to abut against components except for the movable assembly.

12. The processing cartridge according to claim 1, wherein the installing part is installed in processing cartridge in a manner of being capable of moving along a straight line, the processing cartridge further comprises a rotating member rotatably installed therein, and when the acting part receives a force applied by the force applying portion, the first unit and the second unit are separated from each other by the acting part through forcing the rotating member in the second unit.

13. The processing cartridge according to claim 1, wherein the second unit is configured to accommodate toner, the first unit is configured to accommodate waste toner produced during a working process of the processing cartridge, and the installing part is installed in the first unit.

14. The processing cartridge according to claim 1, wherein the first unit is rotatably provided with a rotating member, and the installing part is installed on the rotating member.

15. The processing cartridge according to claim 11, wherein the rotating member comprises a photosensitive member for receiving toner, and the installing part is installed on the photosensitive member.

16. The processing cartridge according to claim 1, wherein when the processing cartridge is being installed to the imaging device, along a vertical direction of the processing cartridge, a free end of the movable assembly is not opposite to the force applying portion.

17. The processing cartridge according to claim 1, wherein the installing part is provided with an installing hole, and the guide block is accommodated by the installing hole and is movable in the installing hole.

* * * * *